US006544708B2

(12) United States Patent
Komoto et al.

(10) Patent No.: US 6,544,708 B2
(45) Date of Patent: Apr. 8, 2003

(54) IMAGE FORMING METHOD

(75) Inventors: Keiji Komoto, Numazu (JP); Hiroaki Kawakami, Yokohama (JP); Tatsuhiko Chiba, Kamakura (JP); Atsuyoshi Abe, Susono (JP); Yuji Moriki, Numazu (JP); Michihisa Magome, Shizuoka-ken (JP); Satoshi Handa, Shizuoka-ken (JP); Kiyokazu Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/817,340

(22) Filed: Mar. 27, 2001

(65) Prior Publication Data

US 2002/0048713 A1 Apr. 25, 2002

(30) Foreign Application Priority Data

| | | |
|---|---|---|
| Mar. 27, 2000 | (JP) | 2000-086485 |
| Mar. 27, 2000 | (JP) | 2000-086486 |
| Feb. 9, 2001 | (JP) | 2000-033058 |
| Feb. 9, 2001 | (JP) | 2001-033116 |

(51) Int. Cl.[7] ..... G03G 13/20

(52) U.S. Cl. ..... 430/124; 430/110.3; 430/111.4; 399/331

(58) Field of Search ..... 430/124, 110.3, 430/111.4; 399/330, 331, 332

(56) References Cited

U.S. PATENT DOCUMENTS

| | | | | |
|---|---|---|---|---|
| 4,970,219 A | | 11/1990 | Effland et al. | 514/339 |
| 5,149,941 A | | 9/1992 | Hirabayashi et al. | 219/216 |
| 5,210,579 A | | 5/1993 | Setoriyama et al. | |
| 5,525,775 A | | 6/1996 | Setoriyama et al. | 219/216 |
| 5,547,794 A | * | 8/1996 | Demizu et al. | 430/108.1 |
| 5,698,354 A | * | 12/1997 | Ugai et al. | 430/45 |
| 5,745,833 A | * | 4/1998 | Abe et al. | 399/330 |
| 5,747,211 A | * | 5/1998 | Hagi et al. | 430/111.4 |
| 6,177,223 B1 | | 1/2001 | Hashimoto et al. | 430/126 |
| 6,248,491 B1 | * | 6/2001 | Takayanagi et al. | 430/124 |

FOREIGN PATENT DOCUMENTS

| | | |
|---|---|---|
| JP | 51-109739 | 9/1976 |
| JP | 63-313182 | 12/1988 |
| JP | 2-157878 | 6/1990 |
| JP | 4-44075 | 2/1992 |
| JP | 4-204980 | 7/1992 |
| JP | 8-160675 | 6/1996 |
| JP | 8-202077 | 8/1996 |
| JP | 8-262795 | 10/1996 |
| JP | 11-249334 | 9/1999 |

* cited by examiner

*Primary Examiner*—Janis L. Dote
(74) *Attorney, Agent, or Firm*—Fitzpatrick, Cella, Harper & Scinto

(57) ABSTRACT

An image forming method using a dry toner and exhibiting good quick-start and power economization characteristics is provided. The image forming method includes a heat-pressure fixing step using a rotatable electromagnetic induction heat-generation type heating member. The toner used therein is characterized by a moisture content of at most 3.00 wt. %, and viscoelasticities as represented by a storage modulus at 110° C. of G' (110° C.) and a storage modulus at 140° C. of G' (140° C.) satisfying:

$$G'(110°\ C.) \leqq 1.00\times10^{6}\ dN/m^{2},$$

and $$G'(140°\ C.) \geqq 7.00\times10^{3}\ dN/m^{3}.$$

31 Claims, 12 Drawing Sheets

IMAGE FORMING METHOD

FIELD OF THE INVENTION AND RELATED ART

The present invention relates to an image forming method, such as electrophotography, electrostatic recording, magnetic recording and toner jetting; and more particularly to an image forming method wherein a toner image is transferred onto a transfer(-receiving) material (recording material) and fixed under heat and pressure to provide a fixed image.

Currently, a printer and a copying machine are required to fulfill high-speed as well as high resolution image formation. For coupling with these requirements, an increased process speed is a subject to be achieved, and particularly matching between a fixing device and a toner in a fixing process (or step) is crucially important.

Further, for such a fixing process, improvements in usability, such as suppression of power consumption and quick start performance are desired.

In such a fixing process, as a fixing apparatus for heat-fixing a toner image (yet-unfixed image) on a recording material, such as a transfer sheet, an electrofax sheet, an electrostatic recording sheet, a transparency sheet (OHP sheet), a printing sheet or format paper, a hot roller-type fixing apparatus has been widely used.

However, a hot roller-type fixing apparatus is accompanied with a problem that the fixing roller has a large heat capacity, so that even if a halogen lamp as a heat source for the fixing apparatus is started to be energized simultaneously with turning on a power supply to the image forming apparatus, it requires a considerable waiting time from a fully cooled-down state of the fixing roller until reaching a prescribed fixable temperature, thus leaving a problem regarding a quick start performance.

Further, even in a stand-by state (non-image forming period), the halogen lamp has to be kept energized so as to maintain a prescribed temperature state of the fixing roller, thus requiring a measure for preventing internal temperature increase in the image forming apparatus and posing a problem of increased power consumption.

For solving the above problem, film heating-type fixing apparatus have been described in, e.g., Japanese Laid-Open Patent Application (JP-A) 63-313182, JP-A 2-157878, JP-A 4-44075, and JP-A 4-204980.

In such a film heating-type fixing apparatus, a heat-resistant film (fixing belt) is inserted between a ceramic heater as a heating member and a pressure roller as a pressing member to form a nip, at which a recording material carrying a yet-unfixed toner image formed thereon is introduced between the film and the pressure roller and sandwiched and conveyed together with the film to supply a heat from the ceramic heater to the yet-unfixed image on the recording material via the film at the nip, thereby heat-fixing the toner image onto the recording material surface also under the action of a pressing force at the nip.

As a characteristic of the film heating-type fixing apparatus, the ceramic heater and the film can be composed of low-heat capacity members to provide an on-demand type device, thus allowing an image forming apparatus wherein the ceramic heater as the heat source is energized to be heated to a prescribed fixing temperature only at the time of image formation, so that the waiting time from the turning-on of the power supply of the image forming apparatus until reaching the image-forming allowable state is short (quick start characteristic) and the power consumption during the stand-by period is remarkably smaller (power economization).

However, the film heating-type fixing apparatus has left a room for improvement when used as a fixing apparatus for a full-color image forming apparatus or a high-speed image forming apparatus requiring a large heat supply. Also, further improvements, regarding improved fixing performance and prevention of difficulties, such as gloss irregularity of fixed images and offsetting, are desired.

As heating means, Japanese Laid-Open Utility Model Application (JP-Y) 51-109739 has disclosed an induction heating-type fixing apparatus wherein a fixing roller is heated with a Joule heat caused by a current passing through the fixing roller induced by application of magnetic flux. According to the proposal, the fixing roller is directly heated by utilizing a generated induction current, thus achieving a higher-efficiency fixing process than a heating-roller-type fixing apparatus using a halogen lamp as a heat source.

However, according to the induction heating roller fixing scheme, a large amount of Joule heat is required for sufficiently heating the roller from room temperature to a fixing temperature, so that it is difficult to shorten the waiting time from the time of power-on to an image forming apparatus to an image formation enabling state, thus achieving the so-called "on-demand fixation". Further, as the induction heating roller fixing scheme requires a sufficient preliminary heating of the fixing apparatus, the scheme is not desirable from the viewpoints of obviating temperature elevating in the apparatus and achieving power economization, thus requiring further improvement.

The fixing process generally involves the following problems.

The surface of a heating member, such as a heating roller or a heating film, contacts a toner image in a molten state under a pressure, a portion of the toner image is transferred by attachment onto the heating member surface and re-transferred onto a subsequent fixation sheet, thus soiling the fixation sheet. This is a so-called offset phenomenon, which is largely affected by the fixing speed and fixing temperature. In general, the heating member surface is set at a relatively low temperature in the case of a low-fixing speed, and set at a relatively high temperature in the case of a high fixing speed. This measure is taken to provide a substantially constant heat quantity for toner fixation regardless of a fixing speed.

A toner image on a fixing sheet is formed of a number of toner layers, so that in a fixing system of higher fixing speed thus requiring a higher surface temperature of heating member, there is a tendency of resulting in a larger temperature difference between the uppermost toner layer contacting the heating member and the lowermost toner layer contacting the fixing sheet. As a result, at a higher heating member surface temperature, the uppermost toner layer is liable to cause offset (high-temperature offset), and at a lower temperature, the lowermost toner layer liable to cause offset (low-temperature offset) because of a fixing failure due to insufficient fusion of the lowermost toner layer.

For solving the above problem, it has been generally practiced to elevate the fixing pressure at a higher fixing speed so as to cause anchoring of the toner onto the fixing sheet. According to this measure, it is possible to lower the heating member temperature to some extent and avoid the high-temperature offset of the uppermost toner layer. However, in this case, a very large shearing force acts on the toner, so that the fixing sheet is liable to be wound about the heating member, thus causing winding offset, or a separation claw trace is liable to be left on the resultant fixed image due to a severe action of the separation claw for separation of the fixing sheet from the heating member. Further, because of a higher pressure, the image quality degradation is liable to be cause due to collapse of line images or toner scattering at the time of fixing.

In a high-speed fixing system, a toner having a lower melt viscosity is generally used than in a low-speed fixing system so as to fix the toner image while obviating high-temperature offset and winding offset by lowering the heating member surface temperature and also the fixing pressure. However, when such a toner having a low melt viscosity is used in a low-speed fixing system, the high-temperature offset is liable to be caused.

As a further factor regarding the offset phenomenon, a smaller particle size toner is liable to result in a lower fixability of a halftone image. This is because at a halftone image portion, the toner coverage is low and a small-particle size toner transferred onto cavities on the fixing sheet receives a smaller heat quantity and the toner at the cavities receives also a lower fixing pressure due to obstruction by convexities of the fixing sheet. Further, a toner forming a halftone image and transferred to convexities of the fixing sheet receives a larger shearing force per toner particle because of a smaller toner layer thickness than in a thicker toner layer forming a solid image portion, thus being liable to cause offset and result in a lower quality of fixed image.

In order to solve such problems, it has been practiced to adjust a molecular weight distribution and a crosslinked component amount of a binder resin constituting the toner, so as to be adapted to an objective fixing process.

For example, JP-A 8-262795 has proposed a toner comprising a binder resin characterized by a molecular weight distribution based on gel permeation chromatography including high-molecular weight styrene-acrylic resin having a molecular weight peak in a molecular weight region of at least $5\times10^5$, styrene-acrylic resin having a molecular weight peak in a molecular weight region of $5\times10^4$–$5\times10^5$, styrene-acrylic resin having a crosslinked structure and polyester resin having a molecular weight peak in a molecular weight region of at most $5\times10^4$, but the toner has left a room for improvement regarding adaptability to a high-speed fixing system.

Moreover, the fixability of a toner is largely affected by a moisture content of the toner. This is because the moisture content of a toner is instantaneously vaporized at the time of fixation. As a result, at a high moisture content, the toner is liable to be insufficiently melted because a substantial portion of the heat from the fixing apparatus is consumed for vaporization of the moisture, or the fixation of toner is liable to be obstructed by generated steam. The difficulty is pronounced in a fixing system using a low fixing pressure. As a result, it has been desired to develop an image forming method providing high image quality and high fixing performance at the time of high-speed fixation.

JP-A 8-160675 and JP-A 8-202077 have disclosed an improvement in developing performance by adjustment of toner moisture content. However, no reference is made to the influence of moisture content on the fixability and matching with a fixing apparatus.

Further, JP-A 11-249334 has disclosed an influence of residual monomer content on the wax dispersion state to improve the low-temperature fixability. However, no reference is made to the influence of residual monomer content on fixed image quality and matching with a fixing apparatus.

SUMMARY OF THE INVENTION

A generic object of the present invention is to provide an image forming method using a dry toner having solved the above-mentioned problems of the prior art.

A more specific object of the present invention is to provide an image forming method including a fixing step showing excellent quick-start performance and power economization characteristic.

Another object of the present invention is to provide an image forming method using a dry toner capable of suppressing offset and exhibiting excellent matching with a fixing apparatus.

A further object of the present invention is to provide an image forming method capable of providing a fixed image of excellent image quality in formation of monotone images, or capable of providing a full-color or multi-color images of excellent quality free from image fixing irregularity.

According to the present invention, there is provided an image forming method, comprising:

heating and pressing a toner image onto a recording material by heat-pressure means to form a fixed image on the recording material, wherein said heat-pressure means comprises (i) magnetic flux generating means, (ii) a rotatable heating member having a heat generating layer capable of heat generation by electromagnetic induction and a release layer and (iii) a rotatable pressure member forming a fixing nip with the rotatable heating member, so that the toner image on the recording material is fixed under heat and pressure by pressing the rotatable pressure member against the rotatable heating member via the recording material, the toner image is formed of a toner comprising toner particles each containing at least a binder resin and a colorant, the toner has a moisture content of at most 3.00 wt. %, and the toner has a storage modulus at 110° C. of G' (110° C.) and a storage modulus at 140° C. of G' (140° C.) satisfying:

$$G'\ (110^\circ\ \mathrm{C.}) \leq 1.00\times10^6\ \mathrm{dN/m^2},\ \text{and}$$

$$G'\ (140^\circ\ \mathrm{C.}) \geq 7.00\times10^3\ \mathrm{dN/m^2}.$$

These and other objects, features and advantages of the present invention will become more apparent upon a consideration of the following description of the preferred embodiments of the present invention taken in conjunction with the accompanying drawings.

DETAILED DESCRIPTION OF THE INVENTION (1) Image forming method and apparatus (for color image formation)

The present invention is principally characterized by an image forming method for forming a fixed image on a recording material.

An embodiment of the image forming method according to the present invention will be described with reference to FIG. 1, which is a schematic illustration of an electrophotographic color printer as an example of an image forming apparatus.

Figure 1:
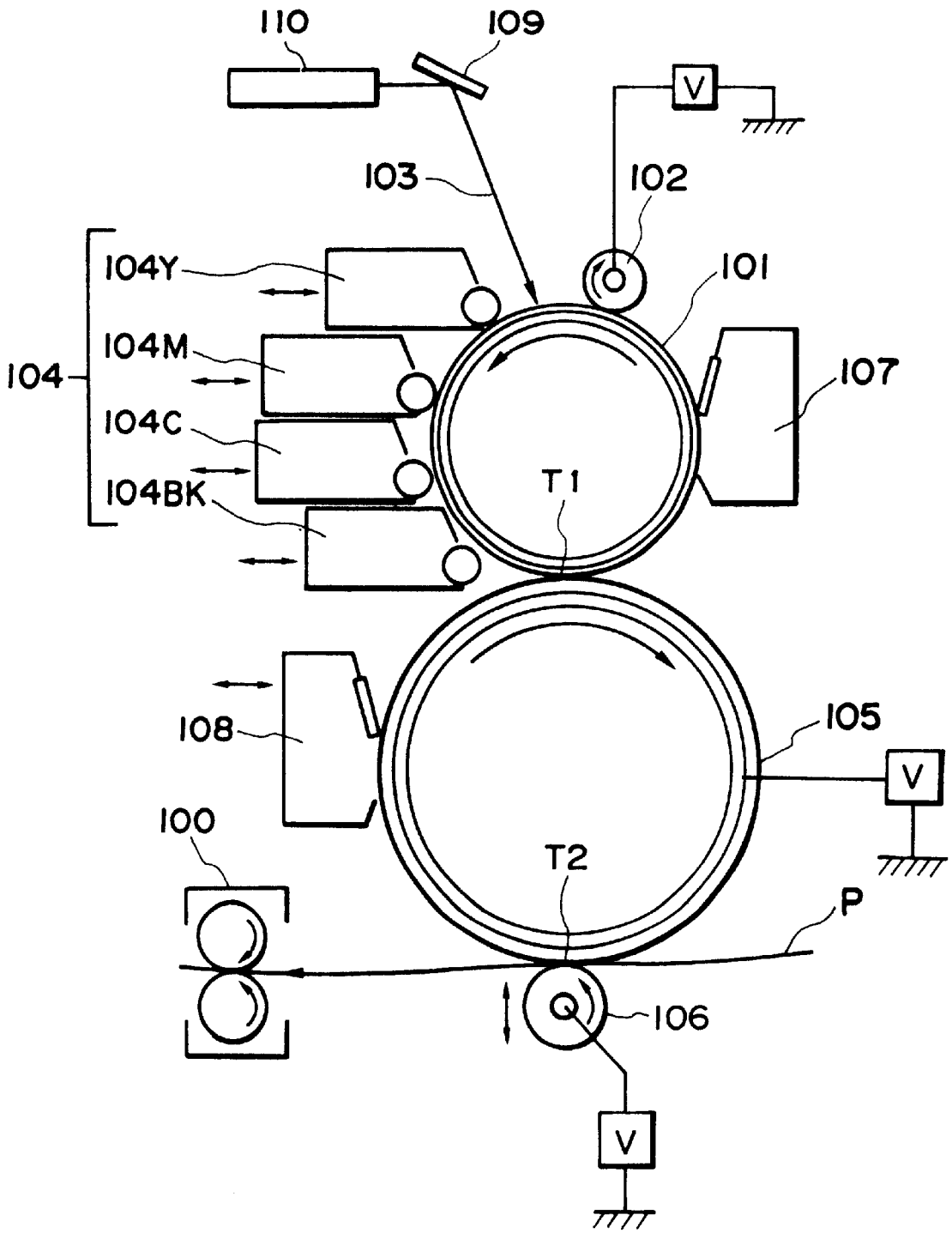
FIG. 1 illustrates an organization of a full-color image forming apparatus related to the invention.

Referring to FIG. 1, the image forming apparatus includes a photosensitive drum (image bearing member) 10 comprising organic photosensitive material, or amorphous silicon, and rotatively driven in an indicated arrow direction at a predetermined process speed (peripheral velocity).

The photosensitive drum 101 is uniformly charged to predetermined polarity and potential by a charging apparatus 102 such as a charging roller.

The uniformly charged surface of the photosensitive drum 101 is exposed to a scanning laser beam 103 which carries the image data of an objective image, and is projected from a laser optical box (laser scanner) 110; the laser optical box 110 projects the laser beam 103 while modulating it (on/off) in accordance with sequential electrical digital signals which reflect the image data of the objective image. As a result, an electrostatic latent image correspondent to the image data of the objective image is formed on the peripheral surface of the rotatory photosensitive drum 101. The sequential electrical digital signals are supplied from an image signal generation apparatus such as an image reading apparatus, which is not illustrated in the drawing. A mirror 109 deflects the laser beam projected from the laser optical box 110, onto a point to be exposed on the photosensitive drum 101.

In full-color image formation, an objective image is subjected to a color separation process in which the color of the objective image is separated into, for example, four primary color components. Then, the above described scanning exposure and image formation processes are carried out for each of the primary color components, starting from, for example, yellow component. The latent image correspondent to the yellow color component is developed into a yellow toner image by the function of a yellow color component developing device 104Y of a color developing device 104. Then, the yellow toner image is transferred onto the peripheral surface of an intermediary transfer drum 105, at a primary transfer point $T_1$, which is the contact point of the photosensitive drum 101 and the intermediary transfer drum 105 (or the point at which the distance between the photosensitive drum 101 and the intermediary transfer drum 105 becomes smallest). After the toner image is transferred onto the surface of the intermediary transfer drum 105, the peripheral surface of the photosensitive drum 101 is cleaned by a cleaner 107; foreign matters such as the residual toner particles from the transfer are removed from the peripheral surface of the photosensitive drum 101 by the cleaner 107.

Next, a process cycle comprising the above described charging process, scanning/exposing process, developing process, primary transfer process, and cleaning process is also carried out for the rest (second, third, and fourth) of the primary color components of the target image. More specifically, for the latent image correspondent to the second primary color component, that is, magenta color component, a magenta color component developing device 104M is activated; for the latent image correspondent to the third primary color components, a cyan color component developing device 104C; and for the latent image for the fourth color component, a black color component developing device 104BK is activated. As a result, a yellow toner image, a magenta toner image, a cyan toner image, and a black toner image are superposed in the aforementioned order on the peripheral surface of the intermediary transfer drum 105, effecting a compound full-color toner image of the target image.

The intermediary transfer drum 105 comprises a metallic drum, an elastic middle layer with medium resistance, and a surface layer with high resistance. It is disposed so that its peripheral surface is placed in contact with, or extremely close to, the peripheral surface of the photosensitive drum 101. It is rotatively driven in the indicated arrow direction at substantially the same peripheral velocity as that of the photosensitive drum 101. The toner image on the photosensitive drum 101 is transferred onto the peripheral surface of the intermediary transfer drum 105 using the potential difference created by applying a bias voltage to the metallic drum of the intermediary transfer drum 105.

The compound full-color toner image formed on the peripheral surface of the intermediary transfer drum 105 is transferred onto the surface of a recording medium P, at a secondary transfer point $T_2$, that is, a contact nip between the intermediary transfer drum 105 and a transfer roller 106. The recording medium P is delivered to the secondary transfer point $T_2$ from an unillustrated sheet feeding portion with a predetermined timing. The transfer roller 106 transfers all at once the compound color toner image from the peripheral surface of the intermediary transfer drum 105 onto the recording medium P by supplying the recording medium P with charge having such polarity that is opposite to the polarity of the toner, from the back side of the recording medium P.

After passing through the secondary transfer point $T_2$, the recording medium P is separated from the peripheral surface of the intermediary transfer drum 105, and then is introduced into an image heating apparatus (fixing apparatus) 100, in which the compound full-color toner image composed of layers of toner particles of different colors is thermally fixed to the recording medium P. Thereafter, the recording medium P is discharged from the image forming apparatus into an unillustrated delivery tray. The fixing apparatus 100 will be described in detail in section "(2) Fixing apparatus (heating means)".

After the compound full-color toner image has been transferred onto the recording medium P, the intermediary transfer drum 105 is cleaned by a cleaner 108; the residue, such as the residual toner from the secondary transfer or paper dust, on the intermediary transfer drum 105 is removed by the cleaner 108. Normally, the cleaner 108 is kept away from the intermediary transfer drum 105, and when the full-color toner image is transferred from the intermediary transfer drum 105 onto the recording medium P (secondary transfer), the cleaner 108 is placed in contact with the intermediary transfer drum 105.

Also, the transfer roller 106 is normally kept away from the intermediary transfer drum 105, and when the full-color toner image is transferred from the intermediary transfer drum 105 onto the recording medium P (secondary transfer), the transfer roller 106 is pressed on the intermediary transfer drum 105, with the interposition of the recording medium P.

The image forming apparatus illustrated in FIG. 1 can be operated in a monochromatic mode, for example, a black-and-white mode. It also can be operated in a double-sided mode, as well as a multi-layer printing mode.

In a double-sided mode, after an image is fixed to one (first) of the surfaces of the recording medium P, the recording medium P is delivered to an unillustrated recirculating mechanism, in which the recording medium P is turned over, and then, is fed into the secondary transfer point $T_2$ for the second time so that another toner image is transferred onto the other (second) surface. Then, the recording medium P is sent into the image heating apparatus for the second time, in which the second toner image is fixed. Therefore, the recording medium P is discharged as a double-side print from the main assembly of the image forming apparatus.

In a multi-layer mode, after coming out of the image heating apparatus 100, with the first image on the first surface, the recording medium P is sent into the secondary transfer point $T_2$ for the second time, without being turned over through the recirculating mechanism. Then, the second image is transferred onto the first surface, to which the first image has been fixed. Then, the recording medium P is introduced into the image heating apparatus 100 for the second time, in which the second toner image is fixed. Thereafter, the recording medium P is discharged as a multi-layer image print from the main assembly of the image forming apparatus.

The fixing apparatus used in the present invention essentially includes a heat generating layer and a release layer, and can also include an elastic layer, e.g., for use as a fixing apparatus for fixing a thick toner image as in color image formation for the purpose of providing enhanced color mixability.

Next, an example of heating apparatus including an elastic layer in addition to a heat generation layer and a release layer.

(2) Fixing apparatus (heating means) 100

An embodiment of fixing apparatus as a characteristic feature of the present invention will now be described more specifically, but the heating apparatus used in the present invention is not restricted to the embodiment described below but can also be a type of heat-fixing apparatus including an exciting coil part outside a fixing belt (or film).

Figure 2:
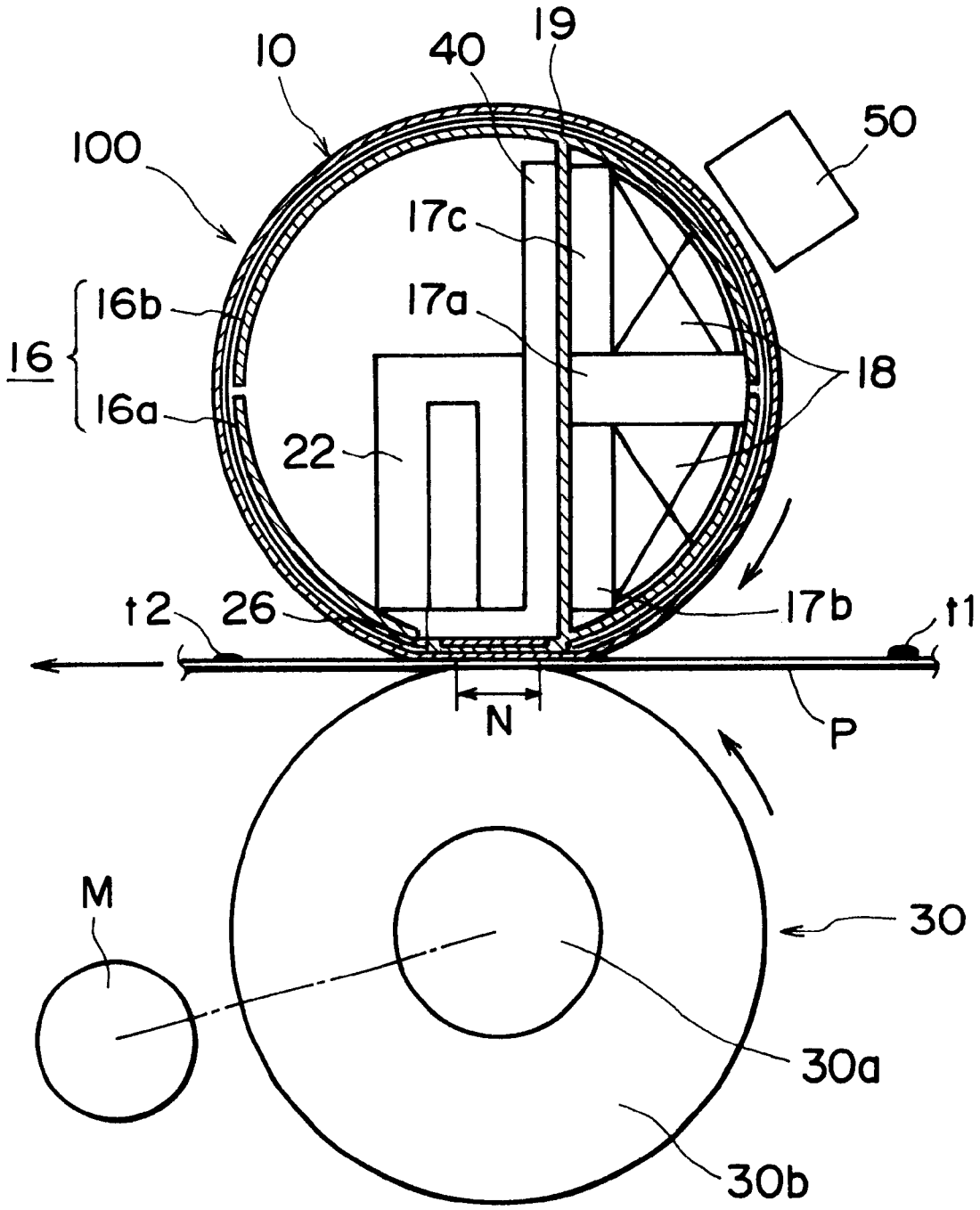
FIG. 2 is a schematic transverse section of a heating apparatus (fixing apparatus) related to the invention.
Figure 3:
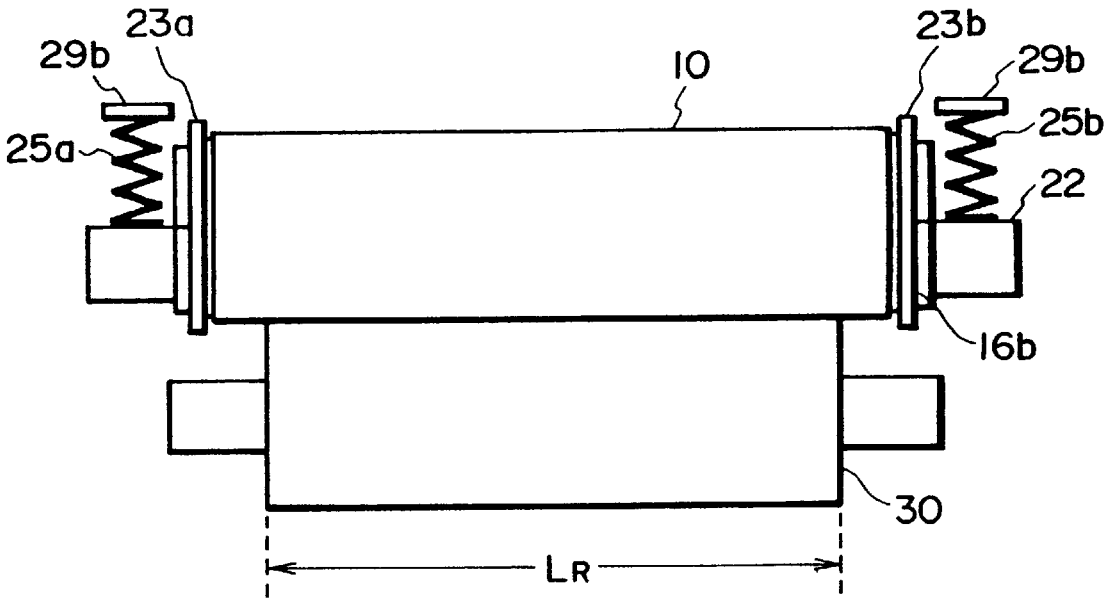
FIG. 3 is a schematic front view of an essential portion of the heating apparatus of FIG. 2.
Figure 4:
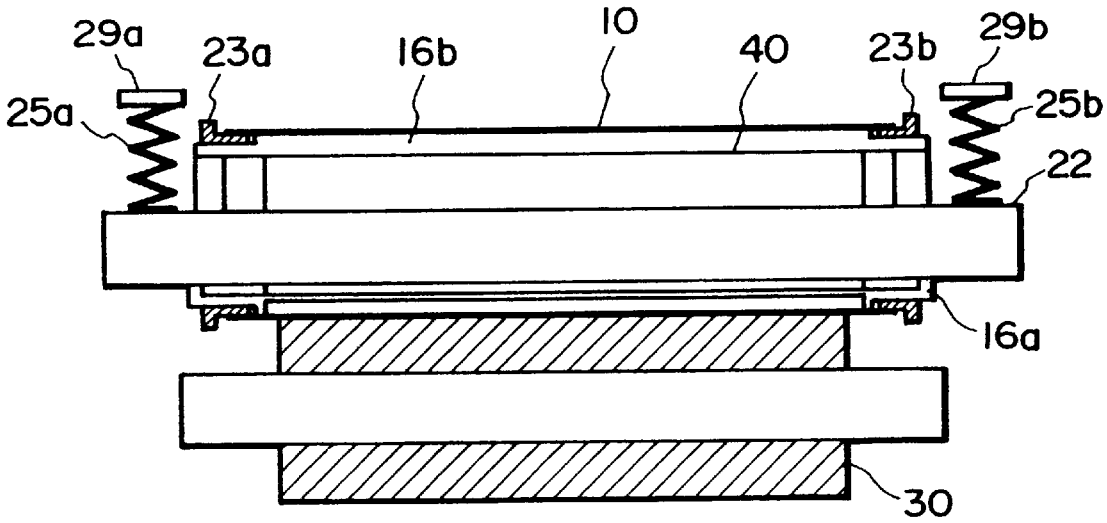
FIG. 4 is a schematic longitudinal section of an essential portion of the heating apparatus of FIG. 2.

FIG. 2 is a schematic cross section of the essential portion of the fixing apparatus 100 in this embodiment, and FIG. 3 is a schematic front view of the portion illustrated in FIG. 2. FIG. 4 is a longitudinal, vertical section of the portion illustrated in FIG. 2.

Figure 10:
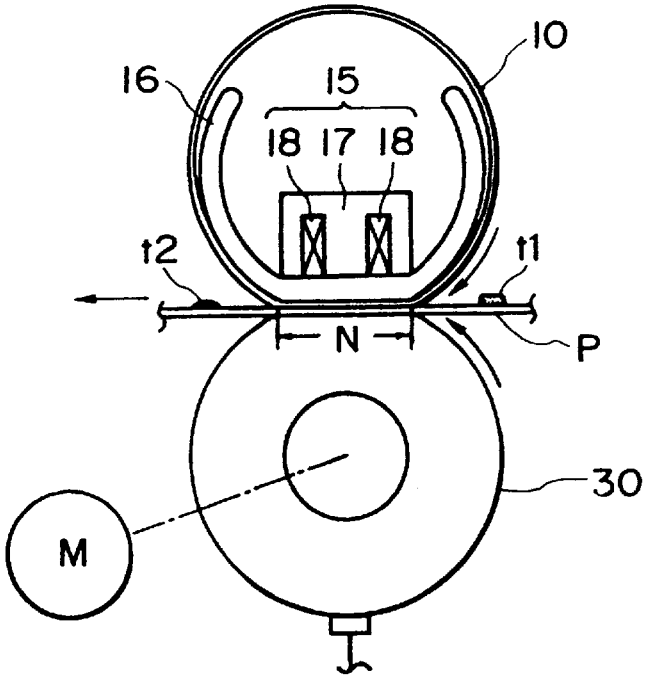
FIG. 10 illustrates a sectional organization of an electromagnetic induction heating-type fixing apparatus.

The fixing apparatus 100 is the same type of apparatus as the fixing apparatus illustrated in FIG. 10, hence it employs a cylindrical fixing belt or film, that is, the rotatory member, which generates heat through electromagnetic induction, and is driven by a pressure roller. Therefore, its components or portions which are the same as those of the apparatus illustrated in FIG. 10 are designated with identical referential numerals to eliminate repetition of the same descriptions.

The magnetic field generating means comprises magnetic cores 17*a*, 17*b* and 17*c* and an excitation coil 18.

The magnetic cores 17*a*, 17*b* and 17*c* are members with high magnetic permeability. As for the material for these cores, material such as ferrite or permalloy which is used as the material for a transformer core is desirable; preferably, ferrite in which loss is small even when operational frequency is above 100 kHz.

Figure 5:
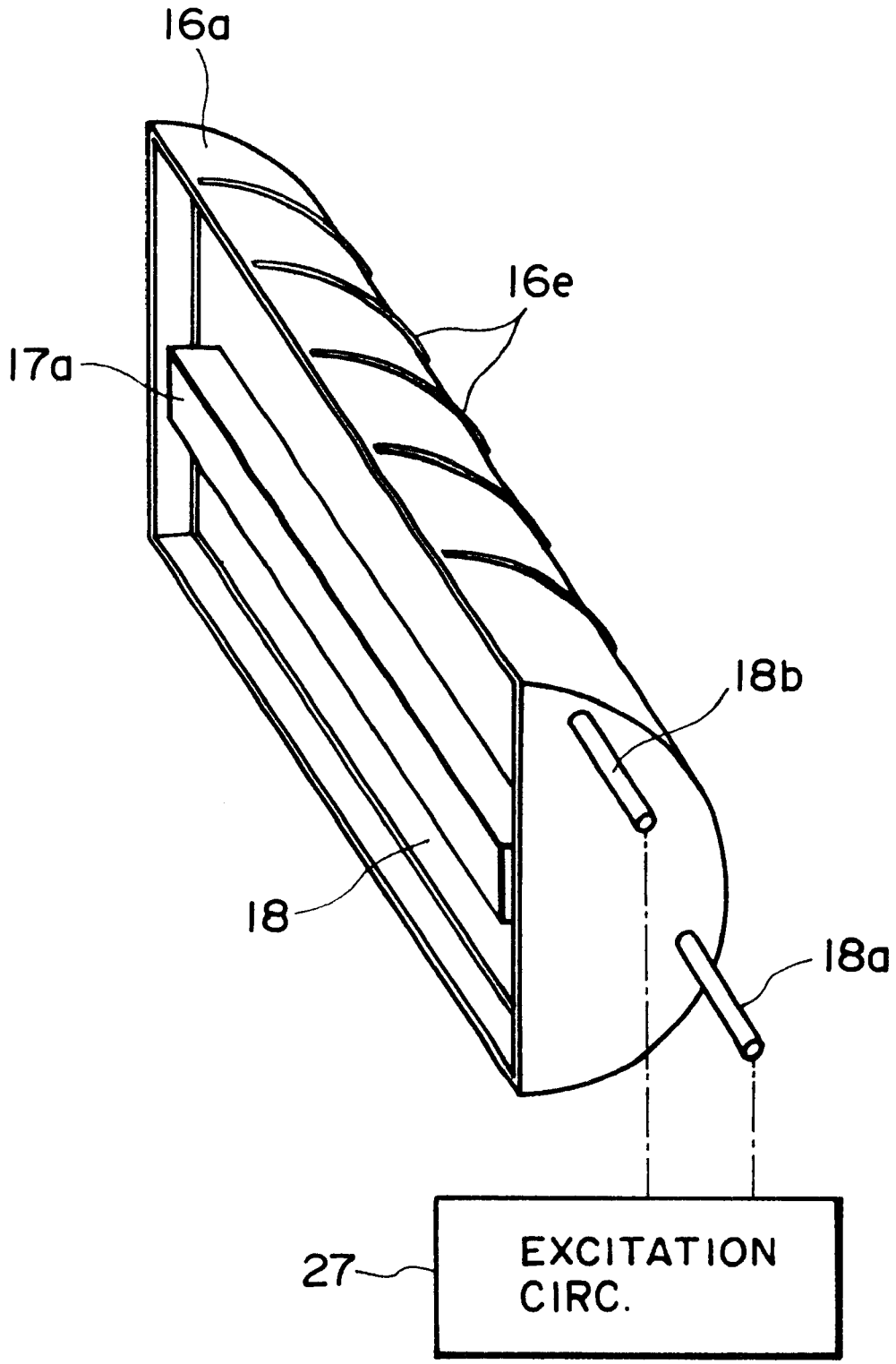
FIG. 5 is a schematic illustration of a magnetic field generating means.

As shown in FIG. 5, the excitation coil 18 is connected to an excitation circuit 27 via power supply lead wires 18*a* and 18*b*. The excitation circuit 27 can generate high frequency waves of 10 kHz to 500 kHz by using a switching power source. The excitation coil 18 generates alternating magnetic flux based on an alternating high-frequency current supplied from the excitation circuit.

The fixing apparatus 100 also includes semi-cylindrical trough-shaped belt guide members 16*a* and 16*b* of which the opening ridges are disposed opposite to each other to leave a small gap, thereby forming together an almost cylindrical guide 16, around which a cylindrical electromagnetic induction heat-generating belt (fixing belt) 10 is loosely fitted.

The belt guide member 16 holds the magnetic cores 17*a*–17*c* and the excitation coil 18 as the magnetic field generation means inside thereof.

Inside the guide member 16, a heat-conductive member 40 extending in a direction perpendicular to the drawing of FIG. 2 (as better understood in a side view of FIG. 4) is disposed opposite to a pressing roller 30 and inside the fixing belt 10 at a nip N. In a specific example, the heat-conductive member 40 was formed of a 1 mm-thick aluminum sheet exhibiting a thermal conductivity k=240 $[W \cdot m^{-1} \cdot K^{-1}]$.

The heat-conductive member 40 is disposed outside a magnetic field formed by the excitation coil 18 and the magnetic cores 17*a*–17*c* constitution the magnetic field generation means, so as not to be affected by the magnetic field. More specifically, the heat-conductive member 40 is disposed at a position opposite from the excitation coil 18 with respect to the magnetic cores 17*b* and 17*c*, that is, a position outside a magnetic path formed by the excitation coil, so as to avoid an influence on the conductive member 40.

The fixing apparatus 100 further includes a laterally elongated rigid stay 22 for pressure application, which is abutted against an inner flat portion of the belt guide member 16*b*; an insulating member 19 for insulating the heat-conductive member 40 and the stay 22 from the magnetic cores 17*a*–17*c* and the excitation coil 18; and flange members 23*a* and 23*b* (FIGS. 3 and 4) which are fitted around the longitudinal ends of the assembly composed of the belt guide members 16*a* and 16*b*, to regulate the edges of the fixing belt 10. The flange members 23*a* and 23*b* are capable of rotation independently or following the rotation of the fixing belt 10 and regulate the movement of the belt in the longitudinal direction of the belt guide 16*a* and 16*b*.

The pressure roller 30 as a pressing or backup member comprises a metallic core 30*a* and an elastic layer 30*b*. The elastic layer 30*b* is concentrically formed around the metallic core 30*a*, covering the peripheral surface of the core 30*a*, and is composed of heat resistant material such as silicone rubber, fluorinated rubber, fluorinated resin, or the like. The pressure roller 30 is fitted between unillustrated side plates of the main assembly of the image forming apparatus, being rotatively supported by bearings, at the respective longitudinal ends of the metallic core 30*a*.

Between the longitudinal ends of the rigid pressing stay 22, and the spring seats 29*a* and 29*b*, springs 25*a* and 25*b* are fitted, respectively, in a state of compression, to press the rigid pressing stay 22 downward. With this arrangement, a fixing nip N with a predetermined width is formed, in which the fixing belt 10 is sandwiched between the bottom surface of the belt guide 16*a* and the upward facing peripheral surface of the pressure roller 30. The bottom surface of the magnetic core 17*a* is squarely aligned with the fixing nip N, sandwiching the bottom portion of the belt guide 16*a*.

The pressure roller 30 is rotatively driven by a driving means M in the indicated arrow direction. As the pressure roller 30 is rotationally driven, rotational force is applied to the fixing belt 10 by the friction between the pressure roller 30 and the outward surface of the fixing belt 10, whereby the fixing belt 10 is rotated along the peripheral surfaces of the belt guides 16*a* and 16*b* in the indicated arrow direction at a peripheral velocity substantially equal to the peripheral velocity of the pressure roller 30. In the fixing nip N, the inward surface of the fixing belt 10 slides on the bottom surface of the belt guide 16*a*, flatly in contact with the surface.

With the above setup, in order to reduce the friction between the bottom surface of the belt guide 16*a* and the inward surface of the fixing belt 10 at the nip N, lubricant such as heat resistant grease may be placed between the bottom surface of the belt guide 16*a* and the inward surface of the fixing belt 10, or the bottom surface of the belt guide 16*a* may be coated with lubricous material such as mold releasing agent. Such a measure may be effective for preventing a lowering in durability due to damages during rubbing of the fixing belt 10, e.g., in the case where the fixing belt 10 is rubbed in operation with a member showing a low surface slippery characteristic, such as an aluminum-made heat-conductive member 40 after a rough surface finishing treatment.

The heat-conductive member 40 is effective for providing a longitudinally uniform temperature distribution. For example, in the case of passing a small-size paper, the heat of the fixing belt 10 at the non-paper passing region is longitudinally transferred via the heat-conductive member 40 to the paper-passing region of the fixing member and to the small-size paper, whereby a toner image on the small size paper can be well fixed at a lower heat consumption.

FIG. 5 is a perspective view of the belt guide 16*a* of which the outer surface is provided with a plurality of ribs 16*e* protruding outward from the peripheral surface of the belt guide 16*a*, and running in parallel in the circumferential direction, with equal intervals. These protuberant ribs 16*e* are effective to reduce the friction between the outward surface of the belt guide 16*a* and the inward surface of the fixing belt 10, so that the rotational load borne by the fixing belt 10 is reduced. The belt guide 16*b* may also be provided with protuberant ribs similar to these ribs 16*b*.

Figure 6:
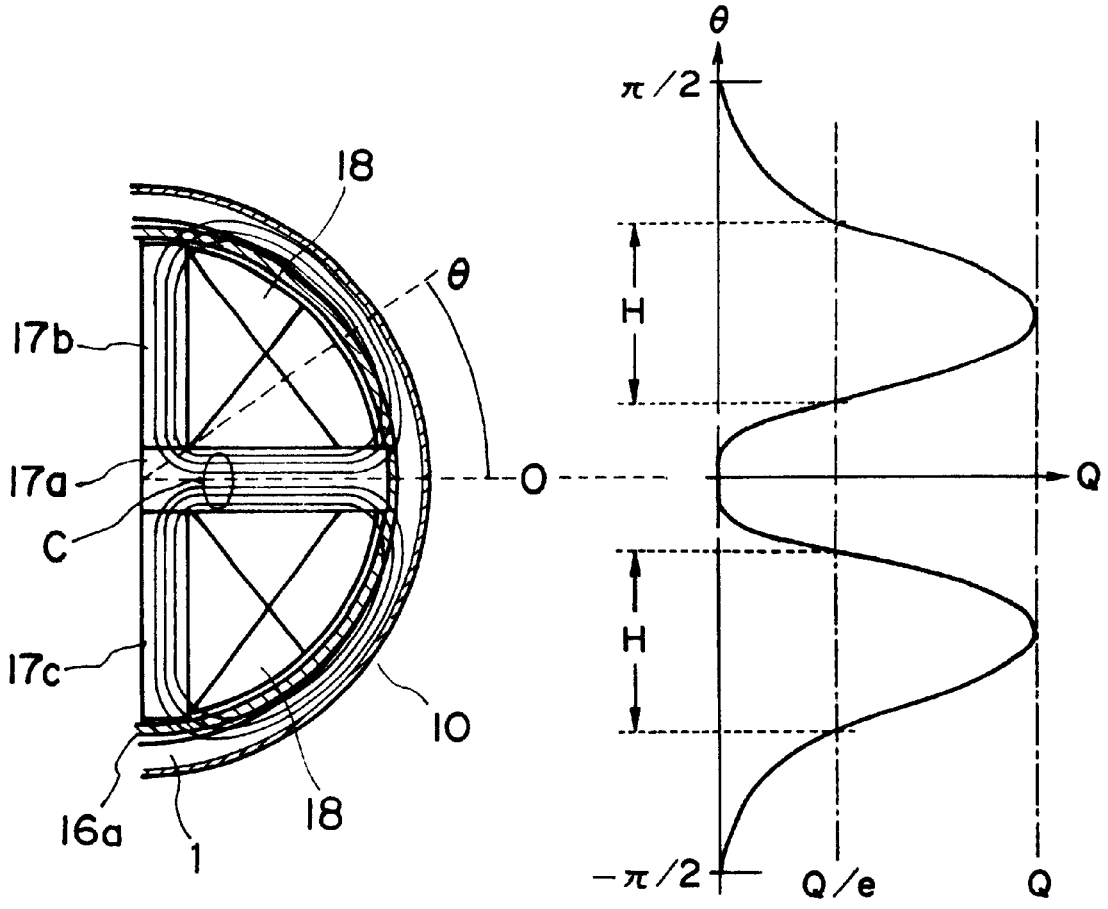
FIG. 6 illustrates a relationship between a magnetic flux and a generated heat quantity.

FIG. 6 schematically depicts the direction and distribution of the alternating magnetic flux adjacent to the fixing nip N. A magnetic flux C represents a portion of the alternating magnetic flux. As for the distribution of the alternating magnetic flux (C), the alternating magnetic flux (C) is guided by the magnetic cores 17*a*, 17*b*, and 17*c* to be concentrated between the magnetic cores 17*a* and 17*b*, and between the magnetic cores 17*a* and 17*c*, generating eddy current in the electromagnetic induction based heat generating layer 1 of the fixing belt 10. This eddy current generates Joule heat (eddy current loss) in the electromagnetic induction based heat generating layer 1, in accordance with the specific resistance of the heat generating layer 1. The amount of the heat generated by the electromagnetic induction based heat generating layer 1 is determined by the density of the magnetic flux which permeates through the electromagnetic induction based heat generating layer 1, and is distributed as shown by the graph in FIG. 6. In FIG. 6 which is a graph, the locational points on the fixing belt 10 are plotted on the ordinate, being expressed by the angle θ from the center (0°) of the fixing nip, and the amount of the heat generated in the electromagnetic induction based heat generating layer 1 of the fixing belt 10 is plotted on the abscissa. A heat-generating or exothermic region is defined as a region generating a heat quantity of Q/e (wherein Q represents a locally maximum generated heat, and e represents a base of natural logarithm) as shown in FIG. 6. This is a region providing a heat quantity necessary for fixation.

The temperature of the fixing nip N is maintained at a predetermined level by controlling the electric current supplied to the excitation coil 18 through the excitation circuit, by means of a temperature control system (not shown) operated based on the temperature data obtained through a temperature detecting element 26. The temperature detecting element 26, which detects the temperature of the fixing belt 10, is a temperature sensor such as a thermistor.

The cylindrical fixing belt 10 is rotated along the outward surfaces of the guides 16*a* and 16*b*, and electrical current is supplied to the excitation coil 18 within the guide from the excitation circuit to generate heat in the fixing belt 10 through electromagnetic induction. As a result, the temperature of the fixing nip N is increased. As the temperature of the fixing nip N reaches the predetermined level, it is maintained at this level. With the heating apparatus in this state, a recording medium P, on which a toner image t1 has been deposited without being fixed thereto, is introduced into the fixing nip N, between the fixing belt 10 and the pressure roller 30, with the image bearing surface of the recording medium P facing upward so that it will come in contact with the outward surface of the belt 10. Then, the recording medium P is passed through the fixing nip N, along with the fixing belt 10, while being compressed by the pressure roller 30 and the belt guide 16, with the image bearing surface being flatly in contact with the outward surface of the fixing belt 10. While the recording medium P, bearing the yet-to-be-fixed toner image t1, is passed through the fixing nip N as described above, this toner image borne on the recording medium P is heated by the heat electromagnetically induced in the fixing belt 10, being thereby fixed to the recording medium P. After passing through the fixing nip N, the recording medium P separates from the outward surface of the rotating fixing belt 10, and is conveyed further to be discharged from the image forming apparatus. After passing through the fixing nip N while being thermally fixed to the recording medium P, the toner image t2 cools down and becomes a permanently fixed image.

The electromagnetic induction heating scheme adopted in the present invention may preferably be operated in the following manner.

Regarding a temperature distribution amount the fixing nip formed between the rotatory heating member and the rotatory member in the electromagnetic induction heating system, it has been formed possible to attain excellent fixing performance, when a temperature Z1 (° C.) of the rotatory heating member before entering the nip, a temperature Z2 (°

C.) of the heating member after passing the nip and temperature Z3 (° C.) of the heating member at a region thereof preceding the heat-generating region, satisfy a relationship of:

$$Z3 \leqq Z2 < Z1.$$

If the above temperature distribution condition is satisfied, the toner on the recording medium receives a largest heat at a high temperature to be quickly melted at a position just beore the nip, thus providing a sufficient fixing strength even at the time of quick start.

At the exit side of the nip, the heating member exhibits a lower temperature than at the entrance side, so that the sticking of the recording material due to the toner having quickly melted at the nip entrance can be effectively prevented.

As another effect, if the temperature Z1 at the nip entrance side of the heating member is high, the recording material and the toner thereon are substantially heated by a radiation heat from the heating member surface before entering the nip, whereby the melting of the toner at the nip is augmented thus contributing to an improved fixing performance.

Further, by maintaining the temperature Z3 of the region of the heating member preceding the heat-generating region thereof below the temperature Z2 at the nip exit side, an excessive heating at the heat-generating region can be obviated.

Herein, the temperatures Z1, Z2 and Z3 are defined as follows. The surface temperature of the heating member at a position preceding the nip center by ⅛ of the peripheral length of the heating member is taken as Z1, the surface temperature of the heating member at position after the nip center by ⅛ of the peripheral length of the heating member is taken as Z2, and the surface temperature of the heating member over a partial length portion thereof preceding a position started to be heated by the heat-generating means is taken as Z3, which partial length portion is ⅛ of the peripheral length of the heating member. FIGS. 15A–15E illustrate the positions on the heating member or measurement of the temperatures Z1–Z3 for various locations of the heat-generating means.

At the above-designated positions, the temperatures Z1–Z3 are measured at the time when the recording material is passed through the fixing apparatus.

The measurement may be performed, e.g., in an environment of 23° C. and 60° C. by using a recording material of 75 /m$^2$ (e.g., "4024", available from Xerox Co.) after storing for 24 hours in the environment.

For the measurement of Z1, the surface temperature of a portion of the heating member corresponding to a portion thereof contacting the recording material at the time of passing the recording material is recorded, and a maximum value thereof is taken as Z1.

For the measurement of Z2, the surface temperature of a portion of the heating member corresponding to a portion thereof contacting the material at the time of passing the recording material is recorded, and a minimum value thereof is taken as Z2.

For the measurement of Z3, the surface temperature of a portion of the heating member corresponding to a portion thereof contacting the material at the time of passing the recording material is recorded, and a minimum value thereof is taken as Z3.

The above condition may be satisfied by appropriate combination of factors, such as an outer diameter, a heat capacity and a rotation speed of the heating member, a rate of power supply to the heating member, a heat-generating position of the heating member, an outer diameter and a heat capacity of the pressure member, and a process speed of the fixing apparatus.

When a peripheral length of the heating member is denoted by La, if the heat-generating layer is energized at least in a range from a point of La/4 preceding the nip center to a point of La/8 after the nip center, it becomes possible to suppress a temperature irregularity of the heating member in proximity to the nip, thus effectively obviating a difficulty, such as the fixing irregularity.

It is further preferred that Z1 is set to be below 250° C. in view of effective energy utilization, and a difference between Z1 and Z2 is set to be at most 40° C., more preferably at most 30° C., so as to retain a high-quality of fixed image. By adopting a fixing method satisfying these conditions, it becomes possible to retain a sufficient fixing performance in a low temperature/low humidity environment which is an environment severe for the fixing.

It is preferred to use a fixing apparatus including a rotatory heating member having a peripheral length La and a rotatory pressure member having a peripheral length Lb satisfying the following conditions:

$$0.4 \times La \leqq Lb \leqq 0.95 \times La < 400 \text{ mm}.$$

By reducing the peripheral length of the rotatory heating member, it becomes possible to reduce the heat quantity transferred from the heating member to the pressure member, thereby improving the thermal followability at the fixing surface and the quick start performance.

It is further preferred that the rotatory pressure member is set to have a peripheral length in the above-described range to suppress the heat transfer from the heating member, thereby allowing the rotatory heating member to have a peripheral length La which is below 400 mm, more preferably 200 mm or below.

It is further preferred to use a toner showing a heat-absorption peak temperature in the course of heating according to DSC (differential scanning calorimetry) in a range of 20–200° C., including a maximum heat absorption peak temperature in the range of 50–150° C., which is lower by at least 30° C., more preferably at least 40° C., so as to achieve sufficient toner melting at the nip entrance, and good fixing performance.

It is further preferred that the toner exhibits an exothermic peak temperature in the course of cooling according to DSC in the range of 20–200° C., including a maximum exothermic temperature in the range of 40–150° C., which is lower than Z2, so as to suppress the toner ticking onto the rotatory heating member at the nip exit.

Details of the DSC measurement will be described in an item of toner described hereinafter.

In this embodiment, a thermoswitch (temperature detection element) 50 is disposed opposite to the heat-generating region H (as defined in FIG. 6) of the fixing belt 10 so as to interrupt power supply to the excitation coil 18 at the time of runaway.

Figure 7:
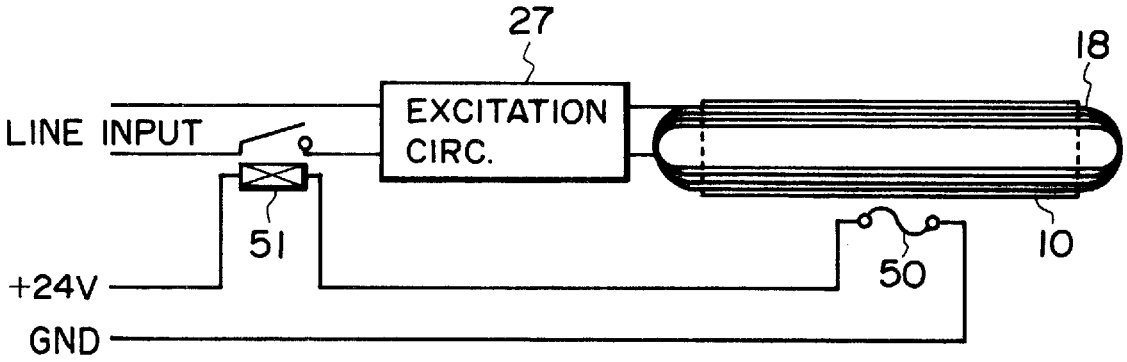
FIG. 7 is a circuit diagram of a safety circuit for the heating apparatus.

FIG. 7 is a circuit diagram of a safety circuit used in this embodiment. Referring to FIG. 7, a thermoswitch (temperature detection element) 50 is connected in series with a DC power supply of +24 volts and a relay switch 51. When the thermoswitch 50 is cut off, the power supply to the relay switch 51 is interrupted to turn on the relay switch 51, thereby interrupting the power supply to the excitation circuit 27 and therefore the power supply to the excitation coil 18. In a specific example, the thermoswitch 50 was set to have a turn-off temperature at 220° C.

The thermoswitch 50 is disposed opposite to the heat-generating region H of the fixing belt or film 10 and free of contact from the outer surface of the fixing belt with a gap of ca. 2 mm. As a result, the fixing belt is prevented from being damaged by contact with the thermoswitch, thereby obviating deterioration of fixed images during a long term of continuous image formation.

In this embodiment of fixing apparatus unlike a fixing apparatus having an arrangement as illustrated in FIG. 10, even when the fixing apparatus is stopped in a state where the nip is plugged with paper an the excitation coil 18 is continually energized to cause continual heat generation of the filing belt, the paper is not directly heated because the heat generation does not occur at the fixing nip N. Further, as the thermoswitch 50 is disposed in the heat-generating region H emitting a large quantity of heat, when the thermoswitch is turned off by detection of 220° C., the power supply to the excitation coil 18 is interrupted by the relay switch 50.

As a result, according to this embodiment, the heat generation from the fixing belt can be terminated without causing the ignition of the paper since paper has an ignition point around 400° C.

As the temperature detection element, a temperature fuse can also be used instead of the thermoswitch.

In this embodiment, a toner containing a low-softening point substance is used so that the fixing apparatus is not provided with an oil application mechanism. However, in the case of using a toner not containing a low-softening point substance, the fixing apparatus may be provided with an oil application mechanism. Further, even in the case of using a toner containing a low-softening point substance it is also possible to effect such oil application or separation of the recording material under cooling.

(A) Excitation coil 18

The material for the excitation coil 18 is copper. More specifically, a plurality of fine copper wires, each of which is individually coated with electrically insulative material, are bundled, and this bundle of insulator-coated fine wires is wound a given number of turns to form the excitation coil 18. In this embodiment, the bundle of wires is wound 10 turns.

As for the insulator for coating the copper wires, heat resistant insulator may preferably be used in consideration of the conduction of the heat generated in the fixing belt 10, such as polyamide imide or polyimide.

The density of the coil wires may be increased by applying external pressure to the excitation coil 18.

In this embodiment, the excitation coil 18 is shaped to conform to the curvature of the heat generating layer 1. The distance between the heat generating layer 1 of the fixing belt 10 and the excitation coil 18 is set at approximately 2 mm.

As for the material for the excitation coil-holding member 19, electrically insulative and heat resistant material is recommendable in order to satisfactorily insulate the excitation coil 18 from the fixing belt 10. For example, phenolic resin, fluorinated resin, polyimide resin, polyamide resin, polyamide-imide resin, PEEK resin, PES resin, PPS resin, PFA resin, PTFE resin, FEP resin, LCP resin, and the like are desirable candidates for the selection.

If the heat-generating layer of the fixing belt 10 is disposed closer to the magnetic cores 17*a*–17*c* and the excitation coil 18, a higher magnetic flux absorption efficiency can be achieved. The distance is preferably 5 mm or less, since a distance exceeding 5 mm results in a remarkable lowering in the efficiency. If the distance is in the range of at most 5 mm, the distance between the heat generating layer of the fixing belt and the excitation coil need not be at constant.

The wires 18*a* and 18*b*, which lead from the excitation coil 18, and are put through the excitation coil-holding member 19, are covered with insulative coating, on the portions outside the excitation coil-holding member 19.

(B) Fixing belt 10

Figure 8:
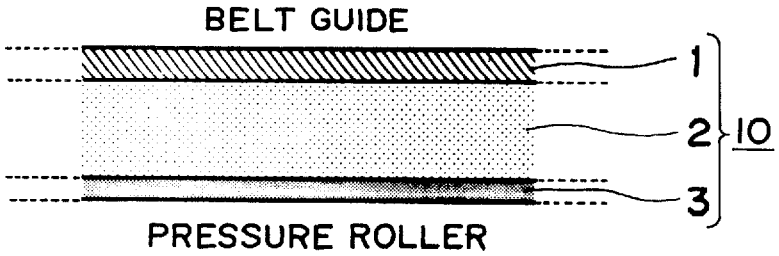
FIG. 8 illustrates a laminar structure of a fixing belt (fixing belt) of the heating apparatus.

FIG. 8 is a schematic vertical section of the fixing belt 10 in this embodiment. This fixing belt 10 has a compound (laminar) structure, including an electrically conductive layer, forming the heat generating layer 1, which is formed of metallic film or the like, and constitutes the base layer of the fixing belt 10; the elastic layer 2 laid on the outward surface of the heat generating layer 1; and the release layer 3 laid on the outward surface of the elastic layer 2. In order to assure the adhesion between the heat generating layer 1 and the elastic layer 2, and the adhesion between the elastic layer 2 and the release layer 3, primer layers (unillustrated) may be placed between the respective layers. The heat generating layer 1 is on the inward side of the cylindrical fixing belt 10, and the release layer 3 is on the outward side. As described above, as alternating magnetic flux acts on the heat generating layer 1, eddy current is generated in the heat generating layer 1, and this eddy current generates heat in the heat generating layer 1. The thus generated heat heats the fixing belt 10 through the elastic layer 2 and the release layer 3, and in turn, the fixing belt 10 heats the recording medium, that is, an object to be heated, which is being passed through the fixing nip N, to thermally fix the toner image.

a. Heat generating layer 1

The heat generating layer 1 can be composed of nonmagnetic metal, but usage of ferromagnetic material or alloy thereof such as nickel, iron, magnetic SUS, nickel-cobalt alloy, or the like is preferable.

As for the thickness of the heat generating layer 1, it is desired to be no less than the skin depth σ (m) expressed by the formula given below, and no more than 200 μm:

$$\sigma=503\times(\rho/f\mu)^{1/2}$$

wherein f stands for the frequency (Hz) of the excitation circuit; μ, the magnetic permeability; and ρ stands for specific resistance (Ωm).

The skin depth a represents a depth of absorption of electromagnetic wave used for electromagnetic induction. At a larger depth, the electromagnetic wave intensity becomes lower than 1/e. In other words, most energy is absorbed in a depth up to the skin depth σ.

More specifically, the thickness of the heat generating layer 1 is desirably in a range of 1–200 μm. If the thickness of the heat generating layer 1 is below 1 μm, all the electromagnetic energy cannot be absorbed; heat generating efficiency deteriorates. If the thickness of the heat generating layer 1 exceeds 100 μm, the heat generating layer 1 becomes too rigid; in other words, its flexibility is lost too much to be practically used as a rotatory member.

b. Elastic layer 2

The elastic layer 2 is composed of such material that is good in heat resistance and thermal conductivity; for example, silicone rubber, fluorinated rubber, fluoro-silicone rubber, and the like.

The thickness of the elastic layer 2 is desirably in a range of 10–500 μm, so as to obviate gloss irregularity which is liable to be caused by failure of the heating surface (release layer 3) in following the unevennesses of the recording material or unevennesses of toner layer on the recording material.

If the thickness of the elastic layer 2 is below 10 μm, the fixing belt 10 fails to function as an elastic member, thus applying a non-uniform pressure distribution at the time of fixation. As a result, particularly at the time of full-color image fixation, it becomes difficult to sufficiently heat-fix a yet-unfixed toner of a secondary color to result in gloss irregularity in the fixed image due to insufficient fusion and fail in obtaining highly defined full-color images. On the other hand, if the elastic layer 2 has a thickness exceeding 500 μm, the heat conduction at the time of fixation can be obstructed to result in an inferior thermal followability of the fixing surface, so that the quick-start performance can be impaired and fixing irregularity is liable to occur.

As for the hardness of the elastic layer 2, the excessive hardness of the elastic layer 2 does not allow the elastic layer 2 to conform to the irregularities of the recording medium surface or the toner layer, causing glossiness to be uneven across an image. Hence, it is desirable that the hardness of the elastic layer 2 is at most 60° (JIS-A), preferably at most 45° (JIS-A).

The thermal conductivity λ of the elastic layer 2 is desirably in the range of 0.25–0.82 (J/m·sec·deg):

When the thermal conductivity λ is lower than 0.25 (J/m·sec·deg.), the thermal resistance becomes large, which slows down the speed at which the temperature of the surface layer (release layer 3) of the fixing belt 10 rises.

When the thermal conductivity λ exceeds 0.82 (J/m·sec·deg.), the hardness of the elastic layer 2 increases too much, and also the permanent deformation of the elastic layer 2 caused by compression worsens.

Therefore, it is desirable that the heat conductivity λ is in the range of 0.25–0.82 (J/m·sec—deg.), preferably in a range of 0.33–0.63 (J/m·sec—deg.).

c. Release layer 3

As for the material for the release layer 3, it can be selected from among such materials as fluorinated resin, silicone resin, fluoro-silicone rubber, fluorinated rubber, silicone rubber, PFA, PTFE, FEP, or the like, in view of releasability and heat resistance.

The thickness of the release layer 3 is desirably in a range of 1–100 μm. If the thickness of the release layer 3 is below 1 μm, the unevenness of the release layer 3 manifests as lubricous unevenness, creating spots inferior in lubricity or durability. On the other hand, if the thickness of the release layer 3 exceeds 100 μm, thermal conductivity deteriorates; in particular, if the release layer 3 is composed of resin, the hardness of the release layer 3 becomes too high to remove the effect of the elastic layer 2.

d. Thermally insulative layer

The fixing belt 10 can also include a thermally insulative layer (not shown) on the belt guide-side (a side opposite to the elastic layer 2) of the heat generating layer 1.

Such a thermally insulative layer may preferably comprise a heat-resistant resin, such as fluorine-containing resin, polyimide resin, polyamide resin, polyamideimide resin, PEEK resin, PES resin, PPS resin, PFA resin, PTFE resin or FEP resin.

The thermally insulative layer may preferably have a thickness of 10–1000 μm. If the thickness of the thermally insulative layer is below 10 μm, a required thermal insulator effect cannot be attained and also the durability is liable to be insufficient. On the other hand, in excess of 1000 μm, the distance to the heat generating layer 1 from the magnetic cores 17*a*–17*d* and the excitation coil 18 is enlarged, so that sufficient absorption of the magnetic flux by the heat generating layer becomes difficult.

The thermally insulative layer functions to prevent the conduction of heat generated in the heat generating layer 1 inwards of the fixing belt, thus providing a better heat supply efficiency to the recording material P side and suppressing the power consumption.

C) Nip

For ensuring a good fixing performance, the fixing nip between the rotatory heating member and the pressure member in the heat fixing apparatus according to the present invention may preferably be formed in a width of 5.0–15.0 mm. Below 5.0 mm, it becomes difficult to transfer a sufficient heat quantity to a yet unfixed toner image at the time of full-color image formation and cause satisfactory fusion color mixing of the toner, thus being liable to result in non-natural color images.

If the nip width N exceeds 15.0 mm, a sufficient heat quantity for toner fixation can be transferred, but the hot offset phenomenon is liable to occur, and the curvature change of the fixing belt 10 at both ends of the fixing nip N (i.e., an upstream side and a downstream side of the fixing belt 10) becomes excessively large, so that the durability of the fixing belt 10 is liable to be lowered.

D) Linear pressure

The nip pressure (linear pressure) in the heat fixing apparatus is preferably in a range of 490–1372 N/m (0.5–1.4 kg-f/cm), more preferably 490–784 N/m (0.5–0.8 kg-f/cm), as measured in a state where a recording material is inserted. Below 490 N/m (0.5 kg-f/cm), conveyance irregularity of the recording material and fixing failure due to insufficient fixing pressure are liable to occur. Above 1372 N/m (1.4 kg-f/cm), the durability degradation of the fixing belt 10 is liable to be promoted.

The linear pressure LP (N/m) referred to herein is calculated from a force applied to a recording material F (N) and a length of abutment (LR, FIG. 3) as follows: LP (N/m)=F (N)/LR (m).

The force (F) acting on the recording material can be adjusted by changing the spring pressure exerted by the springs 25*a* and 25*b* shown in FIG. 3. The force (F) can also be controlled by changing a distance between the spring supports 29*a* and 29*b* and the pressure roller 30.

E) Peripheral length of Fixing belt, and Process speed

In this embodiment, the peripheral length of the fixing belt 10 generating heat by electro-magnetic induction and the time for one rotation of the fixing belt 10 are set in a manner as described below to realize a quick-start performance and economical power consumption while ensuring a stable fixing performance.

The heat generating layer 1 of the fixing belt 10 has a small heat capacity because of a small thickness and has a remarkable heat-dissipative characteristic because of a metal showing good heat conductivity. Accordingly, if the fixing belt has a peripheral length La of 400 mm or longer, the fixing belt 10 is liable to cause a substantial temperature lowering during one rotation thereof. Further, because of an increased heating area accompanying the increased peripheral length, the power consumption can be substantially increased. For this reason, the peripheral length La of the fixing belt 10 is preferably below 400 mm, more preferably 200 mm or shorter.

On the other hand, if the peripheral length of the fixing belt 10 is below 70 mm, the curvature of the fixing belt 10 at both sides of the fixing nip N (upstream and downstream sides of the fixing belt 10) becomes excessively large to result in a remarkably inferior durability. For this reason, the peripheral length La is preferably at least 70 mm.

Further, if the rotation speed (fixing speed) of the fixing belt exceeds 400 mm/sec, it becomes difficult to stably rotate the fixing belt 10, thus being liable to break the fixing belt 10. For this reason, the process speed V given by rotation of the fixing belt 10 is desirably at most 400 mm/sec, preferably at most 300 mm/sec.

FIG. 10 is a sectional illustration of an embodiment of fixing apparatus according to the electromagnetic induction heating scheme designed to improve the efficiency by concentrating an alternating magnetic flux distribution caused by the excitation coil at the fixing nip.

The fixing apparatus includes a cylindrical fixing belt or film 10, as an electromagnetic induction-type heat-generating rotatory member, having an electromagnetic induction heat-generation layer (a conductor layer, a magnetic layer and a resistance layer).

The cylindrical fixing belt 10 is loosely fitted about a trough-shaped belt guide 16 having a generally semi-circulate crosssecton.

A magnetic field generating means 15 is disposed on the inward side of the belt guide 16, and is constituted of an excitation coil 18 and a magnetic core 17.

An elastic pressure roller 30 is disposed so that it presses, with a predetermined pressure, upon the bottom surface of the belt guide 16, with the fixing belt interposed, and forms a fixing nip N having a predetermined width. The magnetic core 17 of the magnetic field generating means 15 is squarely aligned with the fixing nip N.

The pressure roller 30 is rotatively driven in the indicated arrow direction, by a driving means M. As the pressure roller 30 is rotatively driven, the fixing belt 10 is driven in the indicated arrow direction by the friction between the pressure roller 30 and the outward surface of the fixing belt 10, with the inward surface of the fixing belt 10 sliding flatly on the bottom surface of the belt guide 16; the fixing belt 10 is rotated along the outward surface of the belt guide 16 at a peripheral velocity substantially equal to the peripheral velocity of the pressure roller 30 (pressure roller driving system).

The belt guide 16 plays a role in generating pressure in the fixing nip N, supporting the excitation coil 18 and magnetic core 17 of the magnetic field generating means 15, supporting the fixing belt 10, and stabilizing the conveyance of the fixing belt 10 while the fixing belt 10 is rotatively driven. The belt guide 16 is formed of dielectric material which does not interfere with the permeation of magnetic flux, and also is capable of withstanding the load it must bear.

The excitation coil 18 generates an alternating magnetic flux as it is supplied with an alternating electric current by an unillustrated excitation circuit. The alternating magnetic flux is concentrated at the fixing nip N by an inverted E-shaped magnetic core 17 disposed opposite to the fixing nip N, and causes an eddy current in the electromagnetic induction heat generating layer, where the eddy current generates Joule heat due to the resistance of the heat generating layer.

Since the alternating magnetic flux is generated so as to be concentrated to the fixing nip N, the heat generated through electromagnetic induction is also concentrated to the fixing nip N. In other words, the fixing nip N is very efficiently heated.

The temperature of the fixing nip N is controlled by a temperature controlling system inclusive of a temperature detecting means; it is maintained at a predetermined level by controlling the current supplied to the excitation coil 18.

In operation, as the pressure roller 30 is rotatively driven, the cylindrical fixing belt 10 is rotated around the belt guide 16, and electrical current is supplied to the excitation coil 18 from the excitation circuit to generate heat in the fixing belt 10 through electromagnetic induction. As a result, the temperature of the fixing nip N is increased. As the temperature of the fixing nip N reaches the predetermined level, it is maintained at this level. With the heating apparatus in this state, a recording medium P, on which a toner image t has been just deposited without being fixed thereto, is introduced into the fixing nip N, between the fixing belt 10 and the pressure roller 30, with the image bearing surface of the recording medium P facing upward so that it will come in contact with the outward surface of the film 10. Then, the recording medium P is passed through the fixing nip N, along with the fixing belt 10, while being compressed by the pressure roller 30 and the belt guide 16, with the image bearing surface being flatly in contact with the outward surface of the fixing belt 10. While the recording medium P with the toner image t is passed through the fixing nip N as described above, the toner image t which is borne on the recording medium P, but is yet to be fixed, is heated by the heat electromagnetically induced in the fixing belt 10, being thereby fixed to the recording medium P. After passing through the fixing nip N, the recording medium P separates from the outward surface of the rotating fixing belt 10, and is conveyed further to be discharged from the image forming apparatus.

(3) Image forming method and apparatus (for monochromatic image formation)

Figure 11:
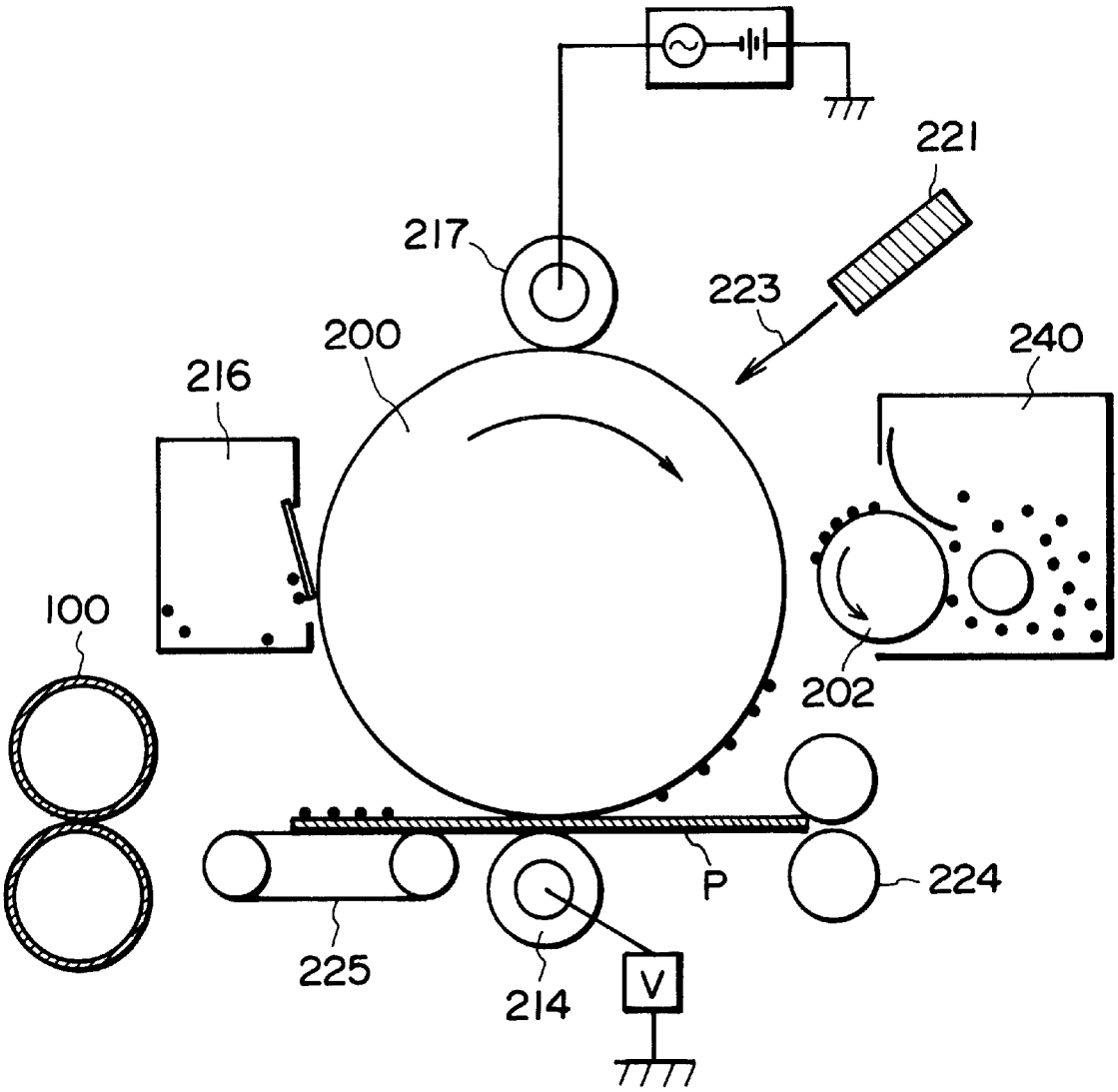
FIG. 11 illustrates an organization of an image forming apparatus for practicing an embodiment of the image forming method according to the invention.

FIG. 11 illustrates an organization of an embodiment of the image forming apparatus, which is constituted as an electrophotographic printer.

Referring to FIG. 11, the image forming apparatus includes a photosensitive drum 200, around which are disposed a primary charging roller 217, a developing apparatus 240, a transfer charging roller 214, a cleaner 216, and register rollers 224. In operation, the photosensitive drum 200 is charged to, e.g., −700 volts by means of the primary charging roller 217 supplied with an AC voltage of 2.0 kVpp superposed with a DC voltage of −700 Vdc. The charged photosensitive drum 200 is then exposed to laser light 223 from a laser 221 to form an electrostatic latent image thereon. The latent image on the photosensitive drum 200 is developed with a monocomponent magnetic toner by the developing apparatus 240 to form a toner image thereon, which is then transferred onto a recording material P by means of the transfer roller 214 abutted against the photosensitive drum 200 via the recording material P. The recording material P carrying the toner image thus transferred thereto is conveyed to the fixing apparatus 100, where the toner image is fixed onto the recording material P. A portion of the toner remaining on the photosensitive drum 200 is then recovered by the cleaning means 216.

In the developing region, A DC/AC-superposed developing bias voltage is applied between the photosensitive drum and a developing sleeve 202, whereby a toner on the developing sleeve is caused to jump onto the photosensitive drum 200 depending on the electrostatic latent image thereon.

The organization and operation of the fixing apparatus 100 are identical to those described in the above-mentioned section of "(2) Fixing apparatus (heating means)".

The image forming apparatus illustrated in FIG. 11 can be operated in a double-sided mode, as well as an ordinary singe-side printing mode. In a double-sided mode, after an image is fixed to one (first) of the surfaces of the recording medium P, the recording medium P is delivered to an unillustrated recirculating mechanism, in which the recording medium P is turned over, and then, is fed into the secondary transfer point $T_2$ for the second time so that another toner image is transferred onto the other (second)

surface. Then, the recording medium P is sent into the image heating apparatus for the second time, in which the second toner image is fixed. Therefore, the recording medium P is discharged as a double-side print from the main assembly of the image forming apparatus.

(4) Toner

Next, the toner according to the present invention will be described.

It is essential for the toner of the present invention to comprise at least a binder resin and a colorant and also has a moisture content of at most 3.00 wt. %. As preferable features, the toner may have an average circularity of at least 0.940, more preferably 0.960 or higher, and a residual monomer content of at most 300 ppm by weight of the toner.

It is essential for the toner to have a moisture content of at most 3.00 wt. %, and it is preferred for the toner to have a moisture content of at most 2.00 wt. %, more preferably 1.00 wt. % or below.

The moisture content in a toner is generally instantaneously turned into water vapor (steam) on receiving the heat for fixation to be discharged outside the system. However, in the electromagnetic induction heating mode fixing apparatus adopted in the present invention, which employs a relatively low pressure and a broad nip as a heating region regardless of a high fixing speed, a large amount of water vapor occurs at the nip between the rotatory heating member and the rotatory pressure member if the moisture content in the toner exceeds 3.00 wt. %. As a result, a small gap is liable to occur between the rotatory heating member and the rotatory pressure member if the moisture content in the toner exceeds 3.00 wt. %. As a result, a small gap is liable to occur between the rotatory heating member and the rotary pressure member, whereby the rotary heating member expected to rotate following the rotation of the pressure member fails to rotate due to a slip with the pressure member, thus causing fixing paper jamming or hot offset due to insufficient rotation of the rotatory heating member.

Especially, in a low temperature/low humidity environment, a large amount of steam exhausted out of the copying machine or printer is liable to cause "smoke", a mist of somewhat dewed steam in the atmosphere.

For the above reason, it is important that the toner has a moisture content of at most 3.00 wt. %.

The "moisture content" herein means a weight-basis moisture content, a percentage moisture weight in the total weight of a toner, as measured according to Karl Fischer method (JIS K-0068, moisture vaporization method) by using a sample after standing for 24 hours in an environment of 23° C. and 60% RH for measurement of gas on heating at 125° C.

Next, some morphological characteristics of the toner will be described.

The toner of the present invention may preferably have an average circularity (as hereinafter defined) of at least 0.940, more preferably 0.960 or higher.

The suppression of the moisture content provides a substantial effect in improving the image quality of the fixed images as mentioned above. As a result of our further study, it has been found possible to attain improvements in fixing uniformity and continuous image forming performance by using a toner having a high average circularity in the image forming method of the present invention.

A toner (composed of toner particles) having an average circularity of at least 0.940 retains few surface edges, thus exerting a lower friction with the fixing belt or film at the pressure contact position in the fixing apparatus to suppress the abrasion of the fixing belt and toner melt-sticking onto the fixing belt. On the other hand, if a toner having an average circularity below 0.940 is continually used, the local abrasion of the fixing belt with toner edges is caused to result in application of nonuniform pressure against the recording material. As a result, the resultant images are liable to cause gloss irregularity due to different gloss portions in the images. Further, as the toner of below 0.940 in average circularity is rich in edges, the pressure applied to the toner is liable to be concentrated at the edge portions when passing through the fixing nip, whereby the wearing of the fixing belt and toner melt-sticking are liable to be promoted. The toner melt-sticking leads to gloss irregularity in the fixed images and soiling of the fixed images, and is transferred to the pressure roller which is not sufficiently heated to an operation temperature at the time of start-up of the image forming apparatus, thus soiling the back surface of a recording sheet (or a first surface in the case of a double-sided printing mode).

If the average circularity is at least 0.940, the above difficulties are less liable to occur, and at 0.960 or above, can extremely hardly occur.

It is also much preferred that the toner has a mode circularity of at least 0.990 according to a number-basis circularity distribution, which means most of the toner particles have a shape close to a true sphere, so that the above-mentioned effects are further pronounced, an adverse influence on the fixing belt is minimized, and further a very high transfer efficiency can be achieved.

Particularly, if a toner having an average circularity of 0.960 or higher is used, the toner particles can be transferred in a densely packed state and can more uniformly contact the fixing belt in the fixing system of the present invention, whereby the fixing performance is less affected by air present between the toner particles and water vapor can be easily liberated through the toner particles, thus providing a further improved fixing performance with less liability of slip at a high-speed fixing operation.

The toner used in the present invention can also be produced through the pulverization process, but the toner particles produced through the pulverization process are generally caused to have indefinite shapes and arc required to have a sphering treatment, which may be a mechanical, a thermal or somewhat special one. Particularly, in order to provide a toner having an average circularity of 0.960 or higher, such a sphering treatment has to be performed sufficiently.

Further, the pulverization toner particles are essentially indefinitely shaped, and in the case of a magnetic toner, are accompanied with surface exposure of magnetic iron oxide particles contained therein. As a result, even if a pulverization process is provided with an average circularity of 0.960 or higher, the toner is liable to have somewhat inferior continuous image forming performances, with respect to cleaning performance and anti-high-temperature offset characteristic, due to a portion of toner particles accompanied with surface-exposed magnetic iron oxide particles.

For obviating the above difficulties accompanying the use of a pulverization process toner, it is preferred to use a toner directly obtained through a polymerization process, such as suspension polymerization, interfacial polymerization or dispersion polymerization to be performed in a dispersion medium or polymerization medium. In the polymerization process, a polymerizable monomer composition is formed by uniformly mixing a polymerizable monomer and a colorant (and optionally, a polymerization initiator, a crosslinking agent, a charge control agent, and other additives, as desired) in solution or dispersion, and is then dispersed in a continuous phase or dispersion medium (e.g., an aqueous phase) by appropriate stirring means, followed by polymerization reaction to obtain toner particles of a desired particle size. The toner thus obtained through the polymerization process (hereinafter sometimes called "polymerization toner") is composed of toner particles each having a uniformly spherical shape and therefore can easily satisfy a requirement of an average circularity of 0.960 or higher. Moreover, the toner can have a relatively uniform charge distribution, so that it exhibits a high transfer efficiency.

Now, the circularity of a toner will be described more specifically.

The average circularity is used herein as a quantitative measure for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3.0 $\mu$m) is determined according to an equation (1) below, and the circularity values (Ci) are totaled and divided by the number of total particles (m) to determine an average circularity ($C_{av}$) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity } (C_{av}) = \sum_{i=1}^{m} Ci/m \tag{2}$$

Further, the mode circularity ($C_{mode}$) is determined by allotting the measured circularity values of individual toner particles to 61 classes in the circularity range of 0.40–1.00, i.e., from 0.400–0.410, 0.410–0.420, . . . , 0.990–1.000 (for each range, the upper limit is not included) and 1.000, and taking the circularity of a class giving a highest frequency as a mode circularity ($C_{mode}$).

Incidentally, for actual calculation of an average circularity ($C_{av}$), the measured circularity values (Ci) of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity ($C_{av}$) is substantially identical to an average circularity value obtained (according to Equation (2) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity ($C_{av}$) and mode circularity ($C_{mode}$) with respect to particles having $D_{CE} \geqq 3.0$ $\mu$m.

The average circularity ($C_{av}$) used herein is a measure of roundness, a circularity of 1.00 means that the magnetic toner particles have a shape of a perfect sphere, and a lower circularity represents a complex particle shape of the magnetic toner.

Incidentally, only particles of $D_{CE} \geqq 3$ $\mu$m in a sample toner are used for measurement of circularity in the above measurement because particles having $D_{CE} < 3$ $\mu$m include particles of external additives other than toner particles and the inclusion of these particles obstructs an exact evaluation of an average toner particle shape.

Next, the significance of the residual monomer content of a toner will be described.

The toner of the present invention can provide high-quality fixed images for a long period through definition of the moisture content and average circularity thereof. However, when used in the image forming method of the present invention, such a toner is not always satisfactory regarding the soiling and toner melt-sticking on the fixing belt. As a result of our further study, the suppression of residual monomer content is found effective to provide improvements in respects of soiling and melt-sticking on the fixing apparatus and also abrasion durability as a synergistic effect with the definition of an average circularity. Further, the suppression of a residual monomer content also improves the matching with various members of the image forming apparatus.

In the present invention, the residual monomer content is preferably at most 300 ppm, more preferably at most 200 ppm, further preferably at most 100 ppm. If the residual monomer content in the toner exceeds 300 ppm, when a recording material carrying a toner image transferred from the image bearing member enters the heated nip portion in the fixing apparatus, the residual monomer content present in a liquid or solid state in the toner is abruptly heated to be vaporized and expanded to be liable to adversely affect the fixing performances. More specifically, the vaporized monomer is liable to penetrate into members of the fixing apparatus (such as the fixing belt and pressure roller) composed of organic materials to deteriorate such members, as by cracking or stiffening, thus shortening the life. The rate of deterioration can vary depending on residual monomer species, and aromatic monomers, such as styrene and styrene derivatives, are liable to accelerate the deterioration, presumably because of a relatively strong dissolving power for organic materials.

On the other hand, at the time of toner fixation, the toner particle surface is once melted. As heat is conducted from the surface to the core, the temperature increase or decrease at the core is somewhat delayed than the surface. Accordingly, if a substantial amount of monomer remains at a toner particle core, a partial vaporization thereof promotes a temperature decrease initiated at the toner particle surface due to latent heat of its vaporization to initiate the solidification at the toner particle surface, thus resulting in a continuous (half-melted) toner layer at the surface of a fixed image. In this state, if a vaporizing residual monomer still remains at the core, the monomer vaporization pressure is increased to cause a dome-like swelling (blister), breakage or destruction of the toner layer, which directly results in undesirable image defects.

The residual monomer content of a toner is originated from unreacted monomer at the time of binder resin production or polymerization toner production described hereinafter.

The binder resin is an indispensable toner component and occupies a substantial proportion, e.g., about 45–85 wt. % of the total weight of a toner, while it depends on the type of the toner. Accordingly, the above-mentioned difficulties are at a major proportion attributable to the residual monomer content in the binder resin and are less attributable to components in other materials. Hence, the residual monomer content in the toner is defined. However, as a result of our study, in the image forming method including an electromagnetic induction heating type fixing step, both the moisture content and residual monomer content are believed to be concerned in combination with the toner fixing performances.

The residual monomer content in the toner described herein is based on values measured in the following manner. Ca. 500 mg of a toner sample is accurately weighed in a sample bottle. Then, ca. 10 g of acetone is accurately weighed into the bottle, and the content is well mixed and then subjected to 30 min. of ultrasonic wave application by an ultrasonic washing machine. Then, the content is filtrated through a membrane filter (e.g., a disposable membrane filter "25JP020AN", made by Advantec Toyo K.K.), and 2 ml of the filtrate liquid is subjected to gas chromatography. The results are compared with calibration curves prepared in advance by using styrene and other monomers. The gas chromatography conditions are as follows.

Gas chromatograph: "Model 6890GC", made by Hewlett-Packard Corp.

Column: INNOWax (200 $\mu$m×0.40 $\mu$m×25 m) made by Hewlett-Packard Corp.

Carrier gas: He (constant pressure mode: 20 psi)

Oven: Held at 50° C. for 10 min., heated up to 200° C. at a rate of 10° C./min. and held at 200° C. for 5 min.

INJ: 200° C., pulsed split-less mode (20–40 psi, unit 0.5 min.)

Split rate: 5.0:1.0

DET: 250° C. (FID)

Further, as mentioned above, a toner image transferred onto a recording material is composed of a plurality of toner particle layers, and heat conduction to the toner particles in the respective layers is not uniform. More specifically, heat conduction to the toner particle layer remotest from the recording material (i.e., closest to the heating member) is different from heat conduction to the toner particle layer closest to the recording material (i.e., remotest from the heating member). Moreover, the influence of the thermal properties of the recording material is small on the toner particle layer closest to the heating member but large on the toner particle layer remotest from the heating member.

Accordingly in order to evaluate the thermal behavior of a toner around the fixing nip, it is not appropriate to note only the toner properties at the set surface temperature of the fixing member.

In consideration of the above factors, it has been found effect to use a storage modulus G' (110° C.) at 110° C. of the toner as a parameter well representing the behavior of the toner on the recording material entering the fixing nip, and a storage modulus G' (140° C.) at 140° C. of the toner as a parameter well representing the behavior of the toner on the recording material exiting out of the fixing nip.

In the present invention, it is important for the toner to exhibit G' (110° C.)$\leqq 1.00\times10^6$ dN/m$^2$. If G' (110° C.) exceeds $1.00\times10^6$ dN/m$^2$, the deformation of toner particles at the initial stage of the fixing step becomes insufficient, so that a portion of inorganic fine powder as an external additive can fail to be well embedded at the toner particle surface at the initial stage of fixation. As a result, the fixing member is liable to be damaged for a long period of continual fixing operation. For a similar reason, G' (110° C.) is preferably at most $7.00\times10^5$ dN/m$^2$.

On the other hand, in the present invention, it is also important for the toner to exhibit G' (140° C.)$\geqq 7.00\times10^3$ dN/m$^2$. Some portion, though it is in a vary small amount, of inorganic fine powder is attached to a non-image part, i.e., a part not covered with a toner image, of the recording material conveyed to the fixing step. This is a portion of inorganic fine powder liberated from the surface of toner particles and transferred onto the recording material. If the portion of the inorganic fine powder on the recording material is transferred onto the fixing member and continually attached on the fixing member for a long period, the fixing member is liable to be damaged by the inorganic fine powder which per se is a rigid material, to leave minute damages on the fixing member which lead to irregular fixing performances.

It is possible to prevent the continual attachment of the inorganic fine powder onto the fixing member by using a toner exhibiting an appropriate value of storage modulus G' (140° C.). More specifically, by contact with a fresh toner image, the fine powder attached to the fixing member can be captured to the fixed image, thus being separated from the fixing member to obviate the damage of the fixing member with the attached inorganic fine powder.

If G' (140° C.) is below $7.00\times10^3$ dN/m$^2$, the effective capture of the inorganic fine powder on the fixing member. For a similar reason, G'$\geqq 1.00\times10^4$ dN/m$^2$ is further preferred.

In the fixing step according to the electromagnetic induction heating scheme of the image forming method of the present invention, it is further preferred that a temperature Z1 (° C.) of the rotatory heating member before entering the nip, a temperature Z2 (° C.) of the heating member after passing the nip and temperature Z3 (° C.) of the heating member at a region thereof preceding the heat-generating region, satisfy a relationship of:

$$Z3 \leqq Z2 < Z1; \text{ and}$$

the toner comprises at least toner particles and inorganic fine powder and satisfies:

$$G'\ (110^\circ\ \text{C.}) \leqq 1.00\times10^6\ \text{dN/m}^2, \text{ and}$$

$$G'\ (140^\circ\ \text{C.}) \geqq 7.00\times10^3\ \text{dN/m}^2,$$

for effectively fixing a toner image using a small-particle size toner, particularly a full-color toner image by using small-particle size color toner.

The G' (110° C.) and G' (140° C.) values of a toner described herein are based on values of storage modulus G' measured in a temperature range of 60–210° C. by using a viscoelasticity measurement apparatus (rheometer) ("Model RDA-II", mfd. by Rhoemetrics Co.) under the following conditions:

Holder: Circular parallel plates of 25 mm in diameter, including a circular plate and a shallow cup-form actuator with a gap of ca. 2 mm between the circular plate and the bottom surface of the shallow cup.

Sample: A sample toner is press-molded into a disk sample of ca. 25 mm in diameter and ca. 2 mm in height.

Measurement frequency: 6.28 radians/sec.

Sample elongation correction: automatic measurement mode.

Temperature raising rate: 2° C./min in the range of 60–210° C.

The storage modulus values measured at 110° C. and 140° C. in the above measurement are taken as G' (110° C.) and G' (140° C.).

The toner used in the present invention is further characterized by including of hydrophobized inorganic fine powder having an average primary particle size of 4–80 nm.

Such inorganic fine powder is generally added to a toner for the purpose of improving the flowability and charge uniformization of toner particles. However, by hydrophobizing the inorganic fine powder with, e.g., silicone oil, it is possible to achieve not only the chargeability adjustment and environmental stability of the toner but also the improvement in releasability of the toner with respect to the fixing belt.

The addition of hydrophobized inorganic fine powder is also preferred for the purpose of retaining a high levels of toner chargeability to prevent toner scattering even in a high humidity environment.

The hydrophobization of inorganic fine powder may, for example, be performed by effecting the silylation as a first-step reaction to remove or reduce the silanol groups by chemical bonding and then forming a hydrophobic film of silicone oil on the surface as a second-step reaction.

The silicone oil used for the above purpose may preferably have a viscosity at 25° C. of 10–200,000 $mm^2/s$, more preferably 3,000–80,000 $mm^2/s$. If the viscosity is below 10 $mm^2/s$, the silicone oil is liable to lack in stable treatability of the inorganic fine powder, so that the silicone oil coating the inorganic fine powder for the treatment is liable to be separated, transferred or deteriorated due to heat or mechanical stress, thus resulting in inferior image quality. On the other hand, if the viscosity is larger than 200,000 $mm^2/s$, the treatment of the inorganic fine powder with the silicone oil is liable to become difficult.

Particularly preferred species of the silicone oil used may include: dimethylsilicone oil, methylphenylsilicone oil, α-methylstyrene-modified silicone oil, chlorophenylsilicone oil, and fluorine-containing silicone oil.

The silicone oil treatment may be performed e.g., by directly blending the inorganic fine powder (optionally preliminarily treated with e.g., silane coupling agent) with silicone oil by means of a blender such as a HENSCHEL MIXER; by spraying silicone oil onto the inorganic fine powder; or by dissolving or dispersing silicone oil in an appropriate solvent and adding thereto the inorganic fine powder for blending, followed by removal of the solvent. In view of less by-production of the agglomerates, the spraying is particularly preferred.

The silicone oil may be used in 1–23 wt. parts, preferably 5–20 wt. parts, per 100 wt. parts of the inorganic fine powder before the treatment. Below 1 wt. part, good hydrophobicity cannot be attained, and above 23 wt. parts, difficulties, such as the occurrence of fog, are liable to be caused.

As the hydrophobization agents for the inorganic fine powder, it is also possible to use silicone varnish, various modified silicone varnish, silicone oil, various modified silicone oil, silane compounds, silane coupling agents, other organic silicon compounds and organic titanate compounds singly or in combination.

The inorganic fine powder may preferably have an average primary particle size of 4–80 nm.

In case where the inorganic fine powder has an average primary particle size larger than 80 nm or the inorganic fine powder is not added, the transfer-residual toner particles, when attached to the charging member, are liable to stick to the charging member, so that it becomes difficult to stably attain good uniform chargeability of the image-bearing member. Further, it becomes difficult to attain good toner flowability, and the toner particles are liable to be ununiformly charged to result in problems, such as increased fog, image density lowering and toner scattering.

In case where the inorganic fine powder has an average primary particle size below 4 nm, the inorganic fine powder is caused to have strong agglomeratability, so that the inorganic fine powder is liable to have a broad particle size distribution including agglomerates of which the disintegration is difficult, rather than the primary particles, thus being liable to result in image defects such as image dropout due development with the agglomerates of the inorganic fine powder and defects attributable to damages on the image-bearing member, developer-carrying member or contact charging member, by the agglomerates. In order to provide a more uniform charge distribution of toner particles, it is further preferred that the average primary particle size of the inorganic fine powder is in the range of 6–35 nm.

The number-average primary particle size of inorganic fine powder described herein is based on the values measured in the following manner. A developer sample is photographed in an enlarged form through a scanning electron microscope (SEM) equipped with an elementary analyzer such as an X-ray microanalyzer (XMA) to provide an ordinary SEM picture and also an XMA picture mapped with elements contained in the inorganic fine powder. Then, by comparing these pictures, the sizes of 100 or more inorganic fine powder primary particles attached onto or isolated from the toner particles are measured to provide a number-average particle size.

The inorganic fine powder used in the present invention may preferably comprise fine powder of at least one species selected from the group consisting of silica, titania and alumina.

For example, silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide powder with other metal oxides for example by using another metal halide, such as aluminum chloride or titanium chloride together with silicon halide in the production process.

It is preferred that the inorganic fine powder having a number-average primary particle size of 4–80 nm is added in 0.1–3.0 wt. parts per 100 wt. parts of the toner particles. Below 0.1 wt. part, the effect is insufficient, and above 3.0 wt. parts, the fixability is liable to be lowered.

The inorganic fine powder having a number-average primary particle size of 4–80 nm may preferably have a specific surface area of 20–250 $m^2/g$, more preferably 40–200 $m^2/g$; as measured by the nitrogen adsorption BET method, e.g., the BET multi-point method using a specific surface area meter ("AUTOSORB 1", made by Yuasa Ionix K.K.).

Within an extent of not adversely affecting the toner of the present invention, it is also possible to include other additives, inclusive of lubricant powder, such as TEFLON powder, zinc stearate powder, and polyvinylidene fluoride powder; abrasives, such as cerium oxide powder, silicon carbide powder, and strontium titanate powder; flowability-imparting agents, or anti-caking agents such as titanium oxide powder, and aluminum oxide powder; medium or large-particle size inorganic or organic spherical particles having a primary particle size exceeding 30 nm as a cleaning performance improver, such as spherical silica particles, spherical polymethylsilsesquioxane particles, and spherical resin particles; and a developing performance improver such as organic and/or inorganic fine particles chargeable to a polarity opposite to that of toner particles. Such additives may also be added after surface hydrophobization.

The other component of the toner will be described.

The binder resin of the toner used in the present invention may preferably comprise a THF-soluble content having a molecular weight distribution showing at least one peak in a molecular weight region of $10^{3-105}$. If no peak is found in the above range, the resultant toner is liable to have inferior anti-blocking property or fail in providing a fixing performance over a wide temperature region. In the case of full-color image formation, it become difficult to ensure a color mixing temperature region suitable for clean color reproduction in providing full color images by superposed development.

Examples of the binder resin used for pulverization toner production may include: polystyrene; homopolymers of substituted derivatives, such as polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, aromatic petroleum resin; paraffin wax, ester wax, carnauba wax, and polyethylene wax. These binder resins and resinous materials may be used singly or in mixture. Styrene copolymers and polyester resins are particularly preferred in view of developing performance and fixing performance.

(GPC molecular weight distribution measurement)

The GPC (gel permeation chromatography) measurement for providing a chromatogram determining peak or/and shoulder molecular weights as polystyrene-equivalent molecular weights may be performed in the following manner.

A sample toner is dissolved in THF (tetrahydrofuran) to provide a solution having a resin concentration of about 0.4–0.6 mg/ml, and the solution is filtrated through a solvent-resistant membrane filter having a pore diameter of 0.2 $\mu$m.

Then, columns are stabilized in a heat chamber at 40° C., THF solvent is flowed at rate of 1 ml/min., and ca. 100 ml of the above-prepared sample solution is injected to the columns for the GPC measurement. For determination of a sample molecular weight distribution, a calibration curve showing a correlation between logarithmic scale molecular weights and corresponding GPC counts has been prepared by using several monodisperse polystyrene standard samples, i.e., TSK Standard Polystyrene F-850, F-450, F-288, F-128, F-80, F-40, F-20, F-10, F-4, F-2, F-1, A-5000, A-2500, A-1000 and A-500 available from Toso K.K. The detector comprises a combination of an RI (refractive index) detector and a UV (ultraviolet) detector arranged in series. The columns may preferably comprise a plurality of commercially available polystyrene gel columns. For providing GPC data described herein, a combination of Shodex GPC KF-801, 802, 803, 804, 805, 806, 807 and 800P available from Showa-Denko K.K was used for a high speed GPC apparatus ("HPLC 8120 GPC", available from Toso K.K.).

In the case of toner production through a polymerization process, a polymerizable monomer composition may be prepared from the materials.

Examples of the polymerizable monomer may include: styrene family monomers, such as styrene, o-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenylmethacrylate, dimethylaminoethyl methacrylate, and diethylaminoethyl methacrylate; acrylonitrile, methacrylonitrile and acrylamide.

The above monomers may be used singly or in mixture of two or more species. Among the above monomer, it is preferred to use styrene or a styrene derivative alone or in mixture with another mixture in view of the developing performance and continuous image forming performances of the resultant toner.

In the polymerization toner production, it is also possible to add a resin to the monomer composition before the polymerization. For example, in order to introduce polymerized units of a monomer having a hydrophilic functional group, such as amino group, carboxyl group, hydroxyl group, sulfonic acid group, glycidyl group, or nitrile group, which monomer cannot be directly used in an aqueous suspension medium because of its solubility to cause emulsion polymerization, it is possible to use a copolymer, such as a random copolymer, block copolymer or graft copolymer, of such a functional monomer with a vinyl compound, such as styrene or ethylene; a polycondensate, such as polyester or a polyamide, or a polyaddition polymer, such as a polyether, as a polyimine.

In the case of using such a polymer having a functional group, the average molecular weight thereof is preferably at least 5000. Below 5000, particularly 4000 or less, such a functional monomer is liable to be concentrate at the surface of polymerizate toner particles to a adversely affect the developing performance and the anti-blocking performance. As such a polymer, a polyester-type resin is particularly preferred.

Further, for the purpose of improving the dispersibility of additives, fixability and improvement of image forming characteristics, it is also possible to add a resin other than the above-mentioned resins. Examples of such a resin may include: polystyrene; homopolymers of substituted derivatives, such as polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resin may be used singly or in mixture.

These resins may preferably be added in 1–20 wt. parts per 100 wt. parts of the monomer. Below 1 wt. part, the addition effect is scarce, an din excess of 20 wt. parts, the designing of various properties of the resultant polymerization toner becomes difficult.

Further, by dissolving a polymer having a molecular weight different from a molecular weight range of a polymer obtained by polymerization of a monomer in the monomer, before the polymerization, it becomes possible to obtain a toner having a broad molecular weight distribution and exhibiting excellent anti-offset performance.

In either of the polymerization process toner or the pulverization process toner, the binder resin may preferably have a glass transition temperature (Tg) of 40–70° C., more preferably 45–65° C. Such a glass transition temperature may generally be provided by mixing monomers so as to provide a theoretical glass transition temperature according a publication "Polymer Handbook", Second Edition, III, pp. 139–192 (John Wiley & Sons, Co.) of 40–70° C. If Tg is below 40° C., the toner is liable to have inferior storage stability and stable image forming performance. In excess of 70° C., the fixing performance of the toner can be problematic.

The Tg values described herein are based on values measured in the following manner.

Figure 14:
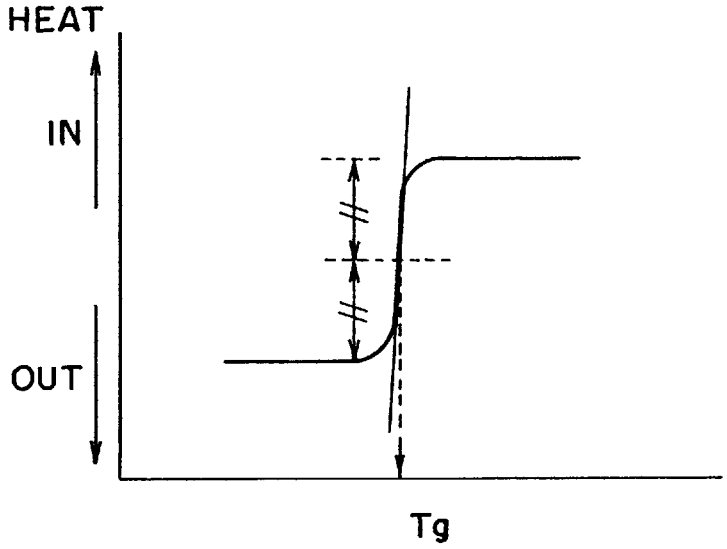
FIG. 14 illustrates a glass transition temperature (Tg).
Figure 15A:
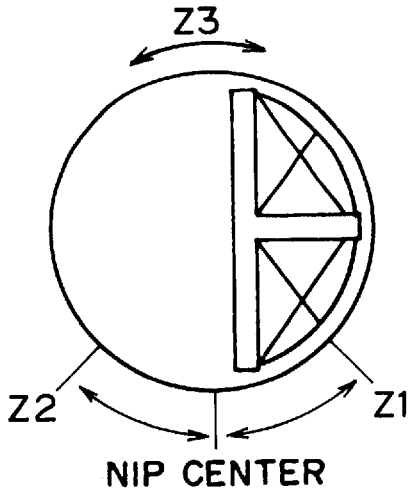
FIGS. 15A–15E illustrate temperature-detection positions Z1, Z2 an Z3.
Figure 15B:
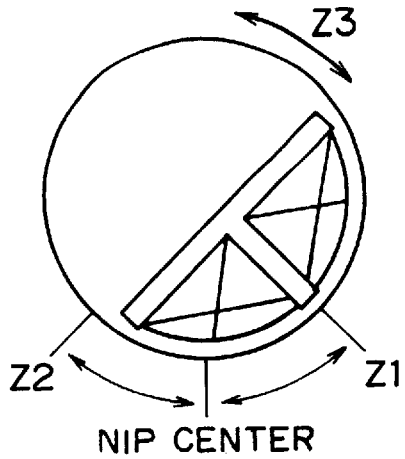
Figure 15C:
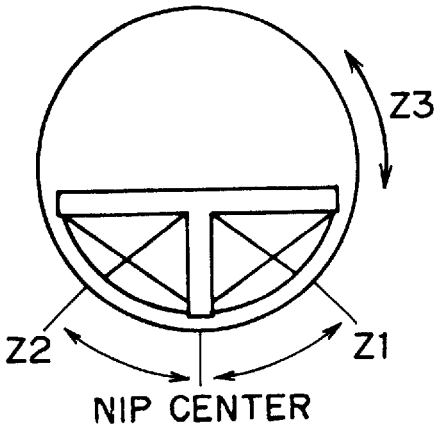
Figure 15D:
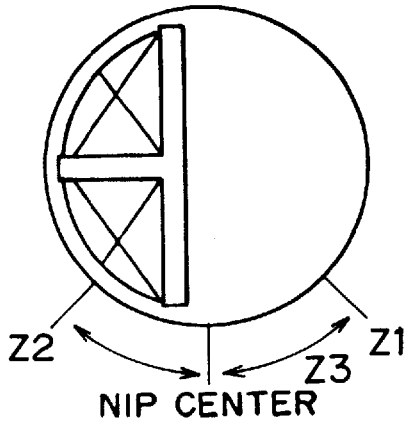
Figure 15E:
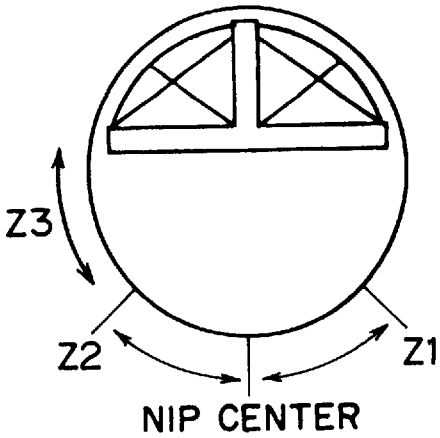

A sample toner (or resin) is once heated and cooled to remove its thermal history, and then again subjected to second heating to obtain a DSC curve on temperature increase. Based on such a DSC curve as schematically illustrated in FIG. 14, a middle line is drawn between base lines before and after heating, and the temperature of an intersection of the middle line with the DSC heating curve is taken as Tg (glass transition temperature).

The toner of the present invention contains a colorant as an essential component for coloring. Organic pigments or dyes preferably used in the present invention may include the following.

Organic pigments or dyes as cyan colorants may include: copper phthalocyanine components and derivatives thereof, anthraquinone compounds, and basic dye lake compound. Specific examples thereof may include: C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Organic pigments or dyes as magenta colorants may include: condensed azo compounds, deketopyrrolopyrrole compounds, anthraquinone, quinacridone compounds, basic dye lake compounds, naphthole compounds, benzimidazolone compounds, thioindigo compounds and perylene compounds. Specific examples thereof may include: C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Organic pigments or dyes as yellow colorants may representatively include: condensed azo compounds, isoindolinone compounds, anthraquinone compounds, azo metal complexes, methine compounds and arylamide compounds. Specific Examples thereof may include: C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

These colorants may be used singly or in mixture, or further in a state of solid solution. In preparing the toner of the present invention, these colorants may be selected in view of the angles, saturation, brightness, light fastness, capable of providing OHP transparencies, and dispersibility in toner particles.

Such a colorant may be added in a proportion of 1–20 wt. parts per 100 wt. parts of the binder resin.

As a black colorant, it is possible to use carbon black, a magnetic material, or a black mixture of yellow/magenta/cyan colorants appropriately selected from the above.

A magnetic material as a black colorant, unlike another colorant, may be added in 30–200 wt. parts per 100 wt. parts of the binder resin.

As such a magnetic material, it is possible to use a metal, an alloy or a metal oxide containing an element of, e.g., iron, cobalt, nickel, copper, magnesium, manganese, aluminum or silicon. Among these, it is preferable to use a magnetic material principally comprising iron oxide, such as triiron tetroxide or γ-iron oxide. Such magnetic iron oxide particles may contain another element, such as silicon or aluminum for controlling the toner chargeability. These magnetic particles may preferably have a BET specific surface area of 2–30 $m^2/g$, more preferably 3–28 $m^2/g$, as measured by the nitrogen adsorption method, and a Moh's hardness of 5–7.

The magnetic particles have a particle shape which is octahedral, hexahedral, spherical, acicular or flaky. A less anisotropic shape, such as an octahedral, hexahedral, spherical or indefinite shape is preferred to provide a high image density. The magnetic particles may preferably have an average particle size of 0.05–1.0 μm, more preferably 0.1–0.6 μm, further preferably 0.1–0.3 μm.

The magnetic material may preferably be added in 30–200 wt. parts, more preferably 40–120 wt. parts, further preferably 50–150 wt. parts. Below 30 wt. parts, the coloring power is lowered, and in a developing apparatus using a magnetic force for toner conveyance, the conveyance characteristic is liable to be impaired, thus being liable to result in an irregularity in magnetic toner layer on the developer-carrying member, leading to image irregularity. Further, the triboelectric charge of the magnetic toner is liable to be increased to result in image irregularity. On the other hand, in excess of 200 wt. parts, the fixability of the toner is liable to be problematic.

In the polymerization toner production, it is necessary to pay attention to the polymerization inhibiting function and migratability to the aqueous phase. For this purpose, it is preferred to subject the colorant to a surface-modifying treatment, e.g., hydrophobization with a substance having no polymerization inhibiting function. The treatment of a dye or a pigment may for example be performed by polymerizing a polymerizable monomer into the presence of such a dye or pigment. The resultant colored polymer may be incorporated in a polymerizable monomer composition for further polymerization prepare to toner particles.

The above treatment is also applicable to carbon black. In addition, carbon black can also be treated with a substance reactive with a surface-functional group of the carbon black, e.g., with polyorganosiloxane.

The above-surface treatment may also be effective for treating a magnetic material before inclusion thereof into a polymerizable monomer composition.

In the polymerization toner production, a polymerization initiator exhibiting a half life of 0.5–30 hours at the reaction temperature may be added in 0.5–20 wt. parts per 100 wt. parts of the polymerizable monomer to form a polymer having a peak molecular weight in a molecular weight range of $1\times10^{4-10\times104}$, thus providing the resultant toner with a desirable strength and appropriate visco-elastic characteristic. Examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-ethoxy-2,4-dimethylvaleronitrile, azobis-isobutyro-nitrile; and peroxide-type polymerization initiators such as benzoyl peroxide, methyl ethyl ketone peroxide, diisopropyl peroxycarbonate cumene hydroperoxide, 2,4-dichlorobenzoyl peroxide, lauroyl peroxide, and t-butylperoxy-2-ethylhexanoate.

For the polymerization toner production, a crosslinking agent can be added in a proportion of 0.001–15 wt. parts per 100 wt. parts of the monomer.

The crosslinking agent may for example be a compound having two or more polymerizable double bonds. Examples thereof may include: aromatic divinyl compounds, such as divinylbenzene, and divinylnaphthalene; carboxylate esters having two double bonds, such as ethylene glycol diacrylate, ethylene glycol dimethacrylate, and 1,3-butane diol dimethacrylate; divinyl compounds, such as divinylaniline, divinyl ether, divinyl sulfide and divinyl sulfone; and compounds having three or more vinyl groups. These may be used singly or in mixture.

In order to produce the toner through a suspension polymerization process, the above-mentioned polymerizable monomer composition or monomeric mixture, i.e., a mixture of a polymerizable monomer and a colorant or magnetic powder, and other toner components, such as a wax, plasticizer, a charge control agent, and a crosslinking agent, as desired; further optional ingredients, such as an organic solvent, a polymer, an additive polymer, and dispersing agent, subjected to uniform dissolution or dispersion by a dispersing machine, such as a homogenizer, a ball mill, a colloid mill or an ultrasonic dispersing machine, may be suspended in an aqueous medium. At this time, it is preferred to use a high-speed dispersing machine, such as a high-speed stirrer or an ultrasonic dispersing machine to form droplets of the monomeric mixture in desired size at a stroke in order to provide toner particles of a narrower particle size distribution.

The polymerization initiator may be added to the polymerization system by adding it to the monomeric mixture together with the other ingredient for providing the monomeric mixture or just before dispersing the monomeric mixture in the aqueous medium. Alternatively, it is also possible to add such a peroxide polymerization initiator in solution within a polymerizable monomer or another solvent into the polymerization system just after the formation of the droplets of the monomeric mixture and before the initiation of the polymerization. After the formation of the droplets of the monomeric mixture, the system may be stirred by an ordinary stirrer at an appropriate degree for maintaining droplet state and preventing the floating or sedimentation of the droplets.

Into the suspension polymerization system, a dispersion stabilizer may be added. As the dispersion stabilizer, it is possible to use a known surfactant or organic or inorganic dispersion agent. Among these, an inorganic dispersing agent may preferably be used because it is less liable to result in excessively small particles which can cause some image defects, its dispersion function is less liable to be impaired even at a temperature change because its stabilizing function principally relies on its steric hindrance, and also it can be readily removed by washing to be less liable to adversely affect the resultant toner performance. Examples of such an inorganic dispersing agent may include: polyvalent metal phosphates, such as calcium phosphate, magnesium phosphate, aluminum phosphate, and zinc phosphate; carbonates, such as calcium carbonate and magnesium carbonate; inorganic salts, such as calcium metasilicate, calcium sulfate, and barium sulfate; and inorganic oxides, such as calcium hydroxide, magnesium hydroxide, aluminum hydroxide, silica bentonite, and alumina.

Such an inorganic dispersing agent may desirably be used singly in an amount of 0.2–20 wt. parts per 100 wt. parts of the polymerizable monomeric mixture so as to avoid the occurrence of ultrafine particles , but it is also possible to use 0.001–0.1 wt. part of a surfactant in combination for providing smaller toner particles.

Examples of such a surfactant may include: sodium dodecylbenzenesulfate, sodium tetradecylsulfate, sodium pentadecylsulfate, sodium octylsulfate, sodium oleate, sodium laurate, sodium stearate, and potassium stearate.

An inorganic agent as mentioned above may be used as it is but may be produced in situ in the aqueous medium for suspension polymerization in order to provide toner particles of a narrower particle size distribution. For example, in the case of calcium phosphate, a sodium phosphate aqueous solution and a calcium phosphate aqueous solution may be blended under high-speed stirring to form water-insoluble calcium phosphate, which allows the dispersion of a monomeric mixture into droplets of a more uniform size. At this time, water-soluble sodium chloride is by-produced, but the presence of such a water-soluble salt is effective for suppressing the dissolution of a polymerizable monomer into the aqueous medium, thus conveniently suppressing the formation of ultrafine toner particles owing to emulsion polymerization. Such a water-soluble salt can obstruct the removal of residual polymerizable monomer, and is therefore desirably removed by exchanging of the aqueous medium or by treatment with an ion-exchange resin, Anyway, an inorganic dispersant can be almost completely removed by dissolution with acid or alkali after the polymerization.

The temperature for the suspension polymerization may be set to at least 40° C., generally in a range of 50–90° C. The polymerization in this temperature range is preferred because the wax is precipitated by phase separation to be enclosed more completely. In order to consume the residual polymerizable monomer, it is possible to raise the reaction temperature up to 90–150° C. at the final stage of polymerization.

The polymerizate toner particles after the present invention may be recovered by filtration, washing and drying, and then blended with the inorganic fine powder in a known manner so as to attach the inorganic fine powder on the toner particles. It is also preferred mode of modification to subject the recovered polymerizate toner particles to a classification step for removal of a coarse and a fine powder fraction.

The pulverization process toner production may be performed in a known manner. For example, toner ingredients, such as a binder resin, a colorant, a magnetic material, a release agent, a charge control agent and/or other additives are sufficiently blended in a blender, such as a HENSCHEL MIXER or a ball mill, and melt-kneaded to well mutually dissolve the resins are dispersed the colorant or magnetic material therein to form a kneaded product, which is then cooled for solidification, pulverized, classified and surface-treated as desired to obtain toner particles. The classification and the surface treatment can be effected in either order. In the classification step, it is preferred to use a multi-division classifier in view of production efficiency.

The pulverization step may be effected by using a known pulverization apparatus of a mechanical impact-type, a jet-type, etc. In order to provide a toner having a high circularity used in the present invention. The pulverization may preferably be effected under heating or application of supplemental mechanical impact. Further, it is also possible to subject finely pulverized (and optionally classified) toner particles to dispersion in a hot water bath or passing through a hot gas stream.

The mechanical impact application may be effected by using a mechanical impact-type pulverizer, such as KRYPTRON system (of Kawasaki Jukogyo K.K.) or TURBO MILL (of Turbo Kogyo K.K.), or a mechanical impact application system, such as MECHANOFUSION system (of Hosokawa Micron K.K.) or HYBRIDIZATION System (of Nara Kikai Seisakusho K.K.) wherein toner particles are pressed against an inner wall of a casing under action of a centrifugal force exerted by blades stirring at high speeds, thereby applying mechanical impact forces including compression and abrasion forces to the toner particles.

For the mechanical impact application treatment for sphering of toner particles, it is preferred that the treatment atmosphere temperature to a range of temperature of Tg±10° C. around the glass transition temperature (Tg) of the toner particles, in view of agglomeration prevention and productivity. A treatment temperature in a range of Tg±5° C. is further preferred for providing an improved transfer efficiency.

The toner particles used in the present invention can also be produced through a process for spraying a molten mixture into air through a disk or a multi-fluid nozzle to obtain spherical toner particles (JP-B 56-13945), and polymerization processes other than suspension polymerization, inclusive of processes as represented by a dispersion polymerization process wherein toner particles are directly produced in an aqueous organic solvent wherein a monomer is soluble but the resultant polymer is insoluble; and emulsion polymerization processes, as represented by a soap-free polymerization process wherein toner particles are directly produced through polymerization in the presence of a water-soluble polar polymerization initiator.

It is an also preferred form of the toner used in the present invention to contain a release agent in a proportion of 0.5–50 wt. % of the toner.

A toner image transferred onto a recording material is then heated and pressed to fixed onto the recording material to provide a semipermanent fixed image.

If a toner having a weight-average particle size of at most 10 $\mu$m is used, it is possible to obtain a very highly defined image, but such small-particle size toner particles are liable to plug into gap between fibers of paper as a recording material, so that heat supply from the heating member for fixation is liable to be insufficient, thus causing low-temperature offset. However, by inclusion of an appropriate amount of wax as a release agent, it is possible to satisfy high resolution characteristic and anti-offset characteristic while avoiding the abrasion of the photosensitive member.

Examples of waxes usable in the toner of the present invention may include: petroleum waxes and derivatives thereof, such as paraffin wax, microcrystalline wax and petrolatum; montan wax and derivatives thereof; hydrocarbon wax by Fischer-Tropsch process and derivative thereof; polyolefin waxes as represented by polyethylene wax and derivatives thereof; and natural waxes, such as carnauba wax and candelilla wax and derivatives thereof. The derivatives may include oxides, block copolymers with vinyl monomers, and graft-modified products. Further examples may include: higher aliphatic alcohols, fatty acids, such as stearic acid and palmitic acid, and compounds of these, acid amide wax, ester wax, ketones, hardened castor oil and derivatives thereof, negative waxes and animal waxes.

It is preferred for the toner containing a wax as mentioned above to exhibit a thermal behavior as represented by a DSC curve on temperature increase showing a heat absorption peak in a region of 20–200° C., and a maximum heat absorption peak in a region of 50–150° C., obtained by using a differential scanning calorimeter. It is further preferred to provide a DSC curve on temperature decrease showing a heat evolution peak in a temperature range of 20–200° C., and a maximum heat evolution peak in a temperature region of 40–150° C. By having a heat-absorption peak and a maximum heat-absorption peak in the above-mentioned temperature regions, the toner can exhibit both low-temperature fixability and releasability while exhibiting good matching with the fixing step of the present invention. If the heat-absorption peak is present below 20° C., the anti-high-temperature offset characteristic of the toner is liable to be impaired, and in excess of 200° C., the low-temperature fixability of the toner is liable to be impaired. On the other hand, if the maximum heat-absorption peak on temperature increase is below 50° C. (or the maximum heat evolution peak on temperature decrease is below 40° C.), the wax compound can exhibit only low self-cohesion force, thus being liable to show inferior anti-high-temperature offset characteristic. If the maximum heat-absorption peak is at a temperature above 150° C., the fixing temperature becomes high and low-temperature offset is liable to occur.

The heat-absorption peak temperature or heat-evolution peak temperature of a toner or a wax may be measured by differential thermal analysis similarly as a heat-absorption peak of a wax as described hereinafter. More specifically, the glass transition temperature may be measured by using a differential scanning calorimeter (DSC) (e.g., "DSC-7", available from Perkin-Elmer Corp.) according to ASTM D3418-8. Temperature correction of the detector may be effected based on melting points of indium and zinc, and calorie correction may be affected based on heat of fusion of indium. A sample is placed on an aluminum pan and subjected to heat at an increasing rate of 10° C./min in parallel with a blank aluminum pan as a control.

In the toner used in the present invention, such a wax component may preferably be contained in 0.5–50 wt. % in the toner. Below 0.5 wt. %, the low-temperature offset preventing effect is insufficient, and above 50 wt. %, the storability for a long period of the toner becomes inferior, and the dispersibility of other toner ingredients is impaired to result in lower flowability of the toner and lower image qualities.

The toner used in the present invention can further contain a charge control agent so as to stabilize the chargeability. Known charge control agents can be used. It is preferred to use a charge control agent providing a quick charging speed and stably providing a constant charge. In the case of polymerization toner production, it is particularly preferred to use a charge control agent showing low polymerization inhibition effect and substantially no solubility in aqueous dispersion medium. Specific examples thereof may include; negative charge control agents, inclusive of: metal compounds of aromatic carboxylic acids, such as salicylic acid, alkylsalicylic acids, dialkylsalicylic acids, naphthoic acid, and dicarboxylic acids; metal salts or metal complexes of azo-dyes and azo pigments; polymeric compounds having a sulfonic acid group or carboxylic acid group in side chains; boron compounds, urea compounds, silicon compounds, and calixarenes. Positive charge control agents may include: quaternary ammonium salts, polymeric compounds having such quaternary ammonium salts in side chains, quinacridone compounds, nigrosine compounds and imidazole compounds. The charge control agent may preferably be contained in 0.5–10 wt. parts, per 100 wt. parts of the binder resin.

However, it is not essential for the toner of the present invention to contain a charge control agent, but the toner need not necessarily contain a charge control agent by positively utilizing the triboelectrification with a toner layer thickness-regulating member and a toner-carrying member.

Hereinbelow, the present invention will be more specifically described based on Production Examples an Examples, which should not be however construed to restrict the scope of the present invention in any way.

Production of Surface-treated Magnetic Powder

Into a ferrous sulfate aqueous solution, an aqueous solution of caustic soda in an amount of 1.0–1.1 equivalent of the iron of the ferrous sulfate, was added to form an aqueous solution containing ferrous hydroxide. While retaining the pH of the aqueous solution at ca. 9, air was blown thereinto to cause oxidation at 80–90° C., thereby forming a slurry liquid containing seed crystals.

Then, into the slurry liquid, a ferrous sulfate aqueous solution was added in an amount of 0.9–1.2 equivalent with respect to the initially added alkali (sodium in the caustic soda), and air was blown thereinto to proceed with the oxidation while maintaining the slurry at pH 7.8.

The resultant magnetic iron oxide particles formed after the oxidation was washed and once recovered by filtration. A portion of the moisture-containing product was taken out to measure a moisture content. Then, the remaining water-containing product, without drying, was re-dispersed in another aqueous medium, and the pH of the re-dispersion liquid was adjusted to ca. 6. Then, into the dispersion liquid under sufficient stirring, a silane coupling agent ($n\text{-}C_{10}H_{21}Si(OCH_3)_3$) in an amount of 1.0 wt. % of the magnetic iron oxide (calculated by subtracting the moisture content from the water-containing product magnetic iron oxide) was added to effect a coupling treatment for hydrophobization. The thus-hydrophobized magnetic iron oxide particles were washed, filtrated and dried in ordinary manners, followed further by disintegration of slightly agglomerated particles, to obtain Surface-treated magnetic powder having a volume-average particle size (Dv) of 0.35 $\mu$m.

Toner Production Example 1

Into 809 wt. parts of deionized water, 501 wt. parts of 0.1 mol/l-$Na_3PO_4$ aqueous solution was added, and after heating at 60° C., 67.7 wt. parts of 1.07 mol/l-$CaCl_2$ aqueous solution was gradually added thereto to form an aqueous medium containing calcium phosphate.

| | |
|---|---|
| Styrene | 78 wt. part(s) |
| n-Butyl acrylate | 22 wt. part(s) |
| Divinylbenzene | 0.3 wt. part(s) |
| Unsaturated polyester resin (Mn = 18000, Mw/Mn = 2.2) | 0.5 wt. part(s) |
| Saturated polyester resin (Mn = 17000, Mw/Mn = 2.4) | 4.5 wt. part(s) |
| Monoazo dye Fe compound (Negative charge control agent) | 1 wt. part(s) |
| Surface-treated magnetic powder | 100 wt. part(s) |

The above ingredients were uniformly dispersed and mixed by an attritor to form a monomer composition. The monomer composition was warmed at 60° C., and 10 wt. parts of an ester wax principally comprising behenyl behenate (Tabs (maximum heat-absorption peak temperature on temperature increase on DSC curve)=72° C., Tevo (maximum heat-evolution peak temperature on temperature decrease on DSC curve)=70° C.) was added thereto and mixed therein. Further, 3 wt. parts of 2,2'-azobis(2,4-dimethylvaleronitrile) ($T_{1/2}$=140 min. at 60° C., polymerization initiator) was further dissolved therein, to obtain a polymerizable monomer composition.

The polymerizable monomer composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition. Then, the system was further stirred by a paddle stirrer and subjected to 6 hours of reaction at 60° C., followed by further 4 hours of stirring at an elevated temperature of 80° C. After the polymerization, the system was subjected to 2 hours of distillation at 80° C. Thereafter, the suspension liquid was cooled, and hydrochloric acid was added thereto to dissolve the calcium phosphate, followed by recovery of polymerizate particles by filtration and washing with water to recover wet magnetic colored particles.

The colored particles were then dried at 40° C. for 12 hours to recover magnetic colored particles (magnetic toner particles) having a weight-average particle size (D4) of 7.0 $\mu$m.

100 wt. parts of the magnetic toner particles were then blended with 1.2 wt. parts of hydrophobic silica fine powder having a BET specific area ($S_{BET}$) of 200 $m^2/g$ obtained by surface-treating silica fine powder having an average primary particle size (Dp1) of 8 nm first with hexamethyldisilazane and then with silicone oil by means of a HENSCHEL MIXER (made by Mitsui Miike Kakoki K.K.) to obtain Toner 1 (black magnetic toner).

Some representative properties and characterizing features of Toner 1 thus produced are shown in Table 1 appearing hereinafter together with those of Toners 2 to 24 prepared in the following Production Examples.

Toner Production Examples 2–4

Toners 2–4 were prepared in the same manner as in Production Example 1 except that the drying time was changed to 10 hours, 8 hours and 6 hours, respectively. Among these, Toner 4 is a comparative toner.

Toner Production Example 5

Toner 5 (non-magnetic black toner) was prepared in the same manner as in Production Example 1 except for replacing 100 wt. parts of Surface-treated magnetic powder with 7.5 wt. parts of carbon black ($S_{BET}$=60 $m^2/g$).

Toner Production Examples 6–8

Toners 6–8 were prepared in the same manner as in Production Example 5 except that the drying time was changed to 10 hours, 8 hours and 6 hours, respectively. Among these, Toner 8 is a comparative toner.

Toner Production Example 9

Toner 9 (non-magnetic yellow toner) was prepared in the same manner as in Production Example 1 except for replacing 100 wt. parts of the magnetic powder with 10 wt. parts of C.I. Pigment Yellow 174, and replacing the monoazo dye Fe compound with dialkylsalicylic acid metal compound.

Toner Production Examples 10–12

Toners 10–12 were prepared in the same manner as in Production Example 9 except that the drying time was changed 10 to hours, 8 hours and 6 hours, respectively. Among these, Toner 12 is a comparative toner.

Toner Production Example 13

Toner 13 (non-magnetic magenta toner) was prepared in the same manner as in Production Example 1 except for replacing 100 wt. parts of the magnetic powder with 10 wt. parts of C.I. Pigment Red 122, and replacing the monoazo dye Fe compound with dialkylsalicylic acid metal compound.

Toner Production Examples 14–16

Toners 14–16 were prepared in the same manner as in Production Example 13 except that the drying time was changed to 10 hours, 8 hours and 6 hours, respectively. Among these, Toner 16 is a comparative toner.

Toner Production Example 17

Toner 17 (non-magnetic cyan toner) was prepared in the same manner as in Production Example 1 except for replacing 100 wt. parts of the magnetic powder with 10 wt. parts of C.I. Pigment Blue 15:3, and replacing the monoazo dye Fe compound with dialkylsalicylic acid metal compound.

Toner Production Examples 18–20

Toners 18–20 were prepared in the same manner as in Production Example 17 except that the drying time was changed to 10 hours, 8 hours and 6 hours, respectively. Among these, Toner 20 is a comparative toner.

Toner Production Example 21

| | |
|---|---|
| Styrene/n-butyl acrylate copolymer (78/22 by weight, Mn = 24300, Mw/Mn = 3.0) | 80 wt. part(s) |

-continued

| | |
|---|---|
| Unsaturated polyester resin (Mn = 18000, Mw/Mn = 2.2) | 0.5 wt. part(s) |
| Saturated polyester resin (Mn = 17000, Mw/Mn = 2.4) | 4.5 wt. part(s) |
| Monoazo dye Fe compound (Negative charge control agent) | 1 wt. part(s) |
| Surface-treated magnetic powder | 100 wt. part(s) |
| Ester wax used in Production Example 1 | 5 wt. part(s) |

The above materials were blended in a blender and melt-kneaded by a twin-screw extruder heated at 110° C. After being cooled, the kneaded product was coarsely crushed by a hammer mill and finely pulverized by an impingement-type jet mill (made by Nippon Pneumatic Kogyo K.K), followed by pneumatic classification to recover toner particles having a weight-average particle size (D4) of 7.2 $\mu$m. The toner particles were then subjected to a sphering treatment by means of a batch-wise impact-type surface treatment apparatus (Temp.=45° C., Rotatory treating blade peripheral speed=80 m/sec, Treatment time=3 min.).

Then, 100 wt. parts of the sphered toner particles were blended with 1.0 wt. part of hydrophobic silica fine powder used in Production Example 1 by means of a HENSCHEL MIXER to obtain Toner 21.

Toner Production Example 22

Toner 22 was prepared in the same manner as in Production Example 22 except for replacing 1.0 wt. part of the hydrophobic silica with 0.8 wt. part of untreated silica ($S_{BET}$=300 $m^2/g$).

Toner Production Example 23

Toner 23 was prepared in the same manner as in Production Example 21 except for omitting the sphering treatment.

Toner Production Example 24

Toner 24 was prepared in the same manner as in Production Example 21 except for omitting the sphering treatment by the impingement type surface treating apparatus after pulverization under different conditions from those dopted in Production Example 23.

Some representative properties and characterizing features of Toners 1–24 prepared in the above Production Examples are inclusively shown in Table 1 below.

As shown in Table 1 below, the above-prepared toners all exhibited G' (110° C.)$\leqq 1.00\times10^6$ dN/$m^2$ and G' (140° C.)$\geqq 7.00\times10^3$ dN/$m^2$.

TABLE 1

| Toner | | D4 | | | Moistures | Storage modulus G'(110° C.) × | Storage modulus G'(140° C.) × | | | | |
|---|---|---|---|---|---|---|---|---|---|---|---|
| Class. *1 | No. | ($\mu$m) | Cav | Cmode | (%) | $10^5$ (dN/$m^2$) | $10^4$ (dN/$m^2$) | Process *2 | Colorant | Silica | Drying (hours) |
| M-Bk | 1 | 7.0 | 0.980 | 1.000 | 0.94 | 2.11 | 5.11 | Pmzn. | Mag | Hydrophobic | 12 |
| | 2 | 7.0 | 0.980 | ↑ | 1.90 | 2.12 | 5.13 | ↑ | ↑ | ↑ | 10 |
| | 3 | 7.0 | 0.980 | ↑ | 2.92 | 2.09 | 5.08 | ↑ | ↑ | ↑ | 8 |
| | 4 | 7.0 | 0.980 | ↑ | 3.47 | 2.15 | 5.15 | ↑ | ↑ | ↑ | 6 |
| NM-Bk | 5 | 7.5 | 0.982 | ↑ | 0.95 | 1.70 | 3.15 | ↑ | C.B. | ↑ | 12 |
| | 6 | 7.5 | 0.982 | ↑ | 1.89 | 1.68 | 3.11 | ↑ | ↑ | ↑ | 10 |
| | 7 | 7.5 | 0.982 | ↑ | 2.90 | 1.71 | 3.17 | ↑ | ↑ | ↑ | 8 |
| | 8 | 7.5 | 0.982 | ↑ | 3.54 | 1.75 | 3.20 | ↑ | ↑ | ↑ | 6 |
| NM-Ye | 9 | 6.8 | 0.976 | ↑ | 0.93 | 2.14 | 2.10 | ↑ | Y174 | ↑ | 12 |
| | 10 | 6.8 | 0.976 | ↑ | 1.92 | 2.11 | 2.08 | ↑ | ↑ | ↑ | 10 |
| | 11 | 6.8 | 0.976 | ↑ | 2.92 | 2.12 | 2.09 | ↑ | ↑ | ↑ | 8 |
| | 12 | 6.8 | 0.976 | ↑ | 3.50 | 2.15 | 2.09 | ↑ | ↑ | ↑ | 6 |

TABLE 1-continued

| Toner | | D4 | | | Moistures | Storage modulus G'(110° C.) × | Storage modulus G'(140° C.) × | | | | |
|---|---|---|---|---|---|---|---|---|---|---|---|
| Class. *1 | No. | (μm) | Cav | Cmode | (%) | $10^5$ (dN/m$^2$) | $10^4$ (dN/m$^2$) | Process *2 | Colorant | Silica | Drying (hours) |
| NM-Ma | 13 | 7.1 | 0.979 | ↑ | 0.90 | 1.71 | 4.74 | ↑ | R122 | ↑ | 12 |
| | 14 | 7.1 | 0.979 | ↑ | 1.90 | 1.70 | 4.71 | ↑ | ↑ | ↑ | 10 |
| | 15 | 7.1 | 0.979 | ↑ | 2.93 | 1.68 | 4.65 | ↑ | ↑ | ↑ | 8 |
| | 16 | 7.1 | 0.979 | ↑ | 3.53 | 1.72 | 4.72 | ↑ | ↑ | ↑ | 6 |
| NM-Cy | 17 | 7.3 | 0.978 | ↑ | 0.91 | 3.13 | 3.44 | ↑ | B15:3 | ↑ | 12 |
| | 18 | 7.3 | 0.978 | ↑ | 1.92 | 3.09 | 3.39 | ↑ | ↑ | ↑ | 10 |
| | 19 | 7.3 | 0.978 | ↑ | 2.89 | 3.16 | 3.48 | ↑ | ↑ | ↑ | 8 |
| | 20 | 7.3 | 0.978 | ↑ | 3.50 | 3.10 | 3.41 | ↑ | ↑ | ↑ | 6 |
| M-Bk | 21 | 7.2 | 0.951 | 0.950 | 0.10 | 4.10 | 6.01 | PVE-sphere | Mag | ↑ | — |
| | 22 | 7.2 | 0.951 | 0.950 | 0.10 | 4.09 | 6.00 | ↑ | ↑ | Untreated | — |
| | 23 | 7.2 | 0.941 | 0.945 | 0.14 | 4.09 | 6.02 | PVZ | ↑ | Hydrophobic | — |
| | 24 | 7.2 | 0.932 | 0.934 | 0.14 | 4.11 | 6.03 | ↑ | ↑ | ↑ | — |

* "↑" means the same as above.
Other notes (*1, *2) to this table are given in the next page.
Notes of Table 1
*1: Toner classification is indicated by the following symbols.
M-Bk = magnetic black toner
NM-Bk = non-magnetic black toner
NM-Cy = non-magnetic cyan toner
NM-Ye = non-magnetic yellow toner
NM-Ma = non-magnetic magenta toner
*2: Toner production process is classified by the following abbreviations:
Pmzn. = polymerization.
$P_{VZ\text{-sphere}}$ = pulverization, followed by sphering.
$P_{VZ}$ = pulverization, not followed by sphering.

EXAMPLES 1–3 AND COMPARATIVE EXAMPLE 1

(1) Color image forming apparatus

For these examples, a commercially available full-color printer ("LBP-2160", made by Canon K.K.) was remodeled so as to replace the fixing apparatus with an electromagnetic induction heating-type fixing apparatus 100 and equip the intermediate transfer drum 105 with a cleaner box 108, for example, to form the image forming apparatus as illustrated in FIG. 1 (explained hereinabove).

More specifically, referring to FIG. 1, a photosensitive drum 101 had an organic semiconductive photosensitive layer on a substrate, and while being rotated in an indicated arrow direction, was uniformly charged to a surface potential of ca. −650 volts, by a charging roller 102 (comprising a core metal and an electroconductive elastic layer) which was rotated mating with the photosensitive drum 101 while being supplied with a bias voltage. The photosensitive drum 101 was then exposed to ON/OFF-laser light 103 carrying digital image data to form an electrostatic latent image thereon having a light-part potential of −100 volts and a dark-part potential of −650 volts. The latent image formation was repeated four times each on one rotation of the photosensitive drum 101, and the respective latent images on the photosensitive drum 101 were sequentially developed with negatively chargeable yellow toner, magenta toner, cyan toner and black toner from developing devices 104Y, 104M, 104C and 104Bk, respectively, by reversal development scheme to form respective color toner images on the photosensitive drum 101. The respective color toner images were successively transferred onto an intermediate transfer member 105 to form a four-color superposed toner image. Transfer residual toner remaining on the photosensitive drum 101 after each transfer of the color toner image was recovered by a cleaner 107.

The intermediate transfer member 105 comprised a pipe-shaped core metal and an elastic conductive coating layer formed on the core metal and comprising nitrile-butadiene rubber (NBR) with carbon black (as electroconductivity-imparting material) dispersed therein. The coating layer had a hardness of 30 deg. (JIS K-6301) and a volume resistivity of $10^9$ ohm.cm. The intermediate transfer member 105 was supplied with a bias voltage of +500 volts through the core metal so as to provide a transfer current of ca. 5 μA for transfer of the respective color toner images to the intermediate transfer member 105.

The four-color superposed toner image on the intermediate transfer member 105 was then transferred onto a recording material P supplied to a secondary transfer nip $T_2$ on a transfer roller 106 under the action of a transfer current of 15 μA caused by a bias voltage applied to the transfer roller 106. The transfer roller 106 comprised a 10 mm-dia. core metal and an elastic coating layer formed thereon and comprising ethylene-propylenediene terpolymer (EPDM) foam with electroconductive carbon dispersed therein. The elastic coating layer exhibited a volume resistivity of $10^6$ ohm.cm and a hardness of 35 deg. (JIS K-6301).

The recording material P carrying the transferred toner image was then conveyed to a heat fixing apparatus (heating means) 100 where the toner image was fixed under heating to form a fixed image. The fixing apparatus 100 used in this example was an electromagnetic induction heating-type apparatus of which an essential part is show in a transverse cross-sectional view of FIG. 2, a front schematic illustration of FIG. 3 and a front sectional view of FIG. 4. An oil application mechanism was omitted from the heat fixing apparatus 100.

The magnetic field generating means comprised magnetic cores 17*a*, 17*b* and 17*c*, and an excitation coil 18.

The magnetic cores 17*a*–17*c* comprised ferrite. The excitation coil 18 was formed by forming a plurality of fine copper wires each electrically insulated into a bundle, and winding the bundle in 10 turns. The excitation coil was supplied with an excitation voltage at a frequency of 100 kHz.

The fixing apparatus 100 included a fixing belt 10 having a sectional structure as shown in FIG. 8, including a heat generating layer 1 of an electromagnetically induction heating metal layer, an elastic layer 2 on an outside thereof and a release layer 3 on a further outside. The fixing belt 10 was a generally cylindrical in shape, included the heat-generating layer 1 on an inner side and the release layer 3 on an outer side, and had a diameter of 50 mm.

The heat-generating layer 1 was a 10 μm-thick nickel layer. The elastic layer 2 was a 100 μm-thick silicone rubber layer exhibiting a hardness of 5 deg. (JIS K-6301). The release layer 3 was a 20 μm-thick fluorine-containing resin.

The fixing apparatus 100 further included a pressure roller 30 comprising a core metal 30*a* and a heat-resistant fluorine-containing rubber layer 30*b* formed concentrically and integrally with the core metal 30*a* so as to provide a roller outer diameter of 35 mm. The pressure roller 30 was pressed against the fixing belt 10 by disposing pressing springs 25*a* and 25*b* between the supporting sheets 29*a*, 29*b* and both end portions of a rigid stay 22 for pressurization. As a result, the lower surface of the belt guide 16*a* and the upper surface of the pressure roller 30 formed a fixing nip N of 9.5 mm via the fixing belt sandwiched therebetween so as to apply a linear pressure of 882 N/m (0.9 kg.f/cm) in a state where paper of 80 g/m$^2$ was inserted therein.

The local temperature parameters Z1, Z2 and Z3 of the fixing apparatus were measured as follows: Z1=182° C., Z2=165° C. and Z3=140° C.

Under the above conditions and in a normal temperature/normal humidity (23° C./60% RH) environment, continuous full-color image formation tests were performed by using Toners 5, 9, 13 and 17 in Example 1; Toners 6, 10, 14 and 18 in Example 2; Toners 7, 11, 15 and 19 in Example 3; and Toners 8, 12, 16 and 20 in Comparative Example 1, contained in the respective developing devices. Each image forming test was performed in a full-color continuous mode (i.e., a mode of promoting toner consumption without providing a substantial pause period of the developing device) at a fixing speed of 94 mm/sec to form lateral line images of respective colors each in a printing areal ratio of 4% on 3000 sheets.

As an evaluation, the printed image sheets were checked as to whether back side soiling due to offset toner was observed or not.

Further, in order to check gloss irregularity, solid images of respective colors were printed on an every 500th sheet, and gloss irregularity was checked with respect to images on each sheet. Further, the image density and fog of the printed images, and the influences of toner sticking onto and abrasion of the fixing belt 10 on the soiling and deterioration of the resultant images, were evaluated.

As a result, in Example 1, during and after the continuous printing test, sufficient image densities were obtained and fog-free clear images were formed for respective colors. Further, gloss irregularity or back-side sheet soiling was not observed.

In Example 2, some increase of fog was observed. Further, slight gloss irregularity and back-side sheet soiling were observed but at a level of practically no problem at all.

In Example 3, some image density lowering and increased fog were observed but at level of practically no problem. Further, some gloss irregularity and back-side sheet soiling were observed but they were also at a level of practically no problem. Further, at the time of solid image printing on a 3000th sheet, a phenomenon of presumably a light degree of "slip" was observed, but it was at a level of practically no problem.

In Comparative Example 1, a large degree of image density lowering and severe fog were observed. Further, "slip" occurred in the fixing step, and also fixation sheet jamming and hot offset occurred. Further, the resultant images were accompanied with severe back-side sheet soiling and gloss irregularity.

The results of evaluation are inclusively shown in Table 2 together with those of the following examples.

EXAMPLE 4

The print-out test of Example 1 was repeated while changing the pressure springs (25*a* and 25*b* in FIGS. 3 and 4) so as to apply a linear pressure of 1568 N/m (1.6 kg-f/cm) in a state of 80 g/m$^2$ paper being inserted and form a fixing nip N of 11.0 mm.

During and after the continuous printing test, clear fog-free images were obtained at sufficient image density for respective colors, while slight back-side sheet soiling was observed at a leave of no problem. This may be attributable to hot offset caused by deterioration of the fixing belt judging from the fact that slight toner melt-sticking was observed at a slightly damage part of the fixing belt after the continuous printing test.

EXAMPLE 5

The print-out test of Example 1 was repeated while changing the pressure springs (25*a* and 25*b* in FIGS. 3 and 4) so as to apply a linear pressure of 294 N/m (0.3 kg-f/cm) in a state of 80 g/m$^2$ paper being inserted and form a fixing nip N of 7 mm.

During and after the continuous printing test, clear fog-free images were obtained at sufficient image density for respective colors, while slight gloss irregularity and back-side sheet soiling were observed at a level of practically no problem. These defects were slightly observed only at the initial stage and might be attributable to a partial peeling of images due to insufficient fixation.

The items of evaluation performed in the above Examples and Comparative Example and evaluation standards are supplemented hereinbelow.

[Print-out image evaluation]

<1> Image density (I.D.)

After printing on 3000 sheets of A4-size plain paper (for CLC (color laser copier)) (80 g/m$^2$, made by Canon K.K.), image densities were measured at 5 points of a solid image by using a Macbeth reflection densitometer (made by Macbeth Co.), and an average of the 5 point image densities was recorded. (Incidentally, all the toner images formed at the initial stage of the continuous printing test exhibited an image density of 1.40 or higher.) Based on the measured 5 point-average image density after 3000 sheet, the evaluation was performed according to the following standard.

A: ≧1.40
B: ≧1.35 and <1.40
C: ≧1.00 and <1.35
D: <1.00

<2> Image fog (Fog)

After continuous printing on 3000 A4-size sheets, a white image (basically, toner free image) was formed by using each color toner, and the whiteness of the paper after printing and that of the blank paper were measured by using a reflect meter "Model TC-6DS", made by Tokyo Denshoku K.K.).

For the whiteness measurement, an Amberlite filter was used for a cyan toner, a blue filter was used for a yellow toner, and a green filter was used for other toners. Based on the measured whiteness values, fog values were calculated according to the following formula. A smaller value represents less fog.

Fog (%)=(Whiteness of blank paper)−(Whiteness of white background portion (non-image portion) of the paper after printing)

For the respective color toners, the evaluation was performed based on the measured fog value according to the following standard.

A: <1.5% (very good)

B: ≧1.5% and <2.5% (good)

C: ≧2.5% and <4.0% (fair)

D: ≧4.0% (poor)

<3> Gloss irregularity (Gloss)

The degree of gloss irregularity was evaluated with respect to solid images of respective colors on the A4-size paper (80 g/m$^2$) and evaluated according to the following standard.

A: Not observed at all.

B: Substantially not observed.

C: Slightly observed but at a level of practically no problem.

D: Substantial gloss irregularity observed.

<4> Back-side sheet soiling (Back soil)

After the continuous printing on 3000 A4-size sheets, the back-side of the image sheet was observed with respect to the soiling and evaluated according to the following standard.

A: Not observed at all.

B: Substantially not observed.

C: Slightly observed but at a level of practically no problem.

D: Substantial soiling observed.

negatively chargeable monocomponent magnetic toner according to the reversal development scheme by the developing device 240 to form a toner image on the photosensitive drum 200, which was then transferred onto a recording material P which was conveyed to a transfer position and pressed against the photosensitive drum 200 by the transfer roller 214. The recording material P carrying the toner image transferred thereto was conveyed by a conveyer belt 225 to a fixing apparatus 100, where the toner image was fixed onto the recording material P under heating. A portion of the toner remaining on the photosensitive drum was cleaned by the cleaning means 216.

In the developing region, an AC/DC-superposed developing bias voltage was applied between the photosensitive drum 200 and a developing sleeve 202 so as to cause the jumping of the toner on the developing sleeve 202 onto the electrostatic latent image on the photosensitive drum 200.

Figure 12:
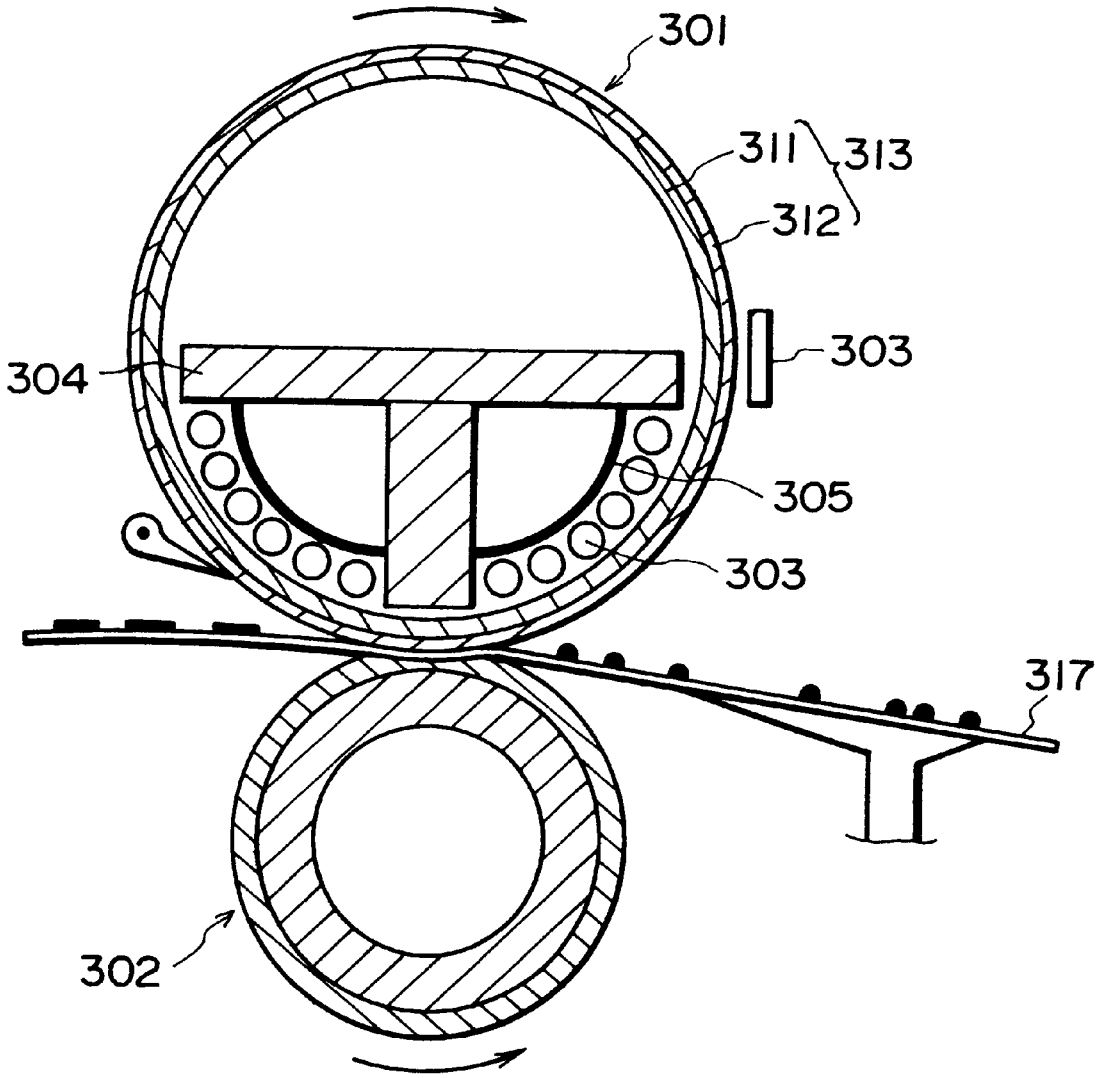
FIG. 12 is a schematic transverse section of a heating apparatus (fixing apparatus) related to the invention.

The fixing apparatus 100 used in this example was a pressure roller drive-type electromagnetic induction heating fixing apparatus illustrated in FIG. 12.

In this example, the rotary heating member 301 included a fixing belt 313 composed of an iron-made core cylinder 311 of 40 mm in outer diameter and 0.7 mm in thickness and a 25 $\mu$m-thick surface-coating PTFE layer 312, and a magnetic field generating means composed of a magnetic core 304, an excitation coil 303 and a coil-supporting member 305.

The magnetic core 304 comprised a ferrite. The excitation coil 303 was formed by forming a plurality of fine copper wires each electrically insulated into a bundle, and winding the bundle in 10 turns. The excitation coil was supplied with an excitation voltage at a frequency of 100 kHz.

TABLE 2

| | Nos. of toners used | | | | Evaluation results | | | | | | | | | | | | |
|---|---|---|---|---|---|---|---|---|---|---|---|---|---|---|---|---|---|
| | | | | | Bk (black) | | | Ye (yellow) | | | Ma (magenta) | | | Cy (cyan) | | | |
| Example | Bk | Ye | Ma | Cy | I.D. | Fog | Gloss | I.D. | Fog | Gloss | I.D. | Fog | Gloss | I.D. | Fog | Gloss | Back soil |
| Ex. 1 | 5 | 9 | 13 | 17 | A | A | A | A | A | A | A | A | A | A | A | A | A |
| Ex. 2 | 6 | 10 | 14 | 18 | A | B | B | A | B | B | A | B | B | A | B | B | B |
| Ex. 3 | 7 | 11 | 15 | 19 | B | C | B | B | C | B | B | C | B | B | C | B | C |
| Comp. 1 | 8 | 12 | 16 | 20 | C | D | D | C | D | D | C | D | D | C | D | D | D |
| Ex. 4 | 5 | 9 | 13 | 17 | A | A | A | A | A | A | A | A | A | A | A | A | C |
| Ex. 5 | 5 | 9 | 13 | 17 | A | A | B | A | A | B | A | A | B | A | A | B | C |

EXAMPLES 6–12 AND COMPARATIVE EXAMPLE 2

For these examples, an image forming apparatus as illustrated in FIG. 11 (described hereinbefore) was prepared by remodeling a commercially available laser beam printer (made by Canon) using an electrophotographic process including a mono-component developing scheme so as to replace the fixing apparatus with an electromagnetic induction heating-type fixing apparatus 100.

Referring to FIG. 11, the image forming apparatus includes a photosensitive drum 200, around which were disposed a primary charging roller 217 supplied with a bias voltage, a developing device 240, a transfer charging roller 214 supplied with a bias voltage, a cleaner 216, and a register roller 224. The photosensitive drum was charged to −700 volts by the primary charging roller 217 supplied with an AC voltage of −2.0 kVpp and a DC voltage of −700 Vdc, and then irradiated with laser light 223 to form an electrostatic latent image thereon. The electrostatic latent image on the photosensitive drum 200 was then developed by a The rotary heating member 301 was pressed against a pressure roller 302 of 35 mm in outer diameter so as to be rotated following the rotation of the pressure roller 302 under the action of a frictional force occurring at the abutted position (nip). The pressing force was exerted by springs 325*a* and 325*b* onto the heating member 301 directed to the rotation shaft of the pressure roller 302.

As a result, the lower surface of the magnetic core 304 and the upper surface of the pressure roller 302 formed a fixing nip N of 9.5 mm via the fixing belt 313 sandwiched therebetween so as to apply a linear pressure of 882 N/m (0.9 kg.f/cm) in a state where paper of 75 g/m$^2$ was inserted therein. The local temperature parameters Z1, Z2 and Z3 of the fixing apparatus measured were as follows: Z1=175° C., Z2=162° C. and Z3=159° C.

Under the above conditions and in a normal temperature/normal humidity (23° C./60% RH) environment, continuous monochromatic image formation tests were performed by using Toners 1–4 and 21–24, respectively, all of negatively chargeable magnetic black toners. Each image forming test was performed in a monochromatic continuous mode (i.e., a mode of promoting toner consumption without providing a substantial pause period of the image forming apparatus) at a fixing speed of 190 mm/sec to form lateral line images in a printing areal ratio of 4% on 5000 sheets.

As an evaluation, the printed image sheets were checked as to whether back side soiling due to offset toner was observed or not.

Further, the image density and fog of the printed images, and the influences of toner sticking onto and abrasion of the fixing belt on the soiling and deterioration of the resultant images, were evaluated.

As a result, in Example 6, even after the continuous printing test, a sufficient image density was obtained without causing any back-side (paper) sheet soiling.

In Example 7, some increase in fog was recognized and some back-side sheet soiling occurred, but they were at a level of no problem at all.

In Example 8, image density lowering and fog increase were observed, but they were at a level of practically no problem.

In Example 9, somewhat lower image density resulted than in Example 6. Further, some back-side sheet soiling occurred, but at a level of no problem at all.

In Example 10, the image density was somewhat lowered and fog increased than in Example 6. Further, some back-side sheet soiling was observed, but it was at a level of no problem.

In Example 11, the image density and fog were at a level of no problem. Some degree of back-side sheet soiling occurred presumably due to deterioration of the fixing belt, but it was at a level of practically no problem.

In Example 12, fog became worse than in Example 11, but it was at a level of practically no problem.

In Comparative Example 2, a large degree of image density lowering and severe fog were observed. Further, "slip" occurred in the fixing step, and also fixation sheet jamming and hot offset occurred. Further, the resultant images were accompanied with severe back-side sheet soiling and gloss irregularity.

The results of evaluation are inclusively shown in Table 3. The evaluation items and evaluation standards are the same as for Table 2.

TABLE 3

| Example | Toner used | I.D. | Fog | Back soil |
|---|---|---|---|---|
| Ex. 6 | 1 | A | A | A |
| Ex. 7 | 2 | A | B | B |
| Ex. 8 | 3 | B | C | C |
| Ex. 9 | 21 | B | A | B |
| Ex. 10 | 22 | B | B | C |
| Ex. 11 | 23 | B | A | C |
| Ex. 12 | 24 | B | C | C |
| Comp. 2 | 4 | C | D | D |

EXAMPLES 13–24 AND COMPARATIVE EXAMPLES 3–6

By using an image forming apparatus identical to the one used in Examples 1–5 in a low temperature/low humidity (15° C./10% RH) environment, each of Toners 5–20 (of which Toners 8, 12, 16 and 28 were comparative) was subjected to a monochromatic image print-out test for reproduction of a monochromatic image at an image density adjusted at 1.5 on 15 sheets continually supplied at a print-out speed of 12 A4-size sheets/min in a quick-start mode (i.e., the image formation test was started from a state where the fixing apparatus was left standing to be sufficiently cooled to room temperature, and the actual image formation was started at a point of 20 sec. (warm-up time of 20 sec.) after turning on the image forming apparatus). The print-out images were evaluated with respect to the following item.

[Print-out image evaluation]

<5> Fixability (rubbing test)

A large number of solid square images of 10 mm×10 mm were printed on A4-size CLC paper (105 g/m$^2$, made by Canon K.K.) at an adjusted toner coverage rate of 1.0 mg/cm$^2$. The resultant fixed images were rubbed with a lens-cleaning paper for 5 reciprocations under a load of 50 g/cm$^2$, and an image density lowering (%) was measured. Based on the measured image density lowering data, the evaluation was performed according to the following standard.

A: <2%

B: ≧2% and <5%

C: ≧5% and d <10%

D: ≧10%

The evaluation was performed on a first sheet and a 15th sheet for each toner. The results are inclusively shown in the following Table 4.

TABLE 4

| Example | Toner No. | Fixability (rubbing test) 1st/15th |
|---|---|---|
| Ex. 13 | 5 | A/A |
| Ex. 14 | 6 | B/A |
| Ex. 15 | 7 | C/B |
| Ex. 16 | 9 | A/A |
| Ex. 17 | 10 | B/A |
| Ex. 18 | 11 | C/B |
| Ex. 19 | 13 | A/A |
| Ex. 20 | 14 | B/A |
| Ex. 21 | 15 | C/B |
| Ex. 22 | 17 | A/A |
| Ex. 23 | 18 | B/A |
| Ex. 24 | 19 | C/B |
| Comp. Ex. 3 | 8 | C/C |
| Comp. Ex. 4 | 12 | C/C |
| Comp. Ex. 5 | 16 | C/C |
| Comp. Ex. 6 | 20 | C/C |

The toners used in Examples 13–24 provided good results in the anti-rubbing fixability test. This may be attributable to factors, such as (1) the fixing apparatus could instantaneously generate and impart a sufficient fixing energy to the toner in response to the quick-start operation, (2) the supply of fixing heat was stably effected (without shortage or excess) in the continuous test, and (3) the moisture content in the toner was reduced to a prescribed low level. According to Examples 13–24, it was confirmed possible to provide a toner and an image forming method without requiring preheating of a fixing apparatus during a waiting time of the image forming apparatus, i.e., showing excellent quick-start characteristic and power economization characteristic.

On the other hand, Comparative Examples 3–6 exhibited somewhat lower level of fixability and caused some "smoke".

COMPARATIVE EXAMPLE 7

Figure 9:
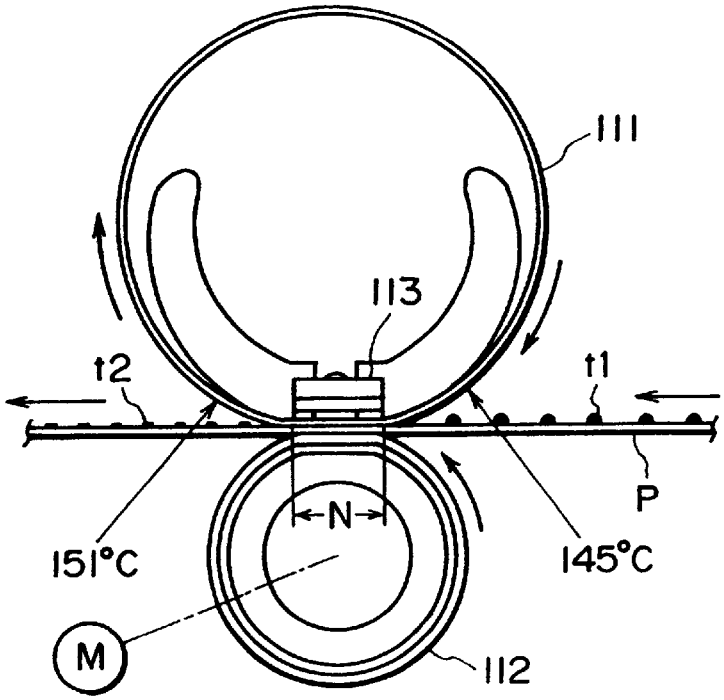
FIG. 9 PRIOR ART
FIG. 9 illustrates a sectional organization of a film-heating-type fixing apparatus used in a comparative example.

The fixing apparatus in the image forming apparatus of Example 13 was replaced by a so-called surf-fixing apparatus, i.e., a fixing apparatus using a fixing belt for supplying a heat for fixation from a resistance heating member, in the apparatus of FIG. 9, heat generated from a heating means 113 disposed opposite a toner image $t_1$ was imparted to the toner image via a film member 111 inserted therebetween while forming a nip width of 7 mm and a linear pressure of 392 N/m (0.4 kg-f/cm). The fixing was performed at a speed of 72 mm/sec, a fixing nip proximity temperature of 190° C. and a warm-up time of 20 sec. The pressure roller 112 comprised a core metal coated successively with an elastic layer, a fluorine-containing rubber layer and a fluorine-containing resin layer. Except for using the surf fixing apparatus, a quick-start mode printing test (i.e., image formation from a sufficiently cooled room temperature state) was performed similarly as in Example 13 by using Toner 9 (yellow) in a low temperature/low humidity (15° C./10% RH) environment. The temperatures before and after the nip were 145° C. and 151° C. as indicated in FIG. 9. The stability of the fixed image was similarly evaluated by rubbing.

As a result, the image density lowering due to the rubbing amounted to 15.3% (at a level D) on the first sheet of printing, thus exhibiting an inferior fixability in the continuous image output.

EXAMPLES 25–31 AND COMPARATIVE EXAMPLE 8

By using an image forming apparatus identical to the one used in Examples 6–12 in a low temperature/low humidity (15° C./10% RH) environment, each of Toners 1–4 and 21–24 (of which Toner 4 was comparative) was subjected to a monochromatic image print-out test for reproduction of a monochromatic image at an image density adjusted at 1.5 on 15 sheets continually supplied at a print-out speed of 12 A4-size sheets/min in a quick-start mode (i.e., the image formation was started from a state where the fixing apparatus was left standing sufficiently to room temperature). The print-out images were evaluated similarly as in Examples 13–24. The results are inclusively shown in Table 5 below.

TABLE 5

| Example | Toner No. | Fixability (rubbing test) 1st/15th |
|---|---|---|
| Ex. 25 | 1 | A/A |
| Ex. 26 | 2 | B/A |
| Ex. 27 | 3 | C/B |
| Ex. 28 | 21 | B/A |
| Ex. 29 | 22 | B/A |
| Ex. 30 | 23 | C/B |
| Ex. 31 | 24 | C/B |
| Comp. Ex. 8 | 4 | C/D |

COMPARATIVE EXAMPLE 9

Figure 16:
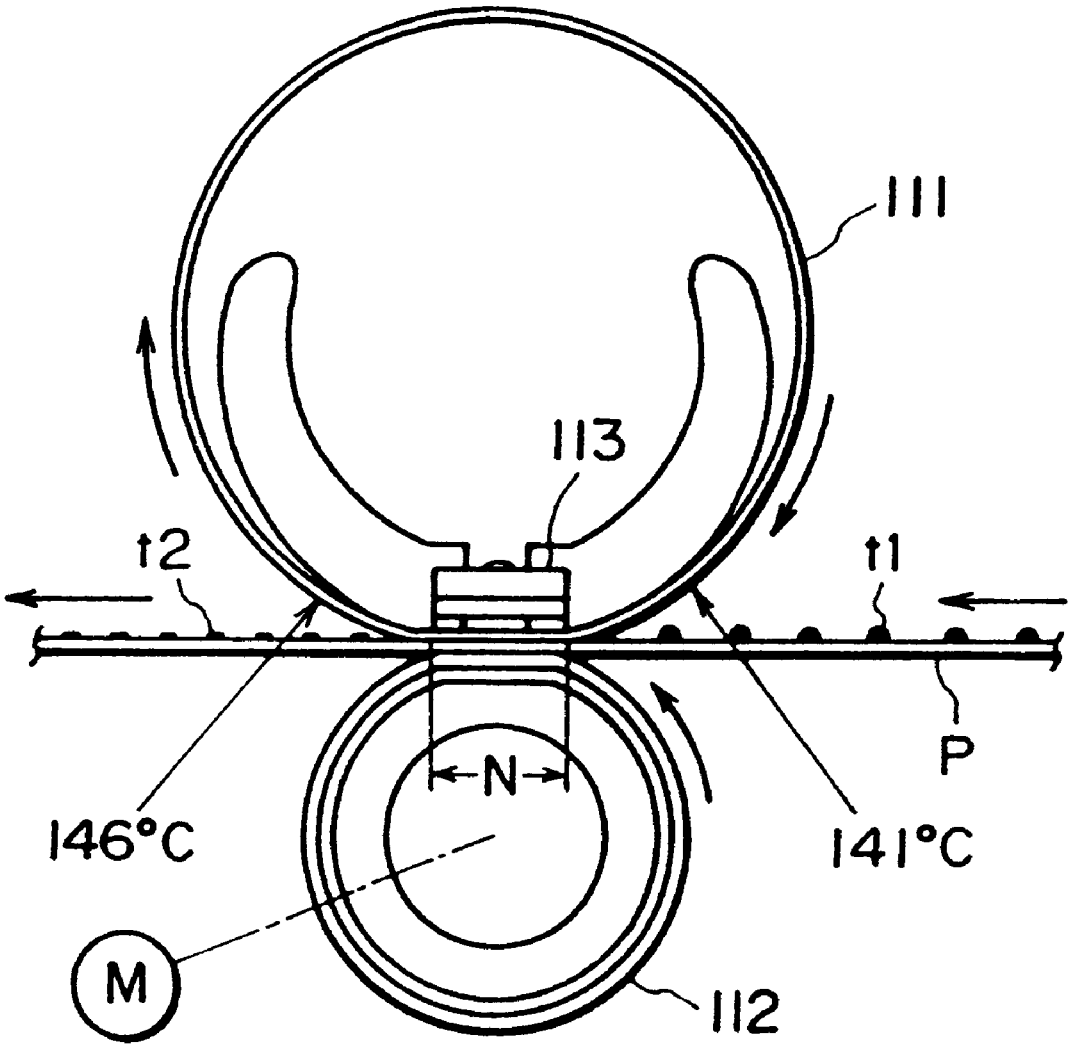
FIG. 16 PRIOR ART
FIG. 16 illustrates a sectional organization of a film-heating-type fixing apparatus used in another comparative example.

The quick-start mode printing test of Example 25 was repeated except for replacing the fixing apparatus used therein with a surface-fixing apparatus illustrated in FIG. 16 (identical to the one used in Comparative Example 7) and modifying the fixing conditions similarly as in Comparative Example 7. At that time, the film temperatures were 141° C. and 151° C. as indicated in FIG. 16.

As a result, the image density lowering due to the rubbing amount to 16.2% (at a level D), thus exhibiting an inferior fixability in the continuous image output.

Binder Resin Production Example 1

Into a glass-made separable flask equipped with a temperature, a stainless stirring bar, a flowdown-type condenser and a nitrogen intake pipe, 200 wt. parts of xylene was placed and heated to a reflux temperature. Into the system, a mixture liquid of 80 wt. parts of styrene, 20 wt. parts of n-butyl acrylate and 2.3 wt. parts of di-tert-butyl peroxide was added dropwise, followed by 7 hours of xylene refluxing to complete the solution polymerization, thereby obtaining a low-molecular weight resin solution.

On the other hand, 65 wt. parts of styrene, 25 wt. parts of butyl acrylate, 10 wt. parts of monobutyl maleate, 0.2 wt. part of polyvinyl alcohol, 200 wt. parts of degassed water and 0.5 wt. part of benzoyl peroxide were subjected to mixing and dispersion. The resultant suspension dispersion liquid was heated and held at 85° C. for 24 hours in a nitrogen atmosphere to complete the polymerization, thereby recovering a high-molecular weight resin.

30 wt. pats of the high-molecular weight resin was added to the above-prepared solution containing 70 wt. parts of low-molecular weight resin just after the completion of the solution polymerization and completely dissolved therein, followed by distilling-off of the solvent to recover Binder resin (I).

As a result of analysis, Binder resin (I) exhibited a lower-molecular weight side peak molecular weight (Mp1) of $1\times10^4$, a higher-molecular weight side peak molecular weight (Mp2) of $55\times10^4$, a weight-average molecular weight (Mw) of $30\times10^4$, a number-average molecular weight (Mn) of $5.5\times10^4$ and a glass transition temperature (Tg) of 55° C.

Toner Production Example 25

| | |
|---|---|
| Binder resin (I) | 100 wt. part(s) |
| Saturated ester resin (Mp = 8000) | 25 wt. part(s) |
| Carbon black ($S_{BET}$ = 62 $m^2/g$) | 10 wt. part(s) |
| Monoazo-dye Fe compound (negative charge control agent) | 1 wt. part(s) |
| Low-molecular weight polyethylene (Tabs = 115° C., Tevo = 110° C.) | 3 wt. part(s) |

The above materials were blended in a blender and melt-kneaded by a twin-screw extruder heated at 160° C. After being cooled, the kneaded product was coarsely crushed by a hammer mill and finely pulverized by an impingement-type jet mill (made by Nippon Pneumatic Kogyo K.K), followed by pneumatic classification to recover toner particles. The toner particles were then subjected to a sphering treatment by means of a batch-wise impact-type surface treatment apparatus (Temp.=50° C., Rotatory treating blade peripheral speed=90 m/sec) to obtain sphered toner particles (D4=7.7 $\mu$m).

Then, 100 wt. parts of the sphered toner particles were blended with 1.0 wt. parts of hydrophobic silica fine powder having a BET specific area ($S_{BET}$) of 140 $m^2/g$ obtained by surface-treating silica fine powder having an average primary particle size (Dp1) of 12 nm first with hexamethyldisilazane and then with silicone oil by means of a HENSCHEL MIXER (made by Mitsui Miike Kakoki K.K.) to obtain Toner 25 (black magnetic toner).

Toner 25 exhibited an average circularity (Cav) of 0.954, a residual monomer content (Mres.) of 80 ppm, and a moisture content ($C_{H20}$) of 0.25 wt. %.

Some composition characteristics and physical properties of Toner 25 are shown in Tables 6 and 7, respectively, together with those of toners obtained in the following Examples.

Toner Production Examples 26–29

Toners 26–29 were prepared in the same manner as in Production Example 25 except for changing the species and amounts of charge control agent and colorants as shown in Table 6.

Toner Production Example 30

Starting materials (except for hydrophobic silica) shown in Table 6 were blended in a blender and melt-kneaded by a twin-screw extruder heated at 160° C. After being cooled, the kneaded product was coarsely crushed by a hammer mill and finely pulverized by an impingement-type jet mill (made by Nippon Pneumatic Kogyo K.K.). The resultant pulverizate was pneumatically classified to obtain indefinitely shaped toner particles (D4=7.8 μm). Then, 100 wt. parts of the toner particles were blended with 1.0 wt. part of hydrophobic silica fine powder identical to the one prepared in Production Example 25.

Toner Production Examples 31–34

Toners 31–34 were prepared in the same manner as in Production Example 30 except for changing the species and amounts of charge control agent and colorants as shown in Table 6.

Some properties of Toners 25–34 are inclusively shown in Table 7.

TABLE 6

Composition of Toners

| | Toner | | | | | | | | | |
|---|---|---|---|---|---|---|---|---|---|---|
| | 25 | 26 | 27 | 28 | 29 | 30 | 31 | 32 | 33 | 34 |
| Binder resin (I) | 100 | 100 | 100 | 100 | 100 | 100 | 100 | 100 | 100 | 100 |
| Saturated polyestre resin | 25 | 25 | 25 | 25 | 25 | 25 | 25 | 25 | 25 | 25 |
| Carbon black (BET 62 $m^2/g$) | 10 | — | — | — | — | 10 | — | — | — | — |
| Pigment Yellow 17 | — | 10 | — | — | — | — | 10 | — | — | — |
| Pigment Red 122 | — | — | 10 | — | — | — | — | 10 | — | — |
| Pigment Blue 15:3 | — | — | — | 10 | — | — | — | — | 10 | — |
| Surface treated magnetic powder | — | — | — | — | 115 | — | — | — | — | 115 |
| Monoazo dye Fe compound | 1 | — | — | — | 1 | 1 | — | — | — | 1 |
| Dialkylsalicylic acid metal compound | — | 1 | 1 | 1 | — | — | 1 | 1 | 1 | — |
| Low H.W. polyethylene | 3 | 3 | 3 | 3 | 3 | 3 | 3 | 3 | 3 | 3 |
| Hydrophobic silica (BET140 $m^2/g$) | 1.0 | 1.0 | 1.0 | 1.0 | 1.0 | 1.0 | 1.0 | 1.0 | 1.0 | 1.0 |

TABLE 7

Toner properties

| | Toner | | | | | | | | | |
|---|---|---|---|---|---|---|---|---|---|---|
| | 25 | 26 | 27 | 8 | 29 | 30 | 31 | 32 | 33 | 34 |
| D4 (μm) | 7.7 | 8.2 | 8.1 | 8.2 | 8.0 | 7.8 | 8.1 | 8.1 | 8.3 | 7.9 |
| Cav | 0.954 | 0.956 | 0.955 | 0.956 | 0.952 | 0.935 | 0.937 | 0.936 | 0.934 | 0.932 |
| Cmode | 0.950 | 0.951 | 0.950 | 0.950 | 0.950 | 0.930 | 0.932 | 0.931 | 0.932 | 0.930 |
| Mres (ppm) | 80 | 80 | 70 | 70 | 60 | 90 | 90 | 90 | 80 | 90 |
| $CH_2O$ (%) | 0.25 | 0.21 | 0.22 | 0.20 | 0.15 | 0.27 | 0.23 | 0.25 | 0.24 | 0.17 |
| Storage modulus | | | | | | | | | | |
| G'(110° C.) × $10^5$ ($dN/m^2$) | 1.15 | 1.23 | 1.21 | 1.25 | 1.37 | 1.12 | 1.25 | 1.19 | 1.22 | 1.39 |
| G'(140° C.) × $10^4$ ($dN/m^2$) | 0.985 | 1.01 | 0.995 | 1.11 | 1.21 | 0.981 | 0.997 | 0.996 | 1.13 | 1.19 |

As shown in Table 7, Toners 25–34 prepared in Toner Production Examples 25–34 all exhibited G' (110° C.)≦$1.00\times10^6$ $dN/m^2$ and G' (140° C.)≧$7.00\times10^3$ $dN/m^2$.

Toner Production Example 35

Into 710 wt. parts of deionized water, 450 wt. parts of 0.1 mol/l-$Na_3PO_4$ aqueous solution was added, and after heating at 60° C., 67.7 wt. parts of 1.0 mol/l-$CaCl_2$ aqueous solution was gradually added thereto to form an aqueous medium containing calcium phosphate.

| | |
|---|---|
| Styrene | 80 wt. part(s) |
| n-Butyl acrylate | 20 wt. part(s) |
| Unsaturated polyester resin (Mn = 18000, Mw/Mn = 2.2) | 2 wt. part(s) |
| Saturated polyester resin (Mn = 17000, Mw/Mn = 2.4) | 4 wt. part(s) |
| Carbon black ($S_{BET}$ = 62 $m^2/g$) | 10 wt. part(s) |
| Monoazo dye Fe compound (Negative charge control agent) | 1 wt. part(s) |

The above ingredients were uniformly dispersed and mixed by a TK homomixer (made by Tokushu Kika Kogyo K.K.) to form a monomer composition. The monomer composition was warmed at 60° C., and 7.5 wt. parts of the same ester wax as used in Production Example 1 was added thereto and mixed therein. Further, 4 wt. parts of 2,2'-azobis (2,4-dimethylvaleronitrile) was further dissolved therein, to obtain a polymerizable monomer composition.

The polymerizable monomer composition was charged into the above-prepared aqueous medium and stirred at 65° C. in an $N_2$ atmosphere for 15 min. at 10,000 rpm by a TK homomixer (made by Tokushu Kika Kogyo K.K.) to disperse the droplets of the polymerizable composition. Then, the system was further stirred by a paddle stirrer and subjected to 6 hours of reaction at 65° C., followed by further 4 hour of stirring at an elevated temperature of 80° C. After the polymerization, the system was subjected to 2 hours of distillation at 80° C. Thereafter, the suspension liquid was cooled, and hydrochloric acid was added thereto to dissolve the calcium phosphate, followed by recovery of polymerizate particles by filtration and washing with water to recover wet magnetic colored particles.

The colored particles were then dried at 40° C. for 72 hours to recover colored particles (non-magnetic toner particles) having a weight-average particle size (D4) of 6.6 μm.

100 wt. parts of the toner particles were then blended with 1.2 wt. parts of hydrophobic silica fine powder having a BET specific area ($S_{BET}$) of 140 $m^2/g$ obtained by surface-treating silica fine powder having an average primary particle size (Dp1) of 12 nm with hexamethyldisilazane by means of a HENSCHEL MIXER (made by Mitsui Miike Kakoki K.K.) to obtain Toner 35 (negatively chargeable non-magnetic black toner).

Toner 35 exhibited an average circularity (Cav) of 0.990, a residual monomer content (Mres.) of 80 ppm, and a moisture content ($C_{H2O}$) of 0.18 wt. %.

Some composition characteristics and physical properties of Toner 35 are shown in Tables 8 and 9, respectively, together with those of toners obtained in the following Examples.

Toner Production Examples 36–39

Toners 36–39 were prepared in the same manner as in Production Example 35 except for changing the species and amounts of colorants as shown in Table 8.

Toner Production Examples 40 and 41

Toners 40 and 41 were prepared in the same manner as in Production Example 35 except for changing the distillation time after the polymerization to 20 min. and 1 hour, respectively, and changing the drying time to 36 hours nd 60 hours, respectively.

Toner Production Example 42

The steps until the formation of droplets of polymerizable composition was performed similarly as in Production Example 35 except for using starting materials shown in Table 8. Then, the system was further stirred by a paddle mixer and subjected to 6 hours of reaction at 65° C., followed further by 1 hour of reaction at 80° C. under stirring. The suspension liquid after the reaction was not subjected to the distillation, but was thereafter cooled, followed by addition of hydrochloric acid to dissolve the calcium phosphate, filtration, washing with water and drying similarly as in Production Example 35 except that the drying time was changed to 10 hours, thereby recovering toner particles (D4=6.8 μm).

100 wt. parts of the toner particles were blended with 1.0 wt. part of the same hydrophobic silica powder as used in Production Example 35 to obtain Toner 42.

Toner 42 exhibited Cav=0.987, Mres=350 ppm, and $CH_2O$=0.20%.

Toner Production Examples 43–46

Toners 43–46 were prepared in the same manner as in Production Example 42 except for changing the species and amounts of and colorants as shown in Table 8.

Toner Production Example 47

Toner 47 was prepared in the same manner as in Production Example 39 except for changing the species and amount of colorant as shown in Table 8 and using surface-untreated silica.

The properties of Toners 35–47 prepared in the above Production Examples are inclusively shown in Table 9.

TABLE 8

| | Toner | | | | | | | | | | | | |
|---|---|---|---|---|---|---|---|---|---|---|---|---|---|
| | 35 | 36 | 37 | 38 | 39 | 40 | 41 | 42 | 43 | 44 | 45 | 46 | 47 |
| Styrene | 80 | 80 | 80 | 80 | 80 | 80 | 80 | 80 | 80 | 80 | 80 | 80 | 80 |
| n-Butylacrylate | 20 | 20 | 20 | 20 | 20 | 20 | 20 | 20 | 20 | 20 | 20 | 20 | 20 |
| Saturated polyester resin | 4 | 4 | 4 | 4 | 4 | 4 | 4 | 4 | 4 | 4 | 4 | 4 | 4 |
| Unsaturated polyester resin | 2 | 2 | 2 | 2 | 2 | 2 | 2 | 2 | 2 | 2 | 2 | 2 | 2 |
| Carbon Black (BET 62 $m^2/g$) | 10 | — | — | — | — | — | — | 10 | — | — | — | — | — |
| Pigment yellow 17 | — | 10 | — | — | — | — | — | — | 10 | — | — | — | — |
| Pigment Red 122 | — | — | 10 | — | — | — | — | — | — | 10 | — | — | — |
| Pigment Blue 15:3 | — | — | — | 10 | — | — | — | — | — | — | 10 | — | — |
| Surface treated magnetic powder | — | — | — | — | 100 | 100 | 100 | — | — | — | — | 100 | 100 |
| Monoazo dye Fe compound | 1 | — | — | — | 1 | 1 | 1 | 1 | — | — | — | 1 | 1 |
| Dialkylsalicylic acid metal compound | — | 1 | 1 | 1 | — | — | | — | 1 | 1 | 1 | — | — |
| Ester wax (mp 72° C.) | 7.5 | 7.5 | 7.5 | 7.5 | 7.5 | 7.5 | 7.5 | 7.5 | 7.5 | 7.5 | 7.5 | 7.5 | 7.5 |
| 2,2'-azobis(2,4-dimethyl-valeronitrile) | 4 | 4 | 4 | 4 | 4 | 4 | 4 | 4 | 4 | 4 | 4 | 4 | 4 |
| Hydrophobic silica (BET 140 $m^2/g$) | 1.2 | 1.2 | 1.2 | 1.2 | 1.2 | 1.2 | 1.2 | 1.2 | 1.2 | 1.2 | 1.2 | 1.2 | — |
| Untreated silica (BET 140 $m^2/g$) | — | — | — | — | — | — | — | — | — | — | — | — | 1.2 |
| Distillation time (hours) | 2 | 2 | 2 | 2 | 2 | 20 min. | 1 | none | none | none | none | none | 2 |
| Drying time (hours) | 72 | 72 | 72 | 72 | 72 | 36 | 60 | 10 | 10 | 10 | 10 | 10 | 72 |

TABLE 9

Toner properties

| | Toner | | | | | | | | | | | | |
|---|---|---|---|---|---|---|---|---|---|---|---|---|---|
| | 35 | 36 | 37 | 38 | 39 | 40 | 41 | 42 | 43 | 44 | 45 | 46 | 47 |
| D4 (μm) | 6.6 | 6.4 | 6.8 | 6.8 | 6.9 | 6.9 | 6.9 | 6.8 | 6.4 | 6.7 | 6.8 | 7.1 | 6.9 |
| Cav | 0.990 | 0.988 | 0.986 | 0.987 | 0.980 | 0.980 | 0.980 | 0.987 | 0.985 | 0.985 | 0.983 | 0.985 | 0.979 |

TABLE 9-continued

| | Toner properties | | | | | | | | | | | | |
|---|---|---|---|---|---|---|---|---|---|---|---|---|---|
| | Toner | | | | | | | | | | | | |
| | 35 | 36 | 37 | 38 | 39 | 40 | 41 | 42 | 43 | 44 | 45 | 46 | 47 |
| Cmode | 1.000 | 1.000 | 1.000 | 1.000 | 1.000 | 1.000 | 1.000 | 1.000 | 1.000 | 1.000 | 1.000 | 1.000 | 1.000 |
| Mres (ppm) | 80 | 70 | 70 | 50 | 60 | 280 | 190 | 350 | 350 | 330 | 310 | 340 | 60 |
| $CH_2O$ (%) | 0.18 | 0.19 | 0.17 | 0.21 | 0.15 | 0.72 | 0.42 | 0.20 | 0.22 | 0.21 | 0.19 | 0.16 | 0.15 |
| Storage modulus | | | | | | | | | | | | | |
| G'(110° C.) × $10^5$ (dN/$m^2$) | 2.90 | 3.56 | 2.86 | 5.22 | 2.55 | 2.51 | 2.59 | 2.82 | 3.54 | 2.82 | 5.18 | 2.49 | 2.53 |
| G'(140° C.) × $10^4$ (dN/$m^2$) | 5.38 | 3.50 | 7.90 | 5.74 | 5.91 | 5.85 | 5.94 | 5.18 | 3.62 | 8.04 | 5.66 | 5.83 | 5.86 |

As shown in Table 9, Toners 35–47 prepared in Toner Production Examples 35–47 all exhibited G' (110° C.)≦1.00×$10^6$ dN/$m^2$ and G' (140° C.)≧7.00×$10^3$ dN/$m^2$.

EXAMPLES 32–35

A continuous full-color printing test was performed in the same manner as in Example 1 except for using four color toners shown in Table 10 below in each Example. The evaluation results are also shown in Table 10.

TABLE 10

| | Nos. of toners used | | | | Evaluation results | | | | | | | | | | | | |
|---|---|---|---|---|---|---|---|---|---|---|---|---|---|---|---|---|---|
| | | | | | Bk (black) | | | Ye (yellow) | | | Ma (magenta) | | | Cy (cyan) | | | |
| Example | Bk | Ye | Ma | Cy | I.D. | Fog | Gloss | I.D. | Fog | Gloss | I.D. | Fog | Gloss | I.D. | Fog | Gloss | Back soil |
| Ex. 32 | 25 | 26 | 27 | 28 | A | A | B | A | A | B | A | A | B | A | A | B | A |
| Ex. 33 | 30 | 31 | 32 | 33 | A | B | C | A | B | C | A | B | C | A | B | C | B |
| Ex. 34 | 35 | 36 | 37 | 38 | A | A | A | A | A | A | A | A | A | A | A | A | A |
| Ex. 35 | 42 | 43 | 44 | 45 | A | B | B | A | B | B | A | B | B | A | B | B | B |

In Examples 32–35, the full-color image mixability was also evaluated. As a result of observation of full-color images with eyes, color mixing was completely effected at any part of the image thus leaving no problem at all.

EXAMPLES 36–42

Monochromatic image formation test was performed in the same manner as in Example 6 except for using magnetic black toners shown in Table 11. The results are also shown in Table 11.

TABLE 11

| Example | Toner used | I.D. | Fog | Back soil |
|---|---|---|---|---|
| Ex. 36 | 29 | B | B | A |
| Ex. 37 | 34 | B | B | A |
| Ex. 38 | 39 | A | A | A |
| Ex. 39 | 40 | A | A | B |
| Ex. 40 | 41 | A | A | A |
| Ex. 41 | 46 | A | B | B |
| Ex. 42 | 47 | A | A | A |

EXAMPLES 43–58

(1) Color image forming apparatus

An image forming apparatus as illustrated in FIG. 1 and similar to the one used in Example 1 was provided except that the photosensitive drum 101 was charged to a surface potential of ca. −600 volts and the springs 25*a* and 25*b* (FIG. 3) were changed so that the lower surface of the belt guide 16*a* and the upper surface of the pressure roller 30 were pressed against each other so as to apply a linear pressure of 784 N/m (0.8 kg-g/cm) in a state of 80 g/$m^2$-paper being inserted and form a fixing nip N of 9.0 mm.

Under the above conditions and in a normal temperature/normal humidity (23° C./60% RH) environment, continuous mono-color image formation tests were performed by using Toners respectively indicated in Table 12. Each image forming test was performed in a full-color continuous mode (i.e., a mode of promoting toner consumption without providing a substantial pause period of the developing device) at a fixing speed of 94 mm/sec to form lateral line images of respective colors each in a printing areal ratio of 5% on 7000 sheets.

As an evaluation, the printed image sheets were checked as to whether back side soiling due to offset toner was observed or not.

Further, in order to check gloss irregularity, solid images of respective colors were printed on an every 500th sheet, and gloss irregularity was checked with respect to images on each sheet. Further, the image density and fog of the printed images, and the influences of toner sticking onto and abrasion of the fixing belt 10 on the soiling and deterioration of the resultant images, were evaluated.

The respective toners of the present invention retained the image density and fog level at the initial stage until the end of the continuous printing test.

The evaluation results are also shown in Table 12. The items of Back soil (back-side sheet soiling), Gloss (gloss irregularity), ID (image density) and Fog (image fog) were evaluated in the same manner as in Example 1 except that images after the printing on 7000 sheets were evaluated.

Additional items of evaluation were evaluated in the following manner.

<6> Soil and sticking on fixing belt (Soil & Stick)

After continuous printing of the above-mentioned image on 7000 sheets of A4-size CLC paper (80 g/$m^2$, made by Canon K.K.), the degree of soiling and toner melt-sticking on the fixing belt in the fixing apparatus were observed with eyes and evaluated according to the following standard while confirming the defective parts (when observed) in parallel with the solid images used for evaluating the gloss irregularity.

A: Not observed at all.

B: Substantially not observed.

C: Slightly observed but at a level of practically no problem.

D: Substantial soil or toner melt-sticking observed.

<7> Damage of fixing belt

After the continuous printing of the above-mentioned image on 7000 sheets of A4-size CLC paper, the damages, such as abrasion or minute scars, on the fixing belt were observed with eyes and evaluated according to the following standard while confirming the damaged parts (when observed) in parallel with the solid images used for evaluating the gloss irregularity.

A: Not observed at all.

B: Substantially not observed.

C: Slightly observed but at a level of practically no problem.

D: Substantial damages observed.

TABLE 12

| Example | Toner Nos. Ye | Ma | Cy | Bk | Evaluation results: Back soil | Gloss | I.D. | Fog | Soil & Stick | Damage |
|---|---|---|---|---|---|---|---|---|---|---|
| 43 | — | — | — | 25 | A | B | A | A | A | B |
| 44 | 26 | — | — | — | A | B | A | A | A | B |
| 45 | — | 27 | — | — | A | B | A | A | A | B |
| 46 | — | — | 28 | — | A | B | A | A | A | B |
| 47 | — | — | — | 30 | B | D | A | B | B | C |
| 48 | 31 | — | — | — | B | D | A | B | B | C |
| 49 | — | 32 | — | — | B | D | A | B | B | C |
| 50 | — | — | 33 | — | B | D | A | B | B | C |
| 51 | — | — | — | 35 | A | A | A | A | A | A |
| 52 | 36 | — | — | — | A | A | A | A | A | A |
| 53 | — | 37 | — | — | A | A | | A | A | A |
| 54 | — | — | 38 | — | A | A | A | A | A | A |
| 55 | — | — | — | 42 | C | B | A | B | D | B |
| 56 | 43 | — | — | — | C | B | A | B | D | B |
| 57 | — | 44 | — | — | C | B | A | B | D | B |
| 58 | — | — | 45 | — | C | B | A | B | D | B |

EXAMPLES 59–65

(2) Monochromatic image forming apparatus

Figure 13:
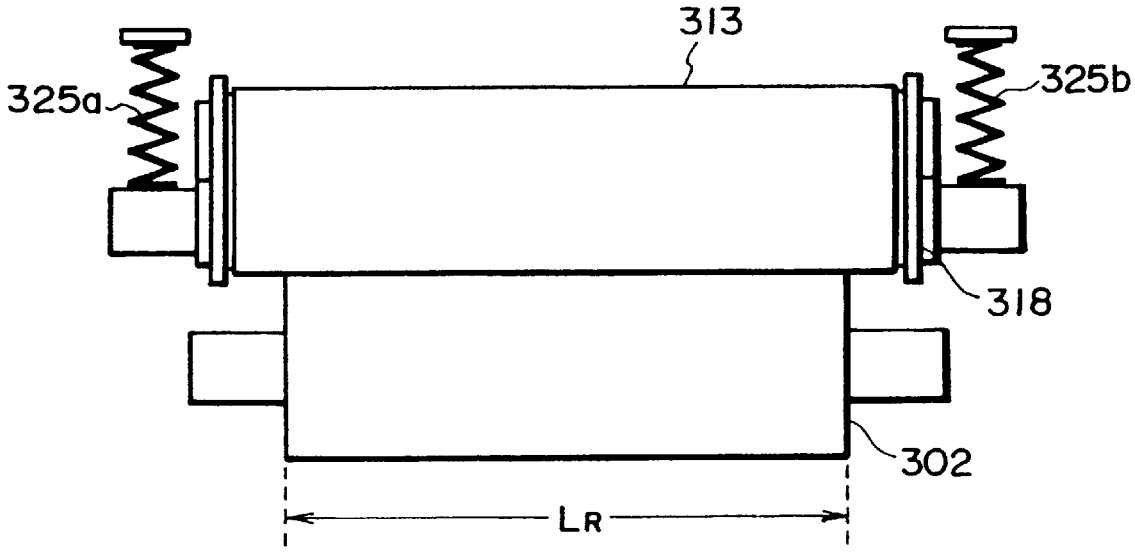
FIG. 13 is a schematic front view of an essential portion of the heating apparatus of FIG. 12.

An image forming apparatus as illustrated in FIG. 11 and similar to the one used in Example 6 was provided except that the photosensitive drum 101 was charged to a surface potential of ca. −600 volts and the springs 325*a* and 325*b* (FIG. 13) were changed so that the lower surface of the belt guide 318 and the upper surface of the pressure roller 302 were pressed against each other so as to apply a linear pressure of 784 N/m (0.8 kg-g/cm) in a state of 75 g/m$^2$-paper being inserted and form a fixing nip N of 9.0 mm.

Under the above conditions and in a normal temperature/normal humidity (25° C./50% RH) environment, continuous mono-color image formation tests were performed by using Toners respectively indicated in Table 13. Each image forming test was performed in a continuous mode (i.e., a mode of promoting toner consumption without providing a substantial pause period of the image forming apparatus) at a fixing speed of 190 mm/sec to form lateral line images each in a printing areal ratio of 5% on 7000 sheets.

As an evaluation, the printed image sheets were checked as to whether back side soiling due to offset toner was observed or not.

Further, the image density and fog of the printed images, and the influences of toner sticking onto and abrasion of the fixing belt 313 on the soiling and deterioration of the resultant images, were evaluated after the printing on 7000 sheets, in the same manner as described above.

The evaluation results are also shown in Table 13.

TABLE 13

| Example | Toner No. | Evaluation results: Back soil | I.D. | Fog | Soil & stick | Damage |
|---|---|---|---|---|---|---|
| Ex. 59 | 29 | A | B | B | A | B |
| Ex. 60 | 34 | B | B | C | B | C |
| Ex. 61 | 39 | A | A | A | A | A |
| Ex. 62 | 40 | B | A | A | B | A |
| Ex. 63 | 41 | B | A | A | A | A |
| Ex. 64 | 46 | C | A | B | D | B |
| Ex. 65 | 47 | B | A | B | B | A |

EXAMPLES 36–73

By using an image forming apparatus identical to the one used in Example 1 in a low temperature/low humidity (15° C./10% RH) environment, each of Toners 35–38 and 42–45 was subjected to a monochromatic image print-out test for reproduction of a monochromatic image at an image density adjusted at 1.5 on 20 sheets continually supplied at a print-out speed of 12 A4-size sheets/min in a quick-start mode (i.e., image formation was started from a state where the fixing apparatus was left standing sufficiently to room temperature). The print-out images were evaluated with respect to the following item.

[Print-out image evaluation]

<8> Fixability (rubbing test)

A large number of solid square images of 10 mm×10 mm were printed on a A4-size CLC paper (105 g/m$^2$, made by Canon K.K.) at an adjusted toner coverage rate of 1.0 mg/cm$^2$. The resultant fixed images were rubbed with a lens-cleaning paper for 5 reciprocations under a load of 50 g/cm$^2$, and an image density lowering (%) was measured. Based on the measured image density lowering data, the evaluation was performed according to the following standard.

A: <2%

B: ≧2% and <5%

C: ≧5% and d<10%

D: ≧10%

The evaulation was performed on a first sheet and a 20th sheet for each toner. The results are inclusively shown in the following Table 14.

TABLE 14

| Example | Toner No. | Fixability (rubbing test) 1st/20th |
|---|---|---|
| Ex. 66 | 35 | A/A |
| Ex. 67 | 36 | A/A |
| Ex. 68 | 37 | A/A |
| Ex. 69 | 38 | A/A |
| Ex. 70 | 42 | B/B |
| Ex. 71 | 43 | B/B |
| Ex. 72 | 44 | B/B |
| Ex. 73 | 45 | B/B |

The toners used in Examples 66–73 provided good results in the anti-rubbing fixability test. This may be attributable to factors, such as (1) the fixing apparatus could instantaneously generate and impart a sufficient fixing energy to the toner in response to the quick-start operation, (2) the supply of fixing heat was stably effected (without shortage or excess) in the continuous test, and (3) the moisture content in the toner was reduced to a prescribed low level. According to Examples 66–73, it was confirmed possible to provide a toner and an image forming method without requiring preheating of a fixing apparatus during a waiting time of the image forming apparatus, i.e., showing excellent quick-start characteristic and power economization characteristic.

COMPARATIVE EXAMPLE 10

The fixing apparatus in the image forming apparatus of Example 66 was replaced by a so-called surf-fixing apparatus, i.e., a fixing apparatus using a fixing belt for supplying a heat for fixation from a resistance heating member, in the apparatus of FIG. 9, heat generated from a heating means 113 disposed opposite a toner image $t_1$ was imparted to the toner image via a film member 111 inserted therebetween while forming a nip width of 7 mm and a linear pressure of 392 N/m (0.4 kg-f/cm). The fixing was performed at a speed of 72 mm/sec, a fixing nip proximity temperature of 190° C. and a warm-up time of 20 sec. The pressure roller 112 comprised a core metal coated successively with an elastic layer, a fluorine-containing rubber layer and a fluorine-containing resin layer. Except for using the surf fixing apparatus, a quick-start mode printing test (i.e., image formation from a sufficiently cooled room temperature state) was performed similarly as in Example 66 by using Toner 35 (black) in a low temperature/low humidity (15° C./10% RH) environment. The stability of the fixed image was similarly evaluated by rubbing.

As a result, the image density lowering due to the rubbing amount to 13.2% or the first sheet, thus exhibiting an inferior fixability in the continuous image output.

EXAMPLES 74–78

By using an image forming apparatus identical to the one used in Example 59 in a low temperature/low humidity (15° C./10% RH) environment, each of Toners 39, 40, 41, 46 and 47 was subjected to a monochromatic image print-out test for reproduction of a monochromatic image at an image density adjusted at 1.5 on 20 sheets continually supplied at a print-out speed of 12 A4-size sheets/min in a quick-start mode (i.e., image formation was started from a state where the fixing apparatus was left standing sufficiently to room temperature). The print-out images were evaluated similarly as in Example 59. The results are inclusively shown in Table 15 below.

TABLE 15

| Example | Toner No. | Fixability (rubbing test) 1st/20th |
|---|---|---|
| Ex. 74 | 39 | A/A |
| Ex. 75 | 40 | B/A |
| Ex. 76 | 41 | A/A |
| Ex. 77 | 46 | C/B |
| Ex. 78 | 47 | A/A |

COMPARATIVE EXAMPLE 11

The quick-start mode printing test of Example 74 was repeated except for replacing the fixing apparatus used therein with a surface-fixing apparatus illustrated in FIG. 9 (identical to the one used in Comparative Example 7) and modifying the fixing conditions similarly as in Comparative Example 7.

As a result, the image density lowering due to the rubbing amounted to 14.9% on the first sheet, thus exhibiting an inferior fixability in the continuous image output.

EXAMPLE 79

The print-out test of Example 59 was repeated while changing the pressure springs (25*a* and 25*b* in FIGS. 3 and 4) so as to apply a linear pressure of 1568 N/m (1.6 kg-f/cm) in a state of 75 g/m$^2$ paper being inserted and form a fixing nip N of 11.0 mm.

During and after the continuous printing test, clear fog-free images were obtained at sufficient image density, while slight back-side sheet soiling was observed at a level of no problem. Slight damage of the fixing belt was also recognized.

EXAMPLE 80

The print-out test of Example 59 was repeated while changing the pressure springs (25*a* and 25*b* in FIGS. 3 and 4) so as to apply a linear pressure of 294 N/m (0.3 kg-f/cm) in a state of 75 g/m$^2$ paper being inserted and form a fixing nip N of 7 mm.

During and after the continuous printing test, clear fog-free images were obtained at sufficient image density, while slight gloss irregularity and back-side sheet soiling were observed at a level of practically no problem.

The results are including shown in Table 16 below.

TABLE 16

| Example | Back soil | Gloss | I.D. | Fog | Soil & stick | Damage |
|---|---|---|---|---|---|---|
| Ex. 79 | B | A | A | A | B | C |
| Ex. 80 | B | C | A | A | A | A |

Toner Production Example 48

Into 809 wt. parts of deionized water, 501 wt. parts of 0.1 mol/l-$Na_3PO_4$ aqueous solution was added, and after heating at 60° C., 67.7 wt. parts of 1.07 mol/l-$CaCl_2$ aqueous solution was gradually added thereto to form an aqueous medium containing calcium phosphate.

| | |
|---|---|
| Styrene | 83 wt. part(s) |
| n-Butyl acrylate | 17 wt. part(s) |
| Divinylbenzene | 0.2 wt. part(s) |
| Saturated polyester resin (Mn = 17000, Mw/Mn = 2.4) | 4.5 wt. part(s) |
| Monoazo dye Fe compound (Negative charge control agent) | 1 wt. part(s) |
| Carbon black ($S_{BET}$ = 60 m$^2$/g) | 7.5 wt. part(s) |

The above ingredients were uniformly dispersed and mixed by an attribute to form a monomer composition. The monomer composition was warmed at 60° C., and 12 wt. parts of an ester wax principally comprising behenyl behenate (Tabs=72° C., Tevo=70° C.) was added thereto and mixed therein. Further, 3 wt. parts of 2,2'-azobis(2,4-dimethylvaleronitrile) ($T_{1/2}$=140 min. at 60° C., polymerization initiator) was further dissolved therein, to obtain a polymerizable monomer composition.

The polymerizable monomer composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition. Then, the system was further stirred by a paddle stirrer and subjected to 6 hours of reaction at 60° C., followed by further 4 hour of stirring at an elevated temperature of 80° C. After the polymerization, the system was subjected to 3 hours of distillation at 80° C. Thereafter, the suspension liquid was cooled, and hydrochloric acid was added thereto to dissolve the calcium phosphate, followed by recovery of polymerizate particles by filtration and washing with water to recover wet colored particles.

The colored particles were then dried at 40° C. for 12 hours to recover colored particles (toner particles) (D4=7.6 μm).

100 wt. parts of the toner particles were then blended with 1.2 wt. parts of hydrophobic silica fine powder ($S_{BET}$=200 $m^2/g$) obtained by surface-treating silica fine powder (Dp1=12 nm) with silicone oil by means of a HENSCHEL MIXER (made by Mitsui Miike Kakoki K.K.) to obtain Toner 48.

Some representative properties and characterizing features of Toner 48 thus produced are shown in Table 17 appearing hereinafter together with those of Toners 49 to 68 prepared in the following Production Examples.

Toner Production Examples 49 and 50

Toners 49 and 50 were prepared in the same manner as in Production Example 48 except that the drying time was changed to 10 hours and 8 hours, respectively.

Toner Production Example 51

Toner 51 was prepared in the same manner as in Production Example 48 except for replacing the 7.5 wt. parts of carbon black ($S_{BET}$ 60 $m^2/g$) with 10 wt. parts of C.I. Pigment Yellow 174 and replacing the monoazo dye Fe compound with dialkylsalicylic acid metal compound.

Toner Production Examples 52 and 53

Toners 52 and 53 were prepared in the same manner as in Production Example 51 except that the drying time was changed to 10 hours and 8 hours, respectively.

Toner Production Example 54

Toner 54 was prepared in the same manner as in Production Example 48 except for replacing the 7.5 wt. parts of carbon black ($S_{BET}$ 60 $m^2/g$) with 10 wt. parts of C.I. Pigment Red 122 and replacing the monoazo dye Fe compound with dialkylsalicylic acid metal compound.

Toner Production Examples 55 and 56

Toners 55 and 56 were prepared in the same manner as in Production Example 54 except that the drying time was changed to 10 hours and 8 hours, respectively.

Toner Production Example 57

Toner 57 was prepared in the same manner as in Production Example 48 except for replacing the 7.5 wt. parts of carbon black ($S_{BET}$ 60 $m^2/g$) with 10 wt. parts of C.I. Pigment Blue 15:3 and replacing the monoazo dye Fe compound with dialkylsalicylic acid metal compound.

Toner Production Examples 58 and 59

Toners 58 and 59 were prepared in the same manner as in Production Example 57 except that the drying time was changed to 10 hours and 8 hours, respectively.

Toner Production Example 60

| | |
|---|---|
| Styrene/n-butyl acrylate copolymer (82/18 by weight, Mn = 27000, Mw/Mn = 3.2) | 80 wt. part(s) |
| Saturated polyester resin (Mn = 17000, Mw/Mn = 2.4) | 4.5 wt. part(s) |
| Dialkylsalicylic acid metal compound (Negative charge control agent) | 3 wt. part(s) |
| C.I. Pigment Yellow 174 | 10 wt. part(s) |

-continued

| | |
|---|---|
| Ester wax used in Production Example 48 | 5 wt. part(s) |

The above materials were blended in a blender and melt-kneaded by a twin-screw extruder heated at 110° C. After being cooled, the kneaded product was coarsely crushed by a hammer mill (made by Hosokawa Micron K.K.) and finely pulverized by an impingement-type jet mill, wherein the impingement plate was set at an angle of 90 deg. with respect to the impinging direction. The pulverizate was pneumatically classified to recover toner particles (D4=7.2 μm). The toner particles were then subjected to a sphering treatment by means of a batch-wise impact-type surface treatment blade peripheral speed=80 m/sec, Treatment time=3 min.).

Then, 100 wt. parts of the sphered toner particles were blended with 1.2 wt. parts of surface-untreated silica fine powder ($S_{BET}$=200 $m^2/g$, Dp1=12 μm) by means of a HENSCHEL MIXER to obtain Toner 60.

Toner Production Example 61

Toner 61 was prepared in the same manner as in Production Example 60 except that the sphering treatment after the pulverization was omitted.

Toner Production Example 62

| | |
|---|---|
| Polyoxypropylene(2.2)-2,2-bis(4-hydroxyphenyl)propane | 30 mol. % |
| Polyoxyethylene(2.0)-2,2-bis(4-hydroxyphenyl)propane | 70 mol. % |
| Terephthalic acid | 60 mol. % |
| Fumaric acid | 40 mol. % |
| Trimellitic acid | 0.50 mol. % |

The above ingredients were reacted with each other to prepare Polyester resin 1 (Mw=78000, Mn=63000, Tg=65° C., acid value=12.3 mgKOH/g).

| | |
|---|---|
| Polyester resin 1 prepared above | 100 wt. part(s) |
| Carbon black ($S_{BET}$ = 60 $m^2/g$) | 4 wt. part(s) |
| 3,5-Di-t-butylsalicylic acid Al compound | 4 wt. part(s) |

The above materials were sufficiently blended by a HENSCHEL MIXER and melt-kneaded by a twin-screw extruder. After cooling, the kneaded product was coarsely crushed to ca. 1–2 μm and then finely pulverized by an air jet-type pulverizer wherein the impingement plate was set at an angle of 45 deg. with respect to the impinging direction. The pulverizable was classified to obtain colored particles (toner particles) (D4=7.4 μm).

100 wt. parts of the toner particles were blended with titania fine powder ($S_{BET}$=12 $m^2/g$, Dp1=290 nm) by a HENSCHEL MIXER (made by Mitsui Miike Kakoki K.K.) to obtain Toner 62.

Toner Production Example 63

Toner 63 was prepared in the same manner as in Production Example 62 except for replacing the 4 wt. parts of carbon black ($S_{BET}$=60 $m^2/g$) with 5 wt. parts of C.I.

Pigment Red 122 an replacing the titania fine powder with titania fine powder surface-treated with silicone oil.

Toner Production Example 64

| | |
|---|---|
| Polyoxypropylene(2.2)-2,2-bis(4-hydroxyphenyl)propane | 30 mol. % |
| Polyoxyethylene(2.0)-2,2-bis(4-hydroxyphenyl)propane | 70 mol. % |
| Terephthalic acid | 40 mol. % |
| Fumaric acid | 60 mol. % |
| Trimellitic acid | 0.05 mol. % |

The above ingredients were reacted with each other to prepare Polyester resin 2 (Mw=12000, Mn=4200, Tg=58° C., acid value=12.3 mgKOH/g).

| | |
|---|---|
| Polyester resin 2 prepared above | 100 wt. part(s) |
| Carbon black ($S_{BET}$ = 60 $m^2/g$) | 4.5 wt. part(s) |
| 3,5-Di-t-butylsalicylic acid Zn compound | 4 wt. part(s) |

The above materials were sufficiently blended by a HENSCHEL MIXER and melt-kneaded by a twin-screw extruder. After cooling, the kneaded product was coarsely crushed to ca. 1–2 μm and then finely pulverized by an air jet-type pulverizer wherein the impingement plate was set at an angle of 45 deg. with respect to the impinging direction. The pulverizable was classified to obtain colored particles (toner particles) (D4=7.2 μm).

100 wt. parts of the toner particles were blended with surface-untreated silica fine powder ($S_{BET}$=200 $m^2/g$, Dp1=12 nm) by a HENSCHEL MIXER (made by Mitsui Miike Kakoki K.K.) to obtain Toner 64.

Toner Production Example 65

Toner 65 was prepared in the same manner as in Production Example 64 except for replacing the 4.5 wt. parts of carbon black ($S_{BET}$=60 $m^2/g$) with 5 wt. parts of C.I. Pigment Yellow 174.

Toner Production Example 66

Toner 66 was prepared in the same manner as in Production Example 64 except for replacing the 4.5 wt. parts of carbon black ($S_{BET}$=60 $m^2/g$) with 5 wt. parts of C.I. Pigment Red 122.

Toner Production Example 67

Toner 67 was prepared in the same manner as in Production Example 64 except for replacing the 4.5 wt. parts of carbon black ($S_{BET}$=60 $m^2/g$) with 5 wt. parts of C.I. Pigment Blue 15:3.

Toner Production Example 68

Into 809 wt. parts of deionized water, 501 wt. parts of 0.1 mol/l-$Na_3PO_4$ aqueous solution was added, and after heating at 60° C., 67.7 wt. parts of 1.07 mol/l-$CaCl_2$ aqueous solution was gradually added thereto to form an aqueous medium containing calcium phosphate.

| | |
|---|---|
| Styrene | 83 wt. part(s) |
| n-Butyl acrylate | 17 wt. part(s) |
| Divinylbenzene | 3.1 wt. part(s) |
| Saturated polyester resin (Mn = 17000, Mw/Mn = 2.4) | 4.5 wt. part(s) |
| Dialkylsalicylic acid metal compound (Negative charge control agent) | 1 wt. part(s) |
| C.I. Pigment Blue 15:3 | 10 wt. part(s) |

The above ingredients were uniformly dispersed and mixed by an attritor to form a monomer composition. The monomer composition was warmed at 60° C., and 12 wt. parts of low-molecular weight polyethylene (Tabs=115° C./Tevo=110° C.) was added thereto and mixed therein. Further, 3 wt. parts of 2,2'-azobis(2,4-dimethylvaleronitrile) ($T_{1/2}$=140 min. at 60° C., polymerization initiator) was further dissolved therein, to obtain a polymerizable monomer composition.

The polymerizable monomer composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition. Then, the system was further stirred by a paddle stirrer and subjected to 6 hours of reaction at 60° C., followed by further 4 hours of stirring at an elevated temperature of 80° C. After the polymerization, the suspension liquid was cooled without being preceded by distillation, and hydrochloric acid was added thereto to dissolve the calcium phosphate, followed by recovery of polymerizate particles by filtration and washing with water to recover wet colored particles.

The colored particles were then dried at 40° C. for 4 hours to recover colored particles (toner particles) (D4=7.1 μm).

The toner particles were used as Toner 68 without being mixed with inorganic fine powder.

Some representative properties and characterizing features of the above-prepared Toners 48–68 are inclusively shown in Table 17 below.

TABLE 17

| | | | | | | Storage moduolus | | Inorganic fine powder | | | | | | | |
|---|---|---|---|---|---|---|---|---|---|---|---|---|---|---|---|
| Toner Nos. | D4 (μm) | Cav | Cmode | Mres (ppm) | $CH_2O$ (%) | G' 110° C.) × $10^5$ ($dN/m^2$) | G' (140° C.) × $10^4$ ($dN/m^2$) | Species | Dp1 (nm) | Treated with | Amt. (wt. parts) | Colorant | Process | Distil. time (Hr) | Drying time (Hr) |
| 48 | 7.6 | 0.981 | 1.000 | 90 | 0.9 | 1.45 | 2.69 | silica | 12 | silicon oil | 1.2 | C.B. | Pmzn. | 3 | 12 |
| 49 | 7.6 | 0.981 | ↑ | 160 | 1.68 | 1.41 | 2.59 | ↑ | ↑ | ↑ | ↑ | ↑ | ↑ | ↑ | 10 |
| 50 | 7.6 | 0.981 | ↑ | 230 | 2.7 | 1.53 | 2.61 | ↑ | ↑ | ↑ | ↑ | ↑ | ↑ | ↑ | 8 |
| 51 | 7.3 | 0.986 | ↑ | 70 | 0.91 | 1.78 | 1.75 | ↑ | ↑ | ↑ | ↑ | Y174 | ↑ | ↑ | 12 |
| 52 | 7.3 | 0.986 | ↑ | 140 | 1.84 | 1.77 | 1.81 | ↑ | ↑ | ↑ | ↑ | ↑ | ↑ | ↑ | 10 |

TABLE 17-continued

| Toner Nos. | D4 (μm) | Cav | Cmode | Mres (ppm) | $CH_2O$ (%) | Storage moduolus G' 110° C.) × $10^5$ ($dN/m^2$) | Storage moduolus G' (140° C.) × $10^4$ ($dN/m^2$) | Inorganic fine powder Species | Dp1 (nm) | Treated with | Amt. (wt. parts) | Colorant | Process | Distil. time (Hr) | Drying time (Hr) |
|---|---|---|---|---|---|---|---|---|---|---|---|---|---|---|---|
| 53 | 7.3 | 0.986 | ↑ | 250 | 2.87 | 1.78 | 1.77 | ↑ | ↑ | ↑ | ↑ | ↑ | ↑ | ↑ | 8 |
| 54 | 6.9 | 0.982 | ↑ | 90 | 0.9 | 1.43 | 3.95 | ↑ | ↑ | ↑ | ↑ | R122 | ↑ | ↑ | 12 |
| 55 | 6.9 | 0.982 | ↑ | 170 | 1.78 | 1.41 | 4.02 | ↑ | ↑ | ↑ | ↑ | ↑ | ↑ | ↑ | 10 |
| 56 | 6.9 | 0.982 | ↑ | 230 | 2.87 | 1.40 | 3.98 | ↑ | ↑ | ↑ | ↑ | ↑ | ↑ | ↑ | 8 |
| 57 | 6.8 | 0.979 | ↑ | 50 | 0.91 | 2.61 | 2.87 | ↑ | ↑ | ↑ | ↑ | B15:3 | ↑ | ↑ | 12 |
| 58 | 6.8 | 0.979 | ↑ | 140 | 1.94 | 2.59 | 2.83 | ↑ | ↑ | ↑ | ↑ | ↑ | ↑ | ↑ | 10 |
| 59 | 6.8 | 0.979 | ↑ | 230 | 2.67 | 2.60 | 2.91 | ↑ | ↑ | ↑ | ↑ | ↑ | ↑ | ↑ | 8 |
| 60 | 7.2 | 0.961 | 0.963 | 80 | 0.03 | 1.12 | 0.875 | silica | 12 | none | 1.2 | Y174 | PVZ-sphere | none | none |
| 61 | 7.3 | 0.936 | 0.939 | 80 | 0.04 | 1.07 | 0.870 | ↑ | ↑ | ↑ | ↑ | ↑ | PVZ | ↑ | ↑ |
| 62 | 7.4 | 0.955 | 0.958 | — | 0.34 | 0.654 | 1.53 | titania | 290 | ↑ | 0.8 | C.B. | ↑ | — | — |
| 63 | 7.4 | 0.958 | 0.959 | — | 0.33 | 0.702 | 1.82 | ↑ | ↑ | silicone oil | ↑ | R122 | ↑ | — | — |
| 64 | 7.2 | 0.957 | 0.961 | — | 0.36 | 0.104 | 0.579 | silica | 12 | none | 1.2 | C.B. | VPZ | — | — |
| 65 | 7.3 | 0.958 | 0.959 | — | 0.31 | 0.121 | 0.621 | ↑ | ↑ | ↑ | ↑ | Y174 | ↑ | — | — |
| 66 | 7.2 | 0.955 | 0.957 | — | 0.34 | 0.114 | 0.632 | ↑ | ↑ | ↑ | ↑ | R122 | ↑ | — | — |
| 67 | 7.2 | 0.953 | 0.955 | — | 0.33 | 0.106 | 0.465 | ↑ | ↑ | ↑ | ↑ | B15:3 | ↑ | — | — |
| 68 | 7.1 | 0.982 | 1.000 | 360 | 3.69 | 26.5 | 8.65 | none | — | — | — | B15:3 | Pmzn. | none | 4 |

EXAMPLES 81–83 AND COMPARATIVE EXAMPLE 12

The respective toners were evaluated in the same manner as in Example 1, by using an image forming apparatus as illustrated in FIG. 1.

More specifically in a normal temperature/normal humidity (23° C./60% RH) environment, continuous full-color image formation tests were performed by using Toners 48, 51, 54 and 57 in Example 81; Toners 49, 52, 55 and 58 in Example 82; Toners 50, 53, 56 and 59 in Example 83; and Toners 64, 65, 66 and 67 in Comparative Example 82, contained in the respective developing devices. Each image forming test was performed in a full-color continuous mode at a fixing speed of 94 mm/sec to form lateral line images of respective colors each in a printing areal ratio of 4% on 10,000 sheets, while supplementing the respective toners to the respective developing devices, when necessary.

As an evaluation, the printed image sheets were checked as to whether back side soiling due to offset toner was observed or not.

Further, in order to check gloss irregularity, solid images of respective colors were printed on an every 500th sheet, and gloss irregularity was checked with respect to images on each sheet. Further, the image density and fog of the printed images, and the influences of toner sticking onto and abrasion of the fixing belt 10 on the soiling and deterioration of the resultant images, were evaluated. The influences of the damages to the fixing belt were checked also at the time after printing on 7000 sheets.

As a result, in Example 81, during and after the continuous printing test, sufficient image densities were obtained and fog-free clear images were formed for respective colors. Further, gloss irregularity, back-side sheet soiling or damage on the fixing belt was not observed.

In Example 82, some increase of fog was observed. Further, slight gloss irregularity an back-side sheet soiling were observed but at a level of no problem at all. Damage on the fixing belt was at a level of no problem.

In Example 83, some image density lowering and increased fog were observed but at level of practically no problem. Further, some gloss irregularity and back-side sheet soiling were observed but they were also at a level of practically no problem. Damage on the fixing belt was at a level of no problem.

In Comparative Example 12, some increase in fog was recognized. The gloss irregularity was also at a level of no problem. Regarding the damage on the fixing belt, it was at a level of no problem after printing on 7000 sheets, but after printing on 10,000 sheets, fine scars were observed over the entire surface of the fixing belt, and a large number of toner-sticking spots were recognized to be originated from the scars. The bask-side sheet soiling was also observed after printing on 10,000 sheets presumably also attributable to the scars.

The results of evaluation are inclusively shown in Table 18 together with those of the following examples.

EXAMPLE 84

The print-out test of Example 81 was repeated while changing the pressure springs (25*a* and 25*b* in FIGS. 3 and 4) so as to apply a linear pressure of 1568 N/m (1.6 kg-f/cm) in a state of 80 $g/m^2$ paper being inserted and form a fixing nip N of 11.0 mm.

During and after the continuous printing test, clear fog-free images were obtained at sufficient image density for respective colors, while slight back-side sheet soiling was observed at a level of no problem. Damage on the fixing belt was at a level of no problem at all after printing on 7000 sheets, but was recognized to some extent after printing on 10,000 sheets. This might be associated with hot offset judging from the fact that slight toner melt-sticking was observed at the damaged part of the fixing belt after the continuous printing test.

EXAMPLE 85

The print-out test of Example 81 was repeated while changing the pressure springs (25*a* and 25*b* in FIGS. 3 and 4) so as to apply a linear pressure of 294 N/m (0.3 kg-f/cm) in a state of 80 $g/m^2$ paper being inserted and form a fixing nip N of 7 mm.

During and after the continuous printing test, clear fog-free images were obtained at sufficient image density for respective colors, while slight gloss irregularity and back-side sheet soiling were observed at a level of no problem. These defects were slightly observed only at the initial stage and might be attributable to a partial peeling of images due to insufficient fixation. The damage on the fixing belt was at a level of no problem at all.

The items of evaluation performed in the above Examples and Comparative Example and evaluation standards are supplemented hereinbelow.

[Print-out image evaluation]

<1> Image density (I.D.)

After printing on 10,000 sheets of A4-size plain paper (for CLC (color laser copier)) (80 g/m$^2$, made by Canon K.K.), image densities were measured at 5 points of a solid image by using a Macbeth reflection densitometer (made by Macbeth Co.), and an average of the 5 point image densities was recorded. (Incidentally, all the toner images formed at the initial stage of the continuous printing test exhibited an image density of 1.40 or higher.) Based on the measured 5 point-average image density after 10,000 sheet, the evaluation was performed according to the following standard.

A: ≧1.40

B: ≧1.35 and <1.40

C: ≧1.00 and <1.35

D: <1.00

<2> Image fog (Fog)

After continuous printing on 10,000 A4-size sheets, a white image (basically, toner free image) was by using each color toner, and the whiteness of the paper after printing and that of the blank paper were measured by using a reflect meter "Model TC-6DS", made by Tokyo Denshoku K.K.).

The degree of gloss irregularity was evaluated with respect to solid images of respective colors on the A4-size paper (80 g/m$^2$) and evaluated according to the following standard.

A: Not observed at all.

B: Substantially not observed.

C: Slightly observed but at a level of practically no problem.

D: Substantial gloss irregularity observed.

<4> Back-side sheet soiling (Back soil)

After the continuous printing on 10,000 A4-size sheets, the back-side of the image sheet was observed with respect to the soiling and evaluated according to the following standard.

A: Not observed at all.

B: Substantially not observed.

C: Slightly observed but at a level of practically no problem.

D: Substantial soiling observed.

<5> Damage of fixing belt

After printing on 7000 sheets and after printing on 10,000 sheets of A4-size CLC paper, the damages, such as abrasion or minute scars, on the fixing belt were observed with eyes and evaluated according to the following standard while confirming the damaged parts (when observed) in parallel with the solid images used for evaluating the gloss irregularity.

A: Not observed at all.

B: Substantially not observed.

C: Slightly observed but at a level of practically no problem.

D: Substantial damages observed.

TABLE 18

| | | | | | Evaluation results | | | | | | | | | | | | | | |
|---|---|---|---|---|---|---|---|---|---|---|---|---|---|---|---|---|---|---|---|
| Example | Toner Nos. | | | | Black (Bk) | | | Yellow (Ye) | | | Magenta (Ma) | | | Cyan (Cy) | | | Back soil | Damage on belt after | |
| | Bk | Ye | Ma | Cy | I.D. | Fog | Gloss | I.D. | Fog | Gloss | I.D. | Fog | Gloss | I.D. | Fog | Gloss | | 7000 sheets | 10000 sheets |
| Ex. 81 | 48 | 51 | 54 | 57 | A | A | A | A | A | A | A | A | A | A | A | A | A | A | A |
| Ex. 82 | 49 | 52 | 55 | 58 | A | B | B | A | B | B | A | B | B | A | B | B | B | A | A |
| Ex. 83 | 50 | 53 | 56 | 59 | B | C | B | B | C | B | B | C | B | B | C | B | C | A | A |
| Comp. 12 | 64 | 65 | 66 | 67 | B | A | B | B | A | B | B | A | B | B | A | B | D | B | D |
| Ex. 84 | 48 | 51 | 54 | 57 | A | A | A | A | A | A | A | A | A | A | A | A | C | A | C |
| Ex. 85 | 48 | 51 | 54 | 57 | A | A | B | A | A | B | A | A | B | A | A | B | B | A | A |

For the whiteness measurement, an Amberlite filter was used for a cyan toner, a blue filter was used for a yellow toner, and a green filter was used for other toners. Based on the measured whiteness values, fog values were calculated according to the following formula. A smaller value represents less fog.

Fog (%)=(Whiteness of blank paper)−(Whiteness of white background portion (non-image portion) of the paper after printing)

For the respective color toners, the evaluation was performed based on the measured fog value according to the following standard.

A: <1.5% (very good)

B: ≧1.5% and <2.5% (good)

C: ≧2.5% and <4.0% (fair)

D: ≧4.0% (poor)

<3> Gloss irregularity (Gloss)

EXAMPLES 86–92 AND COMPARATIVE EXAMPLE 13

Each toner was evaluated in the same manner as in Example 6 by using an image forming apparatus illustrated in FIG. 11.

More specifically in a normal temperature/normal humidity (23° C./60% RH) environment, a continuous image forming test was performed by using each of Toners 48–50, 60–63 and 68. Each image forming test was performed in a monochromatic continuous mode at a fixing speed of 190 mm/sec to form lateral line images in a printing areal ratio of 4% on 10,000 sheets.

As an evaluation, the printed image sheets were checked as to whether back side soiling due to offset toner was observed or not.

Further, the image density and fog of the printed images, and the influences of toner sticking onto and damage of the fixing belt on the soiling and deterioration of the resultant images, were evaluated after printing on 10,000 sheets. The damage on the fixing belt was also checked after printing on 7000 sheets.

As a result, in Example 86, even after the continuous printing test, a sufficient image density was obtained without causing any back-side (paper) sheet soiling.

In Comparative Example 13, the image density, fog and back-side sheet soiling were at remarkably inferior levels at the time of printing on 300 sheets, so that the image forming test was interrupted.

The results of evaluation are inclusively shown in Table 19. The evaluation items and evaluation standards are the same as the above.

TABLE 19

| | Toner used | | | | Evaluation results | | | | | |
|---|---|---|---|---|---|---|---|---|---|---|
| | | | | | | | | | Damage on belt after | |
| Example | Bk | Ye | Ma | Cy | I.D. | Fog | Gloss | Back soil | 7000 sheets | 1000 sheets |
| Ex. 86 | 48 | — | — | — | A | A | A | A | A | A |
| Ex. 87 | 49 | — | — | — | A | B | B | B | A | A |
| Ex. 88 | 50 | — | — | — | B | C | B | C | A | A |
| Ex. 89 | — | 60 | — | — | B | A | B | B | A | B |
| Ex. 90 | — | 61 | — | — | B | B | C | C | A | B |
| Ex. 91 | 62 | — | — | — | B | A | B | B | B | B |
| Ex. 92 | — | — | 63 | — | B | A | B | B | A | B |
| Comp. 13 | — | — | — | 68 | Stopped after 300 sheets | | | | | |

In Example 87, some increase in fog was recognized and some back-side sheet soiling occurred, but they were at a level of no problem at all. The damage on the fixing belt was not observed.

In Example 88, some image density lowering and fog increase were observed, but they were at a level of practically no problem. Further, some gloss irregularity and back-side sheet soiling were observed but they were also at a level of practically no problem. The damage on the fixing belt was not observed.

In Example 89, somewhat lower image density resulted than in Example 86. Further, some back-side sheet soiling occurred, but at a level of no problem at all. The damage on the fixing belt was not observed after printing on 7000 sheets, but slight scars were observed after 10,000 sheets while they were at a level of no problem.

In Example 90, the image density was somewhat lowered and fog increased than in Example 86. Further, some gloss irregularity and back-side sheet soiling were observed, but they were at a level of no problem. The damage on the fixing belt was recognized to some extent after 7000 sheets and somewhat increased after 10,000 sheets, but was at a level of no problem.

In Example 91, some image density lowering and gloss irregularity were observed compared with Example 86 but fog was at a level of no problem at all. Some degree of back-side sheet soiling occurred presumably due to deterioration of the fixing belt, but it was at a level of practically no problem. Some damages on the fixing belt were observed after 7000 sheets and after 10,000 sheets, but they were at a level of no problem.

In Example 92, some image density lowering and gloss irregularity were observed than in Example 86, but fog was at a level of no problem at all. Some back-side sheet soiling was observed presumably due to deterioration of the fixing belt, but it was at a level of practically no problem. The damage on the fixing belt was not observed after 7000 sheets but some damage was observed after 10,000 sheets while it was at a level of no problem.

EXAMPLES 93–96 AND COMPARATIVE EXAMPLE 14

By using an image forming apparatus identical to the one used in Examples 1–5 in a low temperature/low humidity (15° C./10% RH) environment, each of Toners 48–50, 62 and 68 (of which Toner 68 was comparative) was subjected to a monochromatic image print-out test for reproduction of a monochromatic image at an image density adjusted at 1.5 on 15 sheets continually supplied at a print-out speed of 12 A4-size sheets/min in a quick-start mode (i.e., image formation was started from a state where the fixing apparatus was left standing sufficiently to room temperature). The print-out images were evaluated in the same manner as in Example 13.

The results of the evaluation are inclusively show in Table 20.

TABLE 20

| Example | Toner No. | Fixability (rubbing test) 1st/15th |
|---|---|---|
| Ex. 93 | 48 | A/A |
| Ex. 94 | 49 | B/A |
| Ex. 95 | 50 | C/B |
| Ex. 96 | 62 | A/A |
| Comp. 14 | 68 | C/C |

The toners used in Examples 93–96 provided good results in the anti-rubbing fixability test. This may be attributable to factors, such as (1) the fixing apparatus could instantaneously generate and impart a sufficient fixing energy to the toner in response to the quick-start operation, (2) the supply of fixing heat was stably effected (without shortage or excess) in the continuous test, and (3) the moisture content in the toner was reduced to a prescribed low level. According to Examples 93–96, it was confirmed possible to provide a toner and an image forming method without requiring preheating of a fixing apparatus during a waiting time of the image forming apparatus, i.e., showing excellent quick-start characteristic and power economization characteristic.

On the other hand, Comparative Example 14 exhibited somewhat lower level of fixability and caused some "smoke".

COMPARATIVE EXAMPLE 15

The fixing apparatus in the image forming apparatus of Example 93 was replaced by a so-called surf-fixing apparatus, i.e., a fixing apparatus using a fixing belt for supplying a heat for fixation from a resistance heating member, in the apparatus of FIG. 9, heat generated from a heating means 113 disposed opposite a toner image $t_1$ was imparted to the toner image via a film member 111 inserted therebetween while forming a nip width of 7 mm and a linear pressure of 392 N/m (0.4 kg-f/cm). The fixing was performed at a speed of 72 mm/sec, a fixing nip proximity temperature of 190° C. and a warm-up time of 20 sec. The pressure roller 112 comprised a core metal coated successively with an elastic layer, a fluorine-containing rubber layer and a fluorine-containing resin layer. Except for using the surf fixing apparatus, a quick-start mode printing test (i.e., image formation from a sufficiently cooled room temperature state) was performed similarly as in Example 93 by using Toner 48 in a low temperature/low humidity (15° C./10% RH) environment. The stability of the fixed image was similarly evaluated by rubbing.

As a result, the image density lowering due to the rubbing amount to 12.7%, thus exhibiting an inferior fixability in the continuous image output.

EXAMPLES 97–100 AND COMPARATIVE EXAMPLE 16

By using an image forming apparatus identical to the one used in Example 86 in a low temperature/low humidity (15° C./10% RH) environment, each of Toners 48–50, 63 and 68 (of which Toner 68 was comparative) was subjected to a monochromatic image print-out test for reproduction of a monochromatic image at an image density adjusted at 1.5 on 15 sheets continually supplied at a print-out speed of 12 A4-size sheets/min in a quick-start mode (i.e., image formation was started from a state where the fixing apparatus was left standing sufficiently to room temperature). The print-out images were evaluated similarly as in Example 93. The results are inclusively shown in Table 2 below.

TABLE 21

| Example | Toner No. | Fixability (rubbing test) 1st/15th |
|---|---|---|
| Ex. 97 | 48 | A/A |
| Ex. 98 | 49 | B/A |
| Ex. 99 | 50 | C/B |
| Ex. 100 | 63 | A/A |
| Comp. 16 | 68 | C/C |

COMPARATIVE EXAMPLE 17

The quick-start mode printing test of Example 97 was repeated except for replacing the fixing apparatus used therein with a surface-fixing apparatus illustrated in FIG. 16 (identical to the one used in Comparative Example 7) and modifying the fixing conditions similarly as in Comparative Example 7. At that time, the film temperatures were 141° C. and 151° C. as indicated in FIG. 16.

As a result, the image density lowering due to the rubbing amount to 13.1% (at a level D), thus exhibiting an inferior fixability in the continuous image output.

What is claimed is:

1. An image forming method, comprising:

heating and pressing a toner image onto a recording material by heat-pressure means to form a fixed image on the recording material wherein said heat-pressure means comprises (i) magnetic flux generating means, (ii) a rotatable heating member having a heat generating layer capable of heat generation by electromagnetic induction and a release layer and (iii) a rotatable pressure member forming a fixing nip with the rotatable heating member, so that the toner image on the recording material is fixed under heat and pressure at the fixing nip under a temperature distribution around the fixing nip satisfying: $Z3 \leqq Z2 < Z1$, wherein Z1 is a temperature at a position before entering the fixing nip; Z2 is a temperature at a position after passing the fixing nip and Z3 is a temperature at a position before causing heat generation, respectively, of the rotatable heating member, by pressing the rotatable pressure member against the rotatable heating member via the recording material, the toner image is formed of a toner comprising toner particles each containing at least a binder resin and a colorant, the toner has a moisture content of at most 3.00 wt. %, and the toner has a storage modulus at 110° C. of G' (110° C.) and a storage modulus at 140° C. of G' (140° C.) satisfying:

$$G'(110°\ C.) \leqq 1.00 \times 10^6\ dN/m^2, \text{ and}$$

$$G'(140°\ C.) \geqq 7.00 \times 10^3\ dN/m^2.$$

2. The method according to claim 1, wherein the toner has a residual monomer content of at most 300 ppm by weight of the toner.

3. The method according to claim 1, wherein the toner has an average circularity of at least 0.940.

4. The method according to claim 1, wherein the toner has an average circularity of at least 0.960.

5. The method according to claim 1, wherein said rotatable heating member has a heat generating layer in a thickness of 1–200 $\mu$m and a release layer in a thickness of 1–100 $\mu$m, forms a nip in a width of 5–15 mm with the rotatable pressure member, and heats and presses the toner image on the recording material to fix the toner image at a fixing speed of at most 400 mm/sec under application of a linear pressure of 490–1372 N/m (0.5–1.4 kg-f/cm) acting between the rotatable heating member and the rotatable pressure member in the presence of the recording material therebetween.

6. The method according to claim 5, wherein said rotatable heating member further includes an elastic layer.

7. The method according to claim 6, wherein the elastic layer has at thickness of 10–500 $\mu$m.

8. The method according to claim 5, wherein said rotatable heating member has a peripheral length La and said rotatable pressure member has a peripheral length Lb, satisfying:

$$0.4 \times La \leqq Lb < 0.95 \times La < 400\ mm.$$

9. The method according to claim 8, wherein the heat-generating layer of said rotatable heating member generates heat at least in a region of from a point of La/4 upstream of a fixing nip center to a point of La/8 downstream of the nip center, relative to the peripheral length La of the rotatable heating member.

10. The method according to claim 5, wherein the rotatable heating member has a temperature Z1 of below 250° C. before entering the fixing nip.

11. The method according to claim 5, wherein the toner has a moisture content of at most 2.00 wt. %, and a residual monomer content of at most 200 ppm by weight of the toner.

12. The method according to claim 5, wherein the toner has a moisture content of at most 1.00 wt. %, and a residual monomer content of at most 100 ppm by weight of the toner.

13. The method according to claim 1, wherein said rotatable heating member further includes an elastic layer.

14. The method according to claim 13, wherein the elastic layer has thickness of 10–500 $\mu$m.

15. The method according to claim 1, wherein said rotatable heating member has a peripheral length La and said rotatable pressure member has a peripheral length Lb, satisfying:

$$0.4 \times La \leqq Lb < 0.95 \times La < 400 \text{ mm}.$$

16. The method according to claim 15, wherein the heat-generating layer of said rotatable heating member generates heat at least in a region of from a point of La/4 upstream of a fixing nip center to a point of La/8 downstream of the nip center, relative to the peripheral length La of the rotatable heating member.

17. The method according to claim 1, wherein the rotatable heating member has a temperature Z1 of below 250° C. before entering the fixing nip.

18. The method according to claim 1, wherein the toner has a moisture content of at most 2.00 wt. %.

19. The method according to claim 1, wherein the toner has a residual monomer content of at most 200 ppm by weight of the toner.

20. The method according to claim 1, wherein the toner has a moisture content of at most 1.00 wt. %.

21. The method according to claim 1, wherein the toner has a residual monomer content of at most 100 ppm by weight of the toner.

22. The method according to claim 1, wherein the toner has a maximum heat absorption peak temperature in a range of 50–150° C. on a DSC curve taken in a range of 20–200° C.

23. The method according to claim 1, wherein the toner has a maximum heat evolution peak temperature in a range of 40–150° C. on a DSC curve taken in a range of 20–200° C.

24. The method according to claim 1, wherein the toner comprises toner particles obtained through polymerization.

25. The method according to claim 1, wherein the toner has a mode circularity of at least 0.990.

26. The method according to claim 1, wherein the toner further includes hydrophobized inorganic fine powder having an average primary particle size of 4–80 nm.

27. The method according to claim 26, wherein the inorganic fine powder has been hydrophobized by treatment with a silane compound.

28. The method according to claim 1, wherein the toner comprises toner particles and inorganic fine powder having an average primary particle size of 4–80 nm, and the toner has a storage modulus at 110° C. of G' (110° C.) and a storage modulus at 140° C. of G' (140° C.) satisfying:

$$G'\ (110°\ \text{C.}) \leqq 7.00 \times 10^5\ \text{dN/m}^2,$$

and $$G'\ (140°\ \text{C.}) \geqq 1.00 \times 10^4\ \text{dN/m}^2.$$

29. The method according to claim 28, wherein the toner has an average circularity of at least 0.940, a moisture content of at most 2.00 wt. %, and a residual monomer content of at most 200 ppm by weight of the toner.

30. The method according to claim 1, wherein the toner comprises a blend of toner particles and inorganic fine powder having an average particle size of 4–80 nm externally added thereto.

31. The method according to claim 1, wherein the toner comprises toner particles obtained through suspension polymerization.

* * * * *

UNITED STATES PATENT AND TRADEMARK OFFICE

CERTIFICATE OF CORRECTION

PATENT NO. : 6,544,708 B2 
DATED : April 8, 2003
INVENTOR(S) : Keiji Komoto et al.

It is certified that error appears in the above-identified patent and that said Letters Patent is hereby corrected as shown below:

Column 3,
Line 6, “cause” should read -- caused --.

Column 8,
Line 41, “constitution” should read -- constitutes --.

Column 11,
Line 10, “beore,” should read -- before --.

Column 15,
Line 8, “fail” should read -- failure --.

Column 16,
Line 40, “fixing” should read -- fixing --, and “Process” should read -- process --.

Column 17,
Line 16, “crossection” should read -- cross section --.

Column 22,
Line 48, “than” should read -- than at --.

Column 23,
Line 50, “effect” should read -- effective --.

Column 24,
Line 22, “fixing member.” should read -- fixing member is prevented --.

Column 25,
Line 10, “a” should be deleted.

Column 26,
Line 5, “due” shold read -- due to --.

Column 28,
Line 9, “an din” should read -- and in --;
Line 23, “according” should read -- according to --;
Line 44, “a” should read -- resins. --.

Column 31,
Line 6, “prepare” should read -- preparation --.

UNITED STATES PATENT AND TRADEMARK OFFICE

CERTIFICATE OF CORRECTION

PATENT NO. : 6,544,708 B2
DATED : April 8, 2003
INVENTOR(S) : Keiji Komoto et al.

It is certified that error appears in the above-identified patent and that said Letters Patent is hereby corrected as shown below:

Column 33,
Line 5, “preferred” should read -- as preferred --;
Lines 13-15, “to well mutually dissolve the resins are dispersed the colorant or magnetic material” should read -- to mutually dissolve or disperse the resin, the colorant and magnetic material --;
Line 66, “fixed” should read -- be fixed --.

Column 34,
Line 4, “gap” should read -- gaps --.

Column 35,
Line 66, “Surface-treated” should read -- surface treated --.

Column 37,
Line 17, “10 to” should read -- to 10 --.

Column 38,
Line 40, “dopted” should read -- adopted --.

Column 40,
Line 53, “show” should read -- shown --.

Column 41,
Line 1, “electromagnetically inductions” should read -- electromagnetically induced --;
Line 59, “level” should read -- a level --.

Column 42,
Line 17, “leave” should read -- level --.

Column 47,
Line 3, “member, in” should read -- member. In --;
Line 38, “to” should read -- at --.

Column 49,
Table 6, “polyestre” should read -- polyester --.

Column 51,
Line 31, “nd” should read -- and --.

UNITED STATES PATENT AND TRADEMARK OFFICE

CERTIFICATE OF CORRECTION

PATENT NO. : 6,544,708 B2
DATED : April 8, 2003
INVENTOR(S) : Keiji Komoto et al.

It is certified that error appears in the above-identified patent and that said Letters Patent is hereby corrected as shown below:

Column 57,
Line 16, “member, in” should read -- member. In --;
Line 45, “to” should read -- at --.

Column 61,
Line 1, “an” should read -- and --.

Column 62,
Table 17, “moduolus” should read -- modulus --.

Column 63,
Table 17, “moduolus” should read -- modulus --.

Column 65,
Line 30, “was” should read -- was formed --.

Column 68,
Line 41, “show” should read -- shown --.

Column 69,
Line 6, “member, in” should read -- member. In --;
Lines 22 and 59, “lowering” should read -- lowered --.

Column 70,
Line 50, “at” should read -- a --.

UNITED STATES PATENT AND TRADEMARK OFFICE

CERTIFICATE OF CORRECTION

PATENT NO. : 6,544,708 B2
DATED : April 8, 2003
INVENTOR(S) : Keiji Komoto et al.

It is certified that error appears in the above-identified patent and that said Letters Patent is hereby corrected as shown below:

Column 71,
Line 10, “has” should read -- has a --.

Signed and Sealed this

Ninth Day of March, 2004

JON W. DUDAS
*Acting Director of the United States Patent and Trademark Office*